US012622491B2

(12) United States Patent
Soderberg

(10) Patent No.: US 12,622,491 B2
(45) Date of Patent: May 12, 2026

(54) FASTENING SYSTEM AND METHOD(S)

(71) Applicant: ZIPZON, LLC, Conifer, CO (US)

(72) Inventor: Mark S. Soderberg, Conifer, CO (US)

(73) Assignee: Zipzon, LLC, Conifer, CO (US)

( * ) Notice: Subject to any disclaimer, the term of this patent is extended or adjusted under 35 U.S.C. 154(b) by 0 days.

(21) Appl. No.: 19/098,889

(22) Filed: Apr. 2, 2025

(65) Prior Publication Data

US 2025/0228337 A1 Jul. 17, 2025

Related U.S. Application Data

(63) Continuation of application No. 19/045,405, filed on Feb. 4, 2025, now Pat. No. 12,290,152, which is a continuation of application No. 18/943,797, filed on Nov. 11, 2024, now Pat. No. 12,232,577, which is a continuation of application No. 18/217,433, filed on Jun. 30, 2023, now Pat. No. 12,156,573, which is a continuation-in-part of application No. 17/974,697, filed on Oct. 27, 2022, now Pat. No. 11,805,855.

(51) Int. Cl.
*A44B 11/06* (2006.01)

(52) U.S. Cl.
CPC ..... *A44B 11/065* (2013.01)

(58) Field of Classification Search
CPC ..... A44B 11/06; A44B 11/16; A44B 11/10; A44B 11/12; A44B 11/2523; A44B 11/005; A44B 11/02; A44B 11/065; A43C 11/146; A43C 11/14
See application file for complete search history.

(56) References Cited

U.S. PATENT DOCUMENTS

2016/0051014 A1* 2/2016 Resnick ..... G04B 37/0008 24/484
2016/0198783 A1* 7/2016 Ryou ..... A44B 11/2592 24/482
2022/0333668 A1* 10/2022 Piao ..... A44B 11/26

* cited by examiner

*Primary Examiner* — Patrick J. Lynch
(74) *Attorney, Agent, or Firm* — Leydig, Voit & Mayer, Ltd.

(57) ABSTRACT

A fastening system for an object (e.g., a wearable such as footwear) is disclosed that includes a buckle assembly and a strap for adjusting tension. The buckle assembly includes a base and a slider engaged with the base. The strap includes an array of teeth to engage with a pawl formed on the base. The fastening system is configurable between an engaged condition and a released condition based on the positioning of the slider relative to the base.

9 Claims, 45 Drawing Sheets

FASTENING SYSTEM AND METHOD(S)

CROSS REFERENCE TO RELATED APPLICATION(S)

The present application is a continuation of U.S. patent application Ser. No. 19/045,405 entitled "FASTENING SYSTEM AND METHOD(S)," filed 4 Feb. 2025 by MARK S. SODERBERG, which is a continuation of U.S. patent application Ser. No. 18/943,797 (now U.S. Pat. No. 12,232,577) entitled "FASTENING SYSTEM AND METHOD(S)," filed 11 Nov. 2024 by MARK S. SODERBERG, which is a continuation of U.S. patent application Ser. No. 18/217,433 (now U.S. Pat. No. 12,156,573) entitled "FASTENING SYSTEM AND METHOD(S)," filed 30 Jun. 2023 by MARK S. SODERBERG, which claims priority to and is a Continuation-In-Part (CIP) of U.S. Non-Provisional patent application Ser. No. 17/974,697 (now U.S. Pat. No. 11,805,855), entitled "FASTENING SYSTEM AND METHOD(S)," and filed 27 Oct. 2022 by MARK S. SODERBERG. The entirety of the applications above are incorporated herein by reference for all purposes.

TECHNICAL FIELD

This disclosure relates generally to fastening devices, and particularly to a ratchet-based fastener device and methods of fastening, for example, wearables such as footwear.

BACKGROUND

Conventional fastening systems for wearables (e.g., footwear) include laces, straps, belts, hook-and-loop, buckles, etc. These conventional fastening systems have limitations ranging from low binding force to difficulty of use.

SUMMARY

The disclosed fastening system (and variants thereof) may be used in many applications ranging from wearables (e.g., footwear, clothing, baggage, helmets, etc.) to industrial applications (e.g., closure mechanisms, attachment devices, security devices, etc.). The fastening system may be configured for tightening footwear or for bundling and attaching individual objects (e.g., electrical cables, wires, etc.). In its simplest form, the fastening system includes a strap and a buckle assembly adjustable relative to each other. While the buckle and strap may be formed together (i.e., in a circular configuration), one configuration has the strap and buckle assembly as separate components (e.g., for use as a fastening system for footwear). If configured for footwear (e.g., a shoe, boot, sandal, ski boot, work boot, etc.), the strap is attached to one portion of a shoe while the buckle assembly is attached to a different portion of the shoe. Actuating the strap and buckle assembly causes the two different areas of the shoe to move closer or further away from each other. While specific examples, configurations, and/or applications of the present fastening system are provided, it is to be understood that granted claims ultimately define the breadth and depth of the present disclosure. The following example(s) on footwear are meant to illustrate the present fastening system.

In one illustrative configuration of the present disclosure, the fastening system includes a buckle assembly and a strap attached to a shoe such that the strap passes through the buckle assembly. The buckle assembly is configured to engage or disengage the strap, thereby respectively enabling the preservation or increase and decrease of the tightness of the shoe. The buckle assembly can be manipulated by a user, for example, by using digits on their hands such as an index finger and a thumb to tighten or release the strap the buckle assembly may hold. The buckle assembly may include a lifter movable relative to the strap when the strap is engaged with the buckle assembly. The user can manipulate the lifter by acting on components (e.g., a slider) of the buckle assembly to selectively engage or disengage holding components, thereby tightening, loosening, or releasing the strap. Further, the buckle assembly allows the strap to be inserted or moved relative to the buckle assembly without fully releasing tension in the strap. Further, the fastening system provides for ready access and easy manipulation by the user (e.g., using the index finger and a thumb) to partially or fully release the strap from the buckle assembly.

The fastening system is a low-cost, intuitive, and easy-to-use device that provides binding strength suitable for many other applications. The fastening system may be made of a flexible material, for example, a plastic (e.g., thermoplastics such as nylon, urethane, etc.). The strap of the fastening system is an elongated structure defining a distal end and a proximal end and may include a plurality of teeth provided to position the strap. The buckle assembly may include at least one pawl that selectively engages the plurality of teeth for adjustably positioning the buckle assembly relative to the strap. It is noted that the term 'pawl' may mean one or more pawls (e.g., the illustrated configuration with 3 individual pawls that are referred to herein as a 'pawl'). When the strap is moved (e.g., pulled, pinched, or pushed) relative to the buckle assembly, the strap is tensioned and stays tensioned until a trigger/slider (of the buckle assembly) is actioned to disengage the strap away from the pawl (e.g., moving the strap away from the pawl to disengage the plurality of teeth). Movement of the strap relative to the pawl, partially or entirely, releases the tension in the strap.

The buckle assembly may include a base and a trigger (e.g., a slider). The base may include a bottom and a top. The bottom of the base may be fixed against an object. The top of the base is oppositely disposed from the bottom. In a configuration, a pawl (or plurality of pawls) may be formed on the top of the base. The buckle assembly may include the slider slidingly engaged to the base and configured to move between a first and second position. In one illustrative configuration, the strap may include a proximal end, a distal end, a front surface, and a back surface. The proximal end may be configured to attach to the object. The distal end may be oppositely disposed from the proximal end.

The strap may include a front surface that may be disposed between a proximal end and a distal end. The strap may include a parallel back surface and offset from the front surface. In one illustrative configuration, the strap may include an array of teeth formed on the back surface, so the array of teeth may be slidingly adjacent to the object. Between the base and the slider, the fastening system may include an engaged section for engagement or disengagement of the pawl and the teeth in an engaged and released condition, respectively. In the engaged condition, the slider may be positioned at the first position and offset from the top of the base by a first distance such that the pawl engages or adjoins the array of teeth. Further, in the released condition, the slider may be positioned at the second position and offset from the top of the base by a second distance. The second distance may be greater than the first distance. A biasing member may be disposed between the slider and the base in another configuration. The biasing member may facilitate the return of the slider from the second position to the first position.

In one illustrative configuration, the buckle assembly may further include a cap. The cap may adjoin the biasing member. Further, the cap may be fastened to the base. The cap may be formed into the base as a single unit in alternative configurations. These and other configurations may be required to meet production, operation, and/or financial requirements.

In another illustrative configuration, the base may further include a first wall and a second wall protruding from the top, such that the first wall may be parallel and offset from the second wall by a width. The slider may be configured to slide relative to the base. The first wall may include a first ramp formed on the first wall and a second ramp on the second wall. The slider may be configured to engage the first and second ramps. In a configuration, the slider may include a first condition. The first guide may be slidingly engaged with the first ramp of the base, and the second guide may be slidingly engaged with the second ramp of the base. The first and second guides may align with the slider at the first, second, and between positions.

In one illustrative configuration, the buckle assembly may further include a lifter. The lifter may be positioned adjacent to the slider. The lifter may be fastened to the slider or formed into the slider as a single unit. The lifter further may include a clamp that may receive the strap and allow the strap to pass therethrough. After the strap is passed through the clamp, the strap may be lifted by the lifter when the slider is transitioned from the first position to the second position. As a result of the lifting of the strap, the pawl and the array of teeth are disengaged, thereby releasing the strap from the buckle assembly.

The buckle assembly may include a stopper in the same or different illustrative configuration. The stopper may be disposed at a distal end of the base. In the region adjacent to the stopper and between the first wall and the second wall, a pathway may be formed, which facilitates movement of the lifter thereto. The stopper may be further configured to confine the movement of the lifter within the pathway.

In another illustrative configuration, the strap may include an array of teeth. Each tooth of the array of teeth may include a slope and a flank. The slope and the flank of the same tooth meet to define a peak, and the slope and the flank of the adjacent tooth meet to define a root. The slope may be inclined to a tangential line through the root at a first angle, and the flank may be inclined to the tangential line through the root at a second angle. The first angle and the second angle are less than 90 degrees.

In one illustrative configuration, in the buckle assembly, the front surface may be formed as a first arc with a first radius of curvature, and the buckle assembly may form a second arc with a second radius of curvature. In the same configuration, the first radius of curvature may be less than the second radius of curvature, when measured from a common center of curvature.

In yet another illustrative configuration, the strap may further include a first rib. The first rib may be formed on the front surface. In another configuration, the slider may include a first rib guideway. The first rib guideway may slidingly engage with the first rib of the strap to reduce friction between the strap and the slider. In another configuration, the strap may include a second rib, and the slider may include a second rib guideway. The second rib may be formed parallel and offset from the first rib, so the second rib passes through the second rib guideway.

A method of operating the fastening system is disclosed. The method may include providing a buckle assembly on an object. Further, the method may include providing a strap. Further, the method may include attaching a proximal end of the strap on to the object. The method may include engaging a section of the strap between the base and the slider. The method may include alternately transitioning the buckle assembly between an engaged condition and a released condition. In the engaged condition, the slider may be positioned at a first position, and may be offset from the top of the base by a first distance. In the released condition, the slider may be positioned at a second position, and may be offset from the top of the base by a second distance. The second distance may be greater than the first distance. In the released condition, the strap may be free-to-move relative to the buckle assembly.

The method may include unfastening the strap from the object by manipulating the slider relative to the base from the first position to the second position, thereby positioning the slider at the second position and offsetting the slider from the top of the base by the second distance. Further, the method may include moving the strap to disengage the section of the strap from the base and the slider.

In another illustrative configuration, a method of operating the fastening system is disclosed. The method may include providing a buckle assembly on an object. The buckle assembly may include a bottom, a top, a pawl formed on the top, and a first digit surface formed on the top. The buckle assembly may further include a slider slidingly attached to the base. The slider may include a digit surface configured to receive a user's digit (e.g., their finger or thumb). Further, the method may include providing a strap. The strap may include a proximal end, a digit surface formed on the proximal end, a distal end oppositely disposed of the proximal end, a front surface between the proximal end and the distal end, and a back surface parallel to and offset from the front surface, and an array of teeth formed on the back. The method may include attaching the proximal end of the strap to the object. The method may include engaging a section of the strap between the base and the slider. The method may include alternately transitioning the buckle assembly between an engaged condition and a released condition. In the engaged condition, the slider may be positioned at a first position and may be offset from the top of the base by a first distance. In the released condition, the slider may be positioned at a second position and may be offset from the top of the base by a second distance. The second distance may be greater than the first distance. In the released condition, the strap may be free-to-move relative to the buckle assembly.

In another illustrative configuration, a method may include forming a strap distance between the digit surface and the digit surface in the engaged condition. The method may further include forming a sliding distance between the position of the first digit surface in engaged condition, and the position of the first digit surface in the released condition.

In another configuration, the method may include engaging the pawl with the array of teeth by manually applying equal and opposite forces to the digit surface and the digit surface. The application of equal and opposite forces enables the strap to cover the strap distance to tighten the fastening system. The method may further include disengaging, in the released condition, the pawl and the array of teeth. The disengagement may be enabled by manually applying equal and opposite forces to the first digit surface and the digit surface such that the slider covers the sliding distance. In this configuration, the strap distance is greater than the slider distance.

In another configuration, the base may include the pawl. The pawl, as explained earlier, may include a plurality of counter teeth. The plurality of teeth may be designed in accordance with the array of teeth of the strap. The pawl may be configured to engage the array of teeth in a least invasive manner, such that no damage or wear may be subjected on to the array of the teeth of the strap, thereby increasing robustness of the fastening system.

In another configuration, as explained earlier, the strap may be formed as an arc-type structure, and the array of teeth formed at the bottom surface of the strap. Such configuration may enable the strap to be adequately biased and supported on the object and prevent excessive or unwanted movement of the strap against the object.

In another illustrative configuration, as explained earlier, the first guide and the second guide may slidingly engage the first ramp and the second ramp, respectively. In such configuration, the slider may transition from the first position to the second position by sliding the first guide and the second guide on the first ramp and the second ramp. In this configuration, the lifter may also move along with the slider to create a lifting action for the strap. The strap, after being lifted, may be disengaged from the pawl, and hence, the strap may be totally free-to-move with respect to the buckle assembly. Such configuration may enable ease of use of the fastening system, as the strap may be easily moved for tightening or loosening the object.

BRIEF DESCRIPTION OF THE DRA WINGS

The accompanying figures of the drawing, which are included to provide a further understanding of general aspects of the system/method, are incorporated in and constitute a part of this specification. These illustrative aspects of the system/method, and together with the detailed description, explain the principles of the system. No attempt is made to show structural details in more detail than is necessary for a fundamental understanding of the system and various ways in which it is practiced. The following figures of the drawing include:

FIG. 16 illustrates a released condition;

Figure 59A:
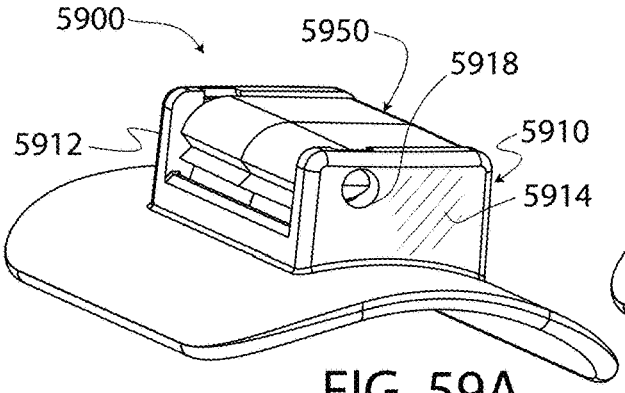
FIGS. 59A and 59B illustrate a top perspective view of an anchor for holding a web of material in a closed condition and an exploded condition, respectively.
Figure 59B:
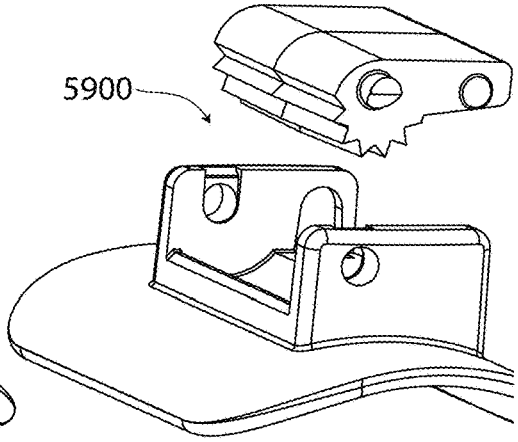
Figure 60:
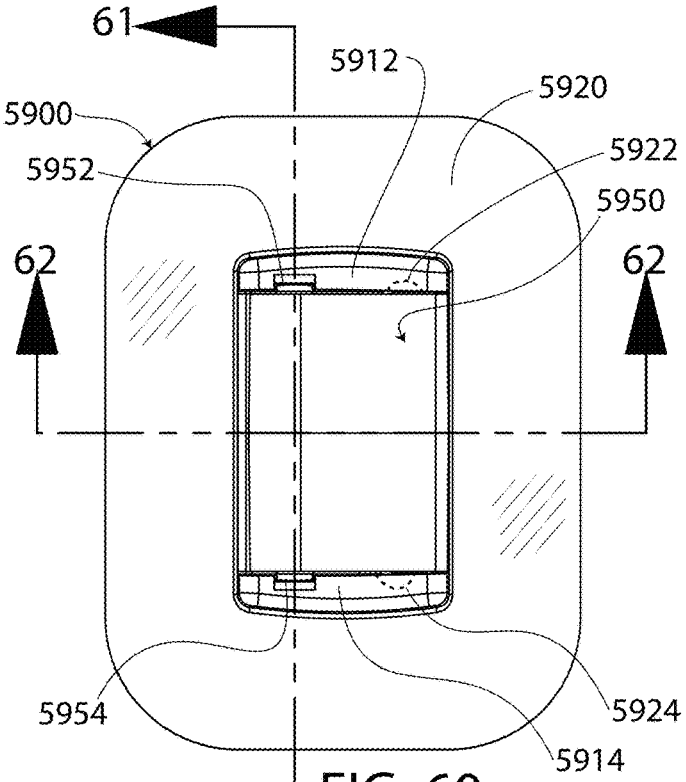
FIG. 60 illustrates top view of the anchor of FIGS. 59A and 59B.
Figure 62A:
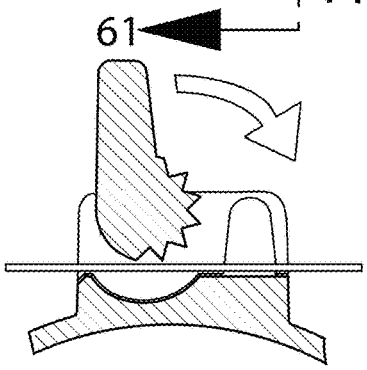
Figure 62B:
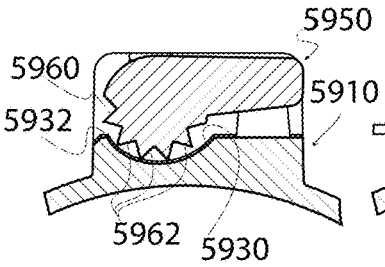
Figure 62C:
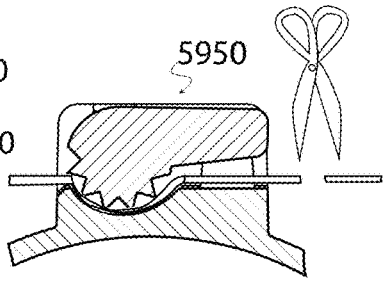
Figure 63:
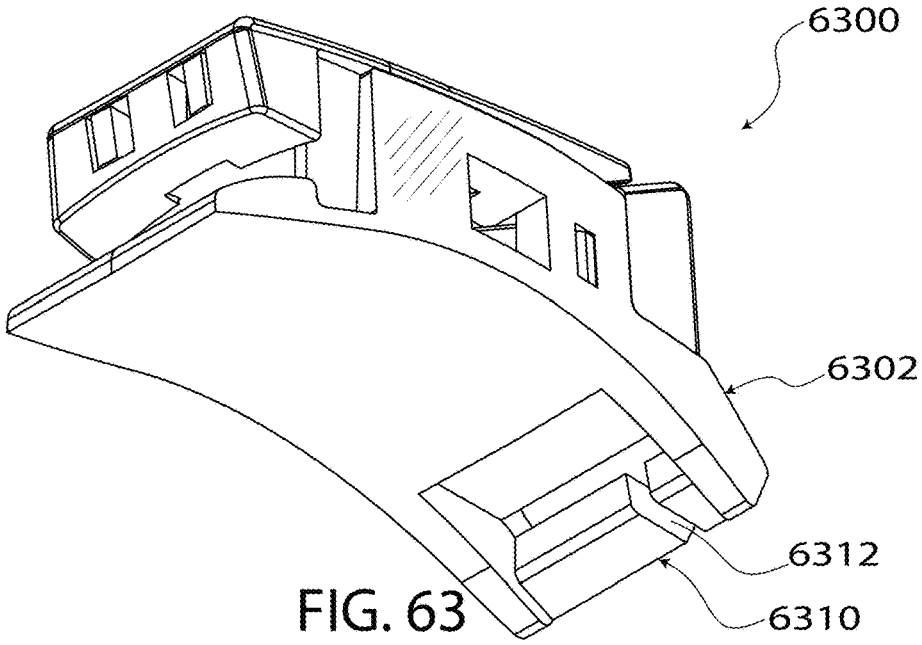
Figure 64:
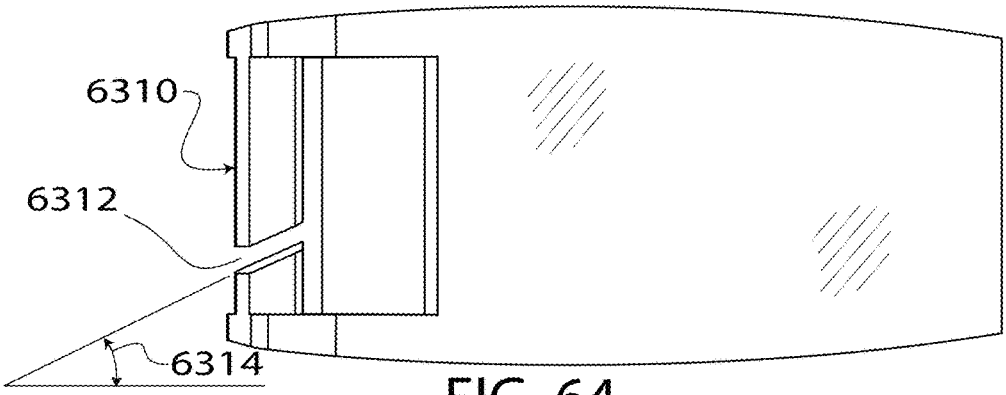
Figure 65:
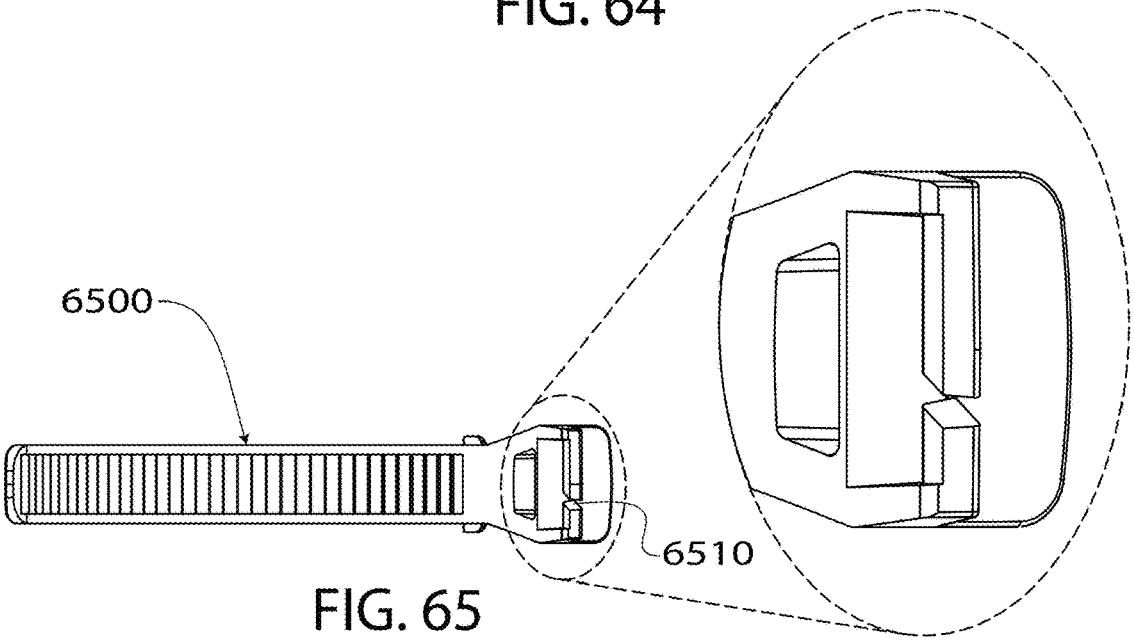
Figure 66:
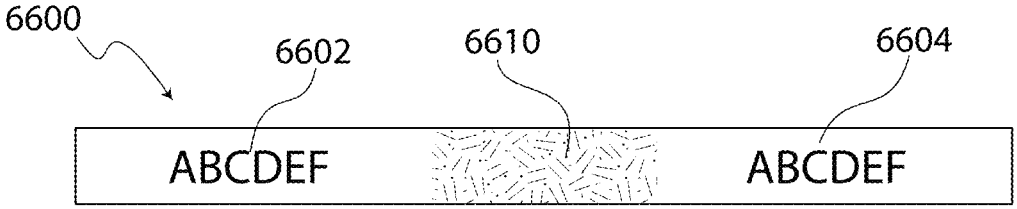
Figure 67:
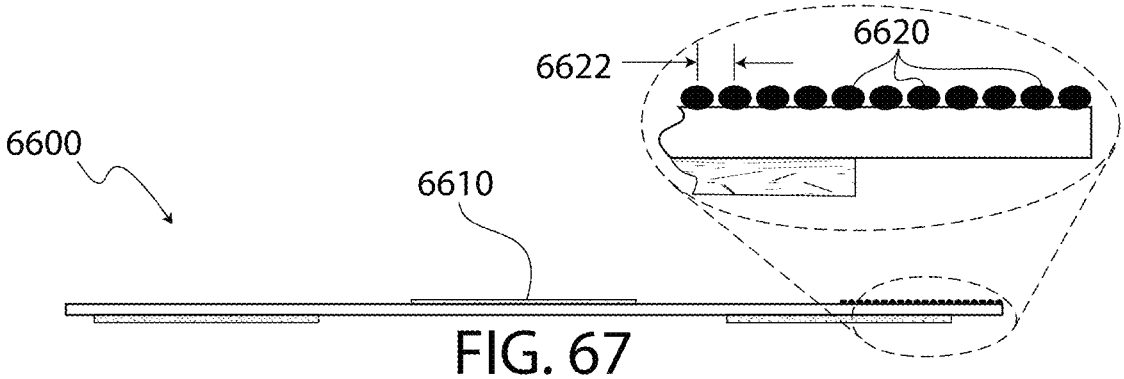
Figure 68:
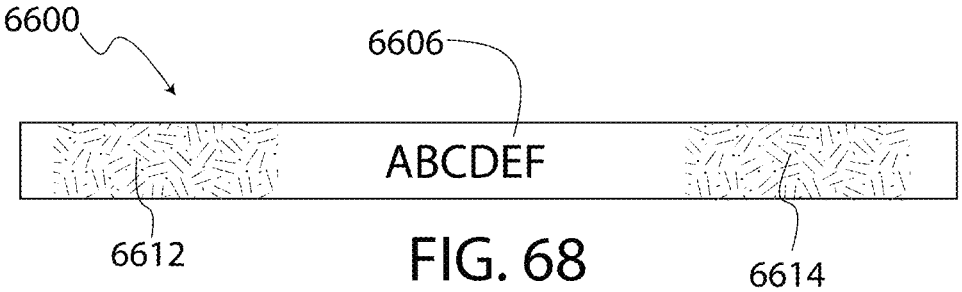
Figure 69:
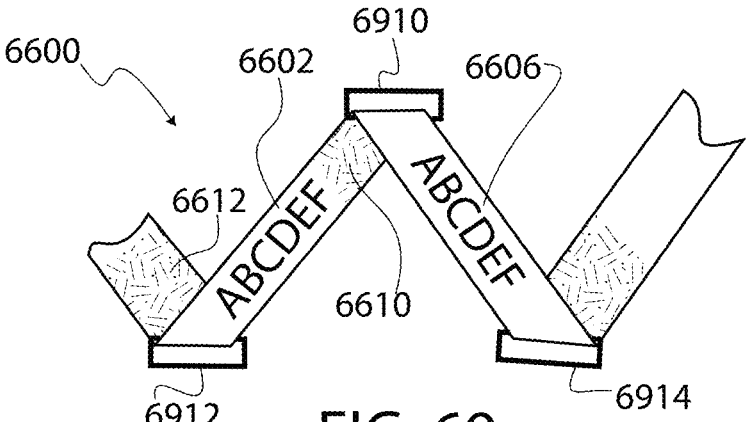
Figure 70:
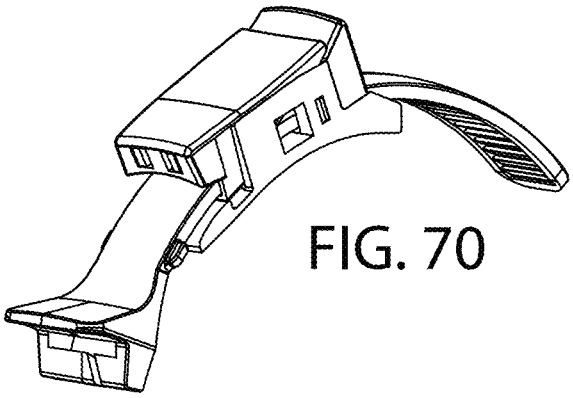
Figure 71:
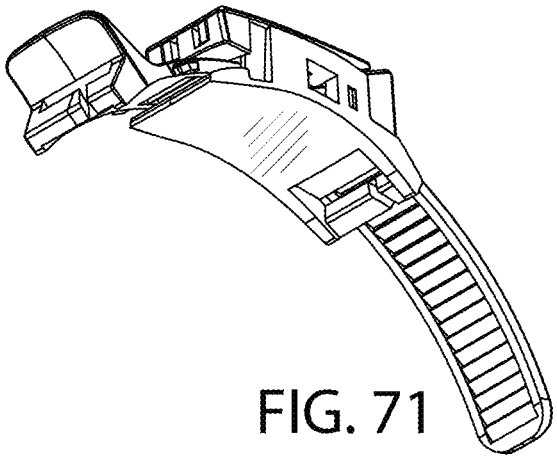
Figure 72:
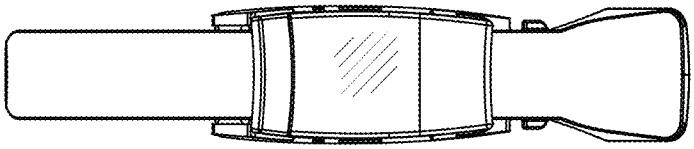
Figure 73:
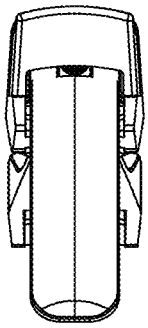
Figure 74:
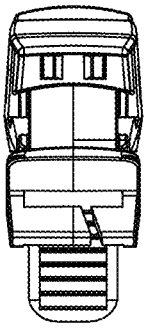
Figure 75:
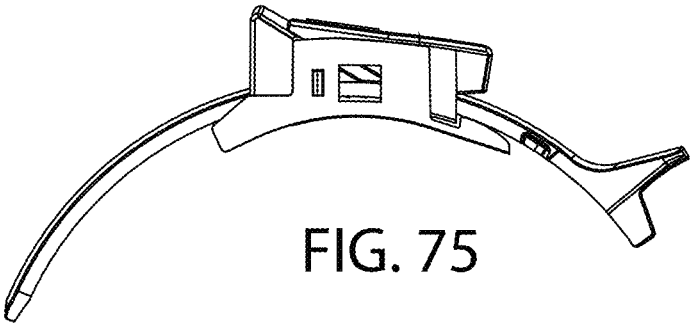
Figure 76:
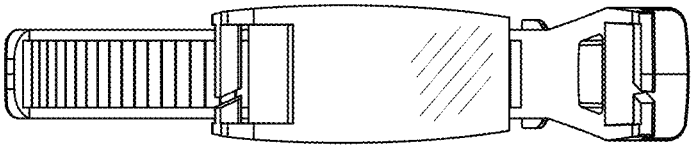
Figure 77:
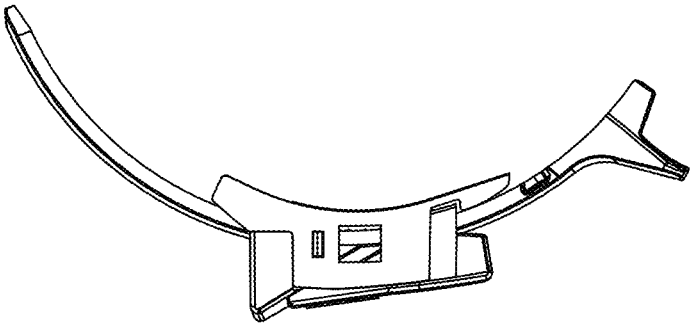
Figure 78:
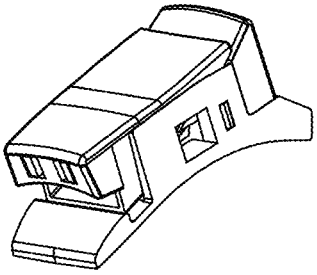
Figure 79:
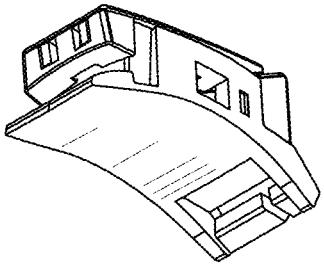
Figure 80:
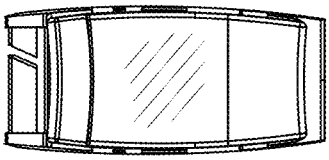
Figure 81:
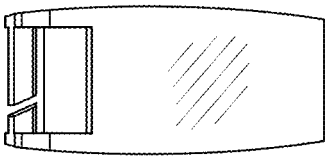
Figure 82:
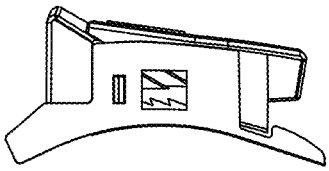
Figure 83:
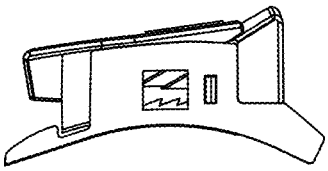
Figure 84:
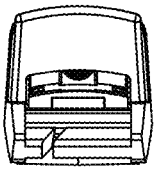
Figure 85:
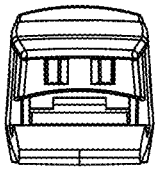
Figure 86:
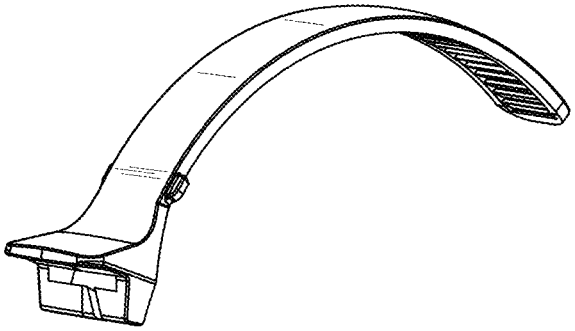
Figure 87:
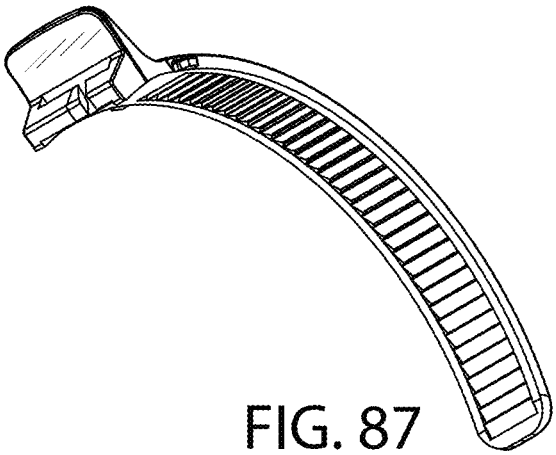
Figure 88:
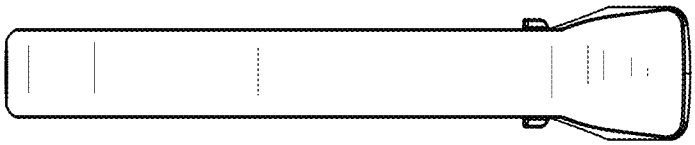
Figure 89:
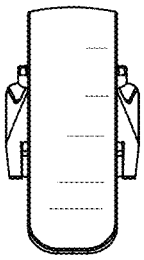
Figure 90:
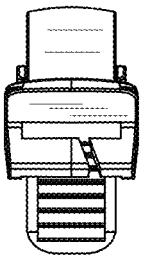
Figure 91:
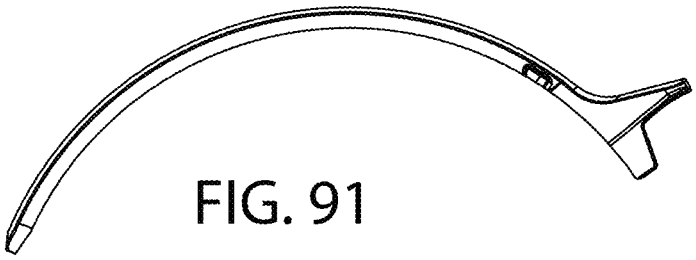
Figure 92:
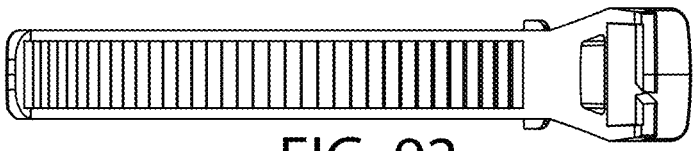
Figure 93:
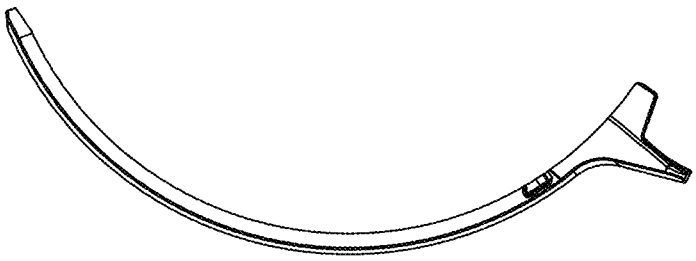
Figure 94:
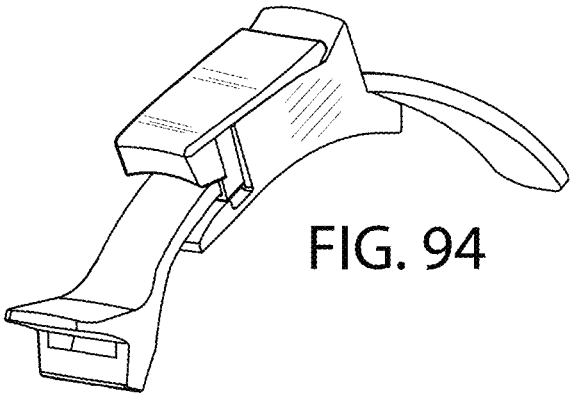
Figure 95:
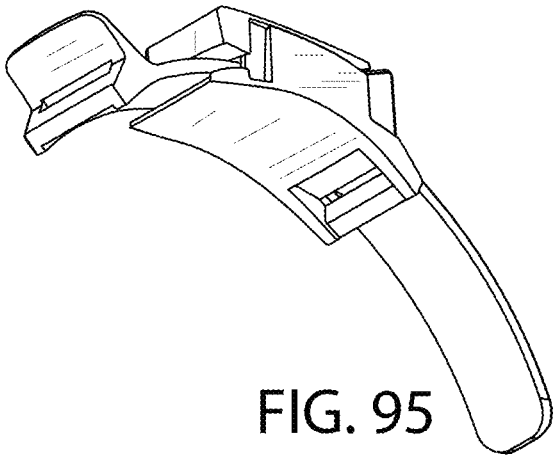
Figure 96:
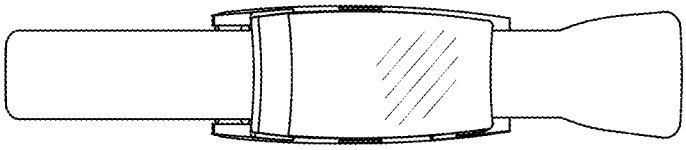
Figure 97:
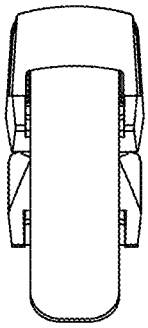
Figure 98:
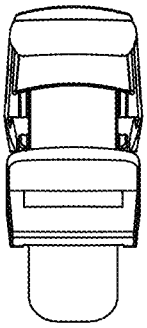
Figure 99:
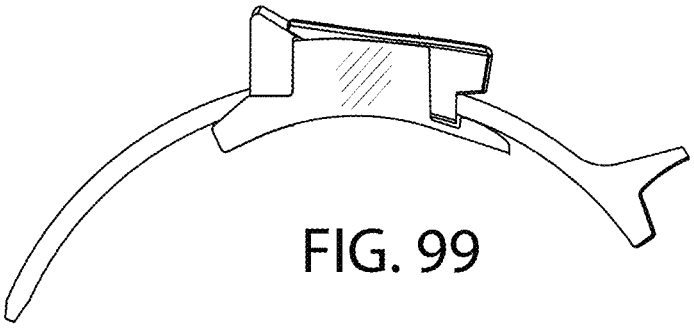
Figure 100:
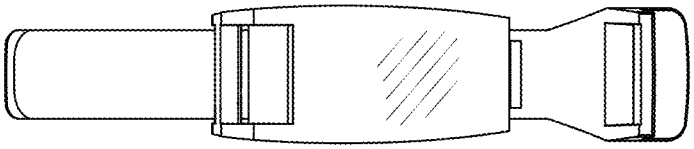
Figure 101:
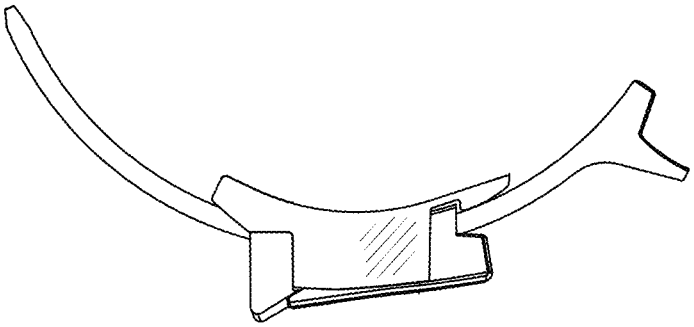
Figure 102A:
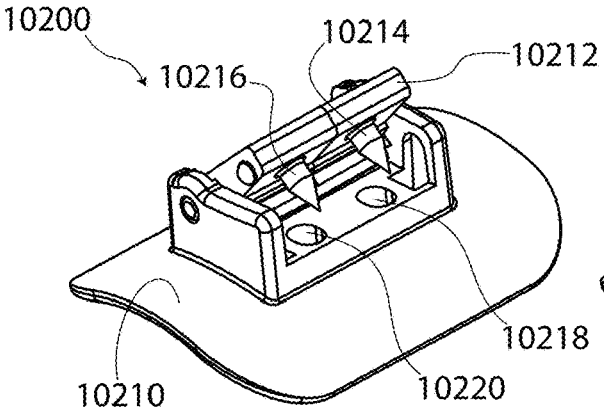
Figure 102B:
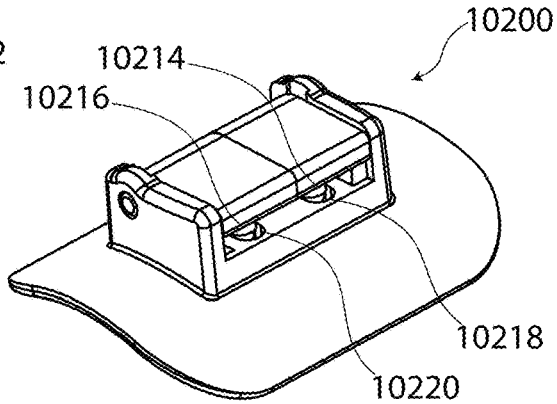
Figure 103:
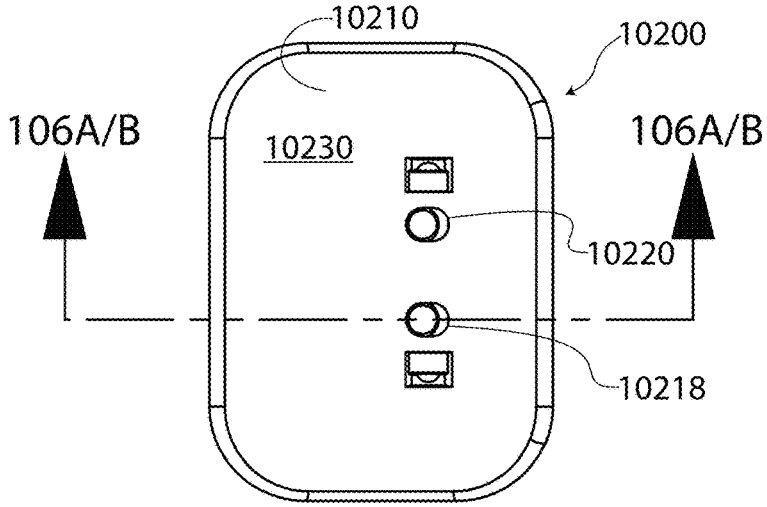
Figure 104:
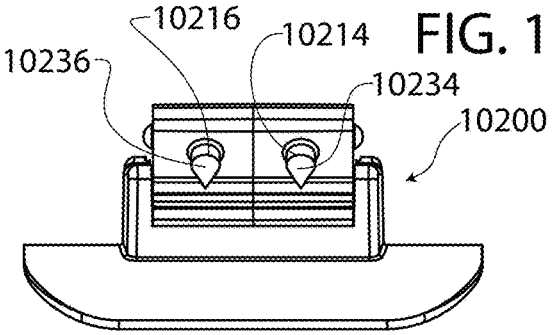
Figure 105:
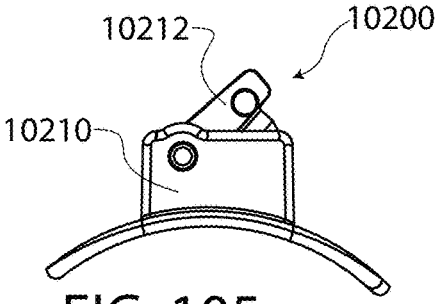
Figure 106A:
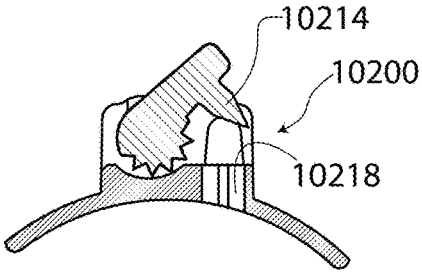
Figure 106B:
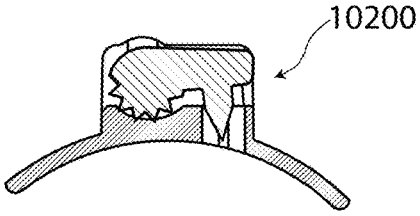

FIGS. 62A, 62B, and 62C illustrate a cross-sectional view of the anchor of FIGS. 59A and 59B taken across plane 62-62 (FIG. 60);

FIG. 63 illustrates a bottom perspective of an illustrative buckle assembly configured with an integrally formed webbing interface;

FIG. 64 illustrates a bottom view of the buckle assembly of FIG. 63;

FIG. 65 illustrates a bottom view of an illustrative strap configured with an integrally formed webbing interface;

FIG. 66 illustrates a top view of an illustrative webbing configured with front-side indicia and a friction-modifying pad;

FIG. 67 illustrates a side view of the webbing of FIG. 66 with a magnified view illustrating ribs;

FIG. 68 illustrates a bottom view of the webbing of FIG. 66 illustrating back-side indica and a pair of friction-modifying pads;

FIG. 69 illustrates top view of webbing, configured with indicia and friction-modifying pads, interfaced with a plurality of rings;

FIG. 70 illustrates a top perspective view of an illustrative fastening system configured with snap-fit fasteners;

FIG. 71 illustrates a bottom perspective view of the fastening system of FIG. 70;

FIG. 72 illustrates a top view of the fastening system of FIG. 70;

FIG. 73 illustrates a front view of the fastening system of FIG. 70;

FIG. 74 illustrates a rear view of the fastening system of FIG. 70;

FIG. 75 illustrates a left-side view of the fastening system of FIG. 70;

FIG. 76 illustrates a bottom view of the fastening system of FIG. 70;

FIG. 77 illustrates a right-side view of the fastening system of FIG. 70;

FIG. 78 illustrates a top perspective view of an illustrative buckle assembly configured with snap-fit fasteners;

FIG. 79 illustrates a bottom perspective view of the buckle assembly of FIG. 78;

FIG. 80 illustrates a top view of the buckle assembly of FIG. 78;

FIG. 81 illustrates a bottom view of the buckle assembly of FIG. 78;

FIG. 82 illustrates a right-side view of the buckle assembly of FIG. 78;

FIG. 83 illustrates a left-side view of the buckle assembly of FIG. 78;

FIG. 84 illustrates a front view of the buckle assembly of FIG. 78;

FIG. 85 illustrates a rear view of the buckle assembly of FIG. 78;

FIG. 86 illustrates a top perspective view of an illustrative strap;

FIG. 87 illustrates a bottom perspective view of the strap of FIG. 86;

FIG. 88 illustrates a top view of the strap of FIG. 86;

FIG. 89 illustrates a rear view of the strap of FIG. 86;

FIG. 90 illustrates a front view of the strap of FIG. 86;

FIG. 91 illustrates a left-side view of the strap of FIG. 86;

FIG. 92 illustrates a back view of the strap of FIG. 86;

FIG. 93 illustrates a right-side view of the strap of FIG. 86;

FIG. 94 illustrates a top perspective view of an illustrative strap;

FIG. 95 illustrates a bottom perspective view of the fastening assembly of FIG. 94;

FIG. 96 illustrates a top view of the fastening assembly of FIG. 94;

FIG. 97 illustrates a back view of the fastening assembly of FIG. 94;

FIG. 98 illustrates a front of the fastening assembly of FIG. 94;

FIG. 99 illustrates a right-side view of the fastening assembly of FIG. 94;

FIG. 100 illustrates a bottom view of the fastening assembly of FIG. 94;

FIG. 101 illustrates a left-side view of the fastening assembly of FIG. 94;

FIG. 102A illustrates an anchor in a perspective view for attaching webbing to an object;

FIG. 102B illustrates an anchor of FIG. 102A in a closed condition;

FIG. 103 illustrates a bottom perspective view of the anchor of FIG. 102A;

FIG. 104 illustrates a front view of the anchor of FIG. 102A;

FIG. 105 illustrates a side view of the anchor of FIG. 102A;

FIG. 106A illustrates a cross-sectional view taken across plane 106A/B (FIG. 103), the anchor of FIG. 102A; and FIG. 106B illustrates a cross-sectional view of the anchor of FIG. 106A.

In the appended figures, similar components and/or features may have the same numerical reference label. Further, various components of the same type may be distinguished by following the reference label with a letter. If only the first numerical reference label is used in the specification, the description is applicable to any one of the similar components and/or features having the same first numerical reference label irrespective of the suffix.

DETAILED DESCRIPTION

Illustrative configurations are described with reference to the accompanying drawings. Wherever convenient, the same reference numbers are used throughout the drawings to refer to the same or like parts. While examples and features of disclosed principles are described herein, modifications, adaptations, and other implementations are possible without departing from the spirit and scope of the disclosed configurations. It is intended that the following detailed description be considered as exemplary only, with the true scope and spirit being indicated by the following claims.

It should be noted that the following description is configured for a fastening system utilized on an object. The object may be a wearable. Possible wearables include, but are not limited to, footwear, garments, helmets, jackets, backpacks, and the like. The fastening system is utilized on the wearable/object for illustrative purpose of increasing, decreasing, or preserving tightness (sometimes referred to herein as binding).

Fasteners for wearables such as footwear may include lace-based tying systems. The laces may interface with a plurality of guides or holes in the object and may be tied to tighten the object when it is worn around a body part. Under typical use, the laces may tend to loosen, resulting in the object also loosening around the body part. Fasteners may also include belts, with the belts passing through a buckle that fixes the buckle therein. However, the above fasteners lack robustness and ease of use.

Some other fasteners may use a buckle and a strap, the strap including an array of teeth. The buckle includes a lever rotatable about a pin with one end of the lever configured to engage an array of the teeth which allow movement of the strap in one direction (for tightening) and prevent the motion of the strap in opposite direction. Such a buckle is fragile and difficult to operate, and the said engagement of the buckle with the strap may damage the array of teeth. Further, such fasteners require the strap to pass underneath the buckle and require the buckle to rotate about the pin. This may lead to the bending and deformation of the buckle over time, and it may make the wearer uncomfortable due to the constant flapping of the strap against the object.

To this end, illustrative embodiments of a fastening system are disclosed, wherein the illustrative embodiment is applicable for closing, attaching, and securing purposes in various applications including wearables such as footwear and clothing and apparatuses like bags, helmets, etc. The fastening also finds utility in bundling and fastening multiple individual units like electrical cables, wires, etc.

This fastening system includes a buckle assembly and a strap such that the strap passes through the buckle assembly and the buckle assembly is configured to engage or disengage the strap, thereby allowing the fastening, tightening, or loosening of the strap. The buckle assembly can be manipulated by a user by, for example, using an index finger and a thumb to release the strap which may be, by default, held in place by the buckle assembly. The buckle assembly includes a lifter which may be movable parallel to the length of the strap when the strap is engaged with the buckle assembly. The user can push the lifter within the body of the buckle assembly to release the strap. Further, the buckle assembly allows the strap to be inserted into or moved further through the buckle assembly in the direction of its original insertion without the need to manipulate the buckle assembly. As such, no manipulative action of the buckle assembly is required to engage or tighten the strap. Further, the fastening system provides for ready access and easy manipulation by the user to release the strap from the buckle assembly.

Figure 1:
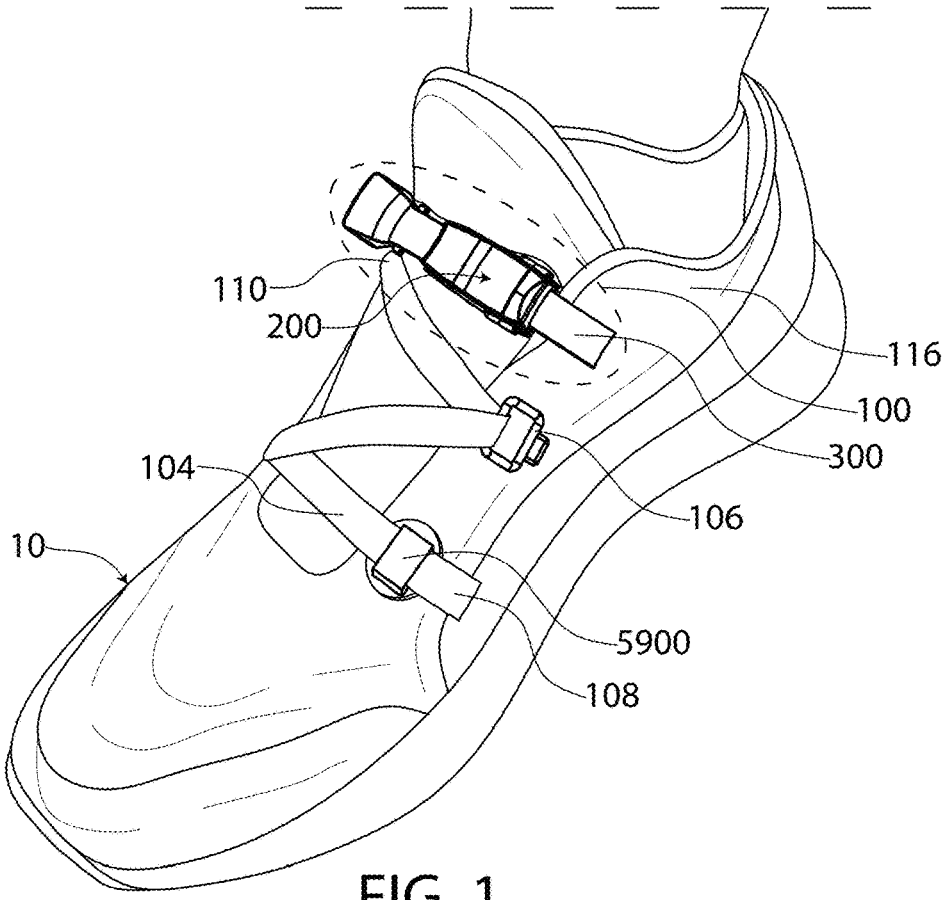
FIG. 1 illustrates a left-side perspective view of an object with webbing and an illustrative configuration of a fastening system.

Referring to FIG. 1, a left-side perspective view of an object 10 configured as footwear, the object 10 may be provided with an illustrative configuration of a fastening system 100. While the fastening system 100 may be attached directly to an object 10, in some configurations the fastening system 100 is provided with a webbing 104. The webbing 104 may be oriented/routed on the object 10 for tightening/binding the object 10 to a body part of the user (e.g., a foot of the user). The fastening system 100 may be manually actuated by a user to tension or relax the webbing 104. This adjustment of the webbing 104 tightens or loosens the fit of object 10 on the body part on which the object is worn.

Figure 4:
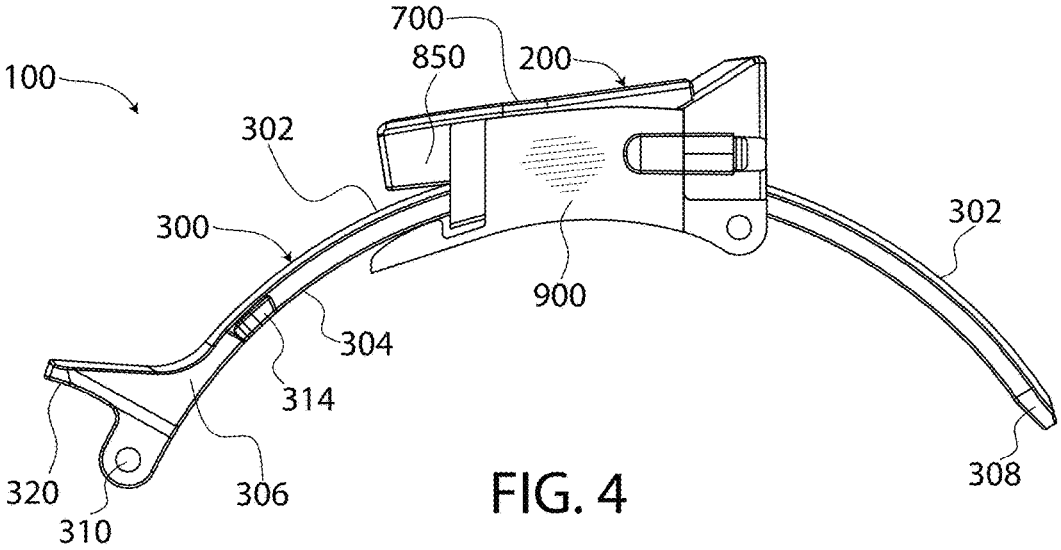
FIG. 4 illustrates a side view of the fastening system of FIG. 3.

The webbing 104 may be guided through one or more rings 106 provided on the object 10. In one configuration, the rings 106 may be placed in two rows such that the webbing running through the rings passes back and forth diagonally across the surface of the object 10. In some example configurations, the rings 106 may be hooks which are attached to the object 10 and allow the webbing 104 to be looped thereinto. The webbing 104 may include a proximal end 108 and a distal end 110. As shown, the proximal end 108 may be fixated on body of the object 10 by means of an anchor 5900, and the rest of the webbing 104 may be looped through the rings 106. The distal end 110 of the webbing 104 may include a strap 300 (FIG. 4).

Figure 2:
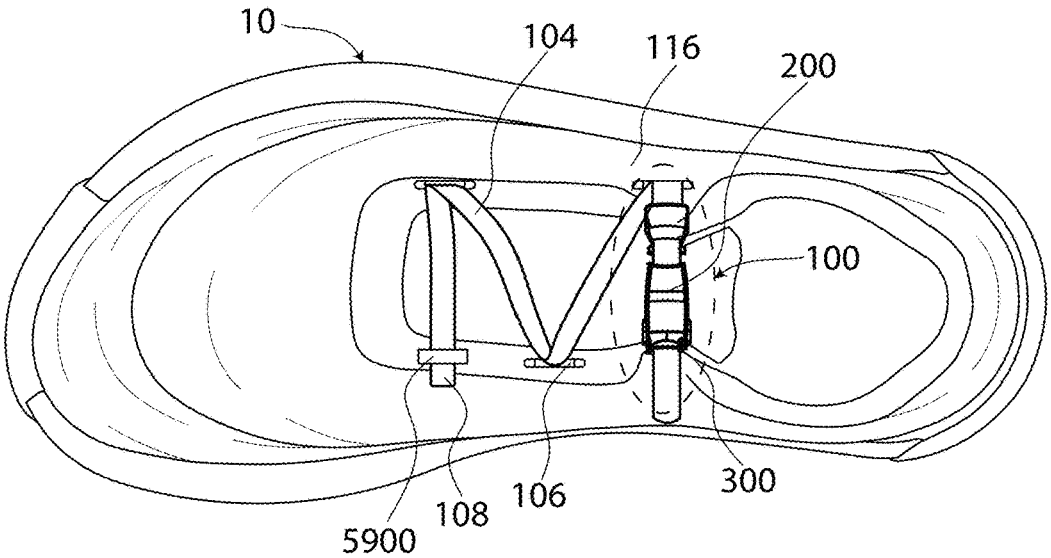
FIG. 2 illustrates a top view of the webbing and a fastening system of FIG. 1.

With reference to FIG. 2 illustrates a top view of the object 10 with the webbing and the fastening system 100. The fastening system 100 includes a buckle assembly 200 and the strap 300. Further, in some illustrative configurations, the strap 300 may be connected to one end of the webbing 104. Alternatively, the strap 300 may be formed into the body of the object 10 with or without the webbing 104. As such, in some configurations, the webbing 104 and the strap 300 may be formed as a single piece.

The buckle assembly 200 may adjoin the object 10. As such, the strap 300 may be affixed to the object 10 at a first location on the object 10, and the buckle assembly 200 may be affixed to the object 10 at a second location. Alternatively, as illustrated, the fastening system 100 may include webbing 104 that may be permanently, removably, or adjustably attached to the object 10 at one of the rings 106, and the buckle assembly 200 may be adjoined to a portion 116 of the object 10 (e.g., a vamp of a footwear/shoe). As shown in FIGS. 1-2, the buckle assembly 200 may be fixedly attached to the portion 116 of the object 10, for example, via one end of the buckle assembly 200. The buckle assembly 200 may be fixedly attached to the portion 116 via, for example, an adhesive joint, a clamp, or a sewing joint, or by using a fastener like a clip, a screw, a nut-bolt assembly, etc. Once the webbing 104 is routed around the object through the rings 106, the strap 300 may be engaged with the buckle assembly 200. The buckle assembly 200 may tightly hold the strap 300, thereby maintaining the tension in the webbing 104. The fastening system 100 is further explained in detail in conjunction with FIGS. 3-45.

Figure 3:
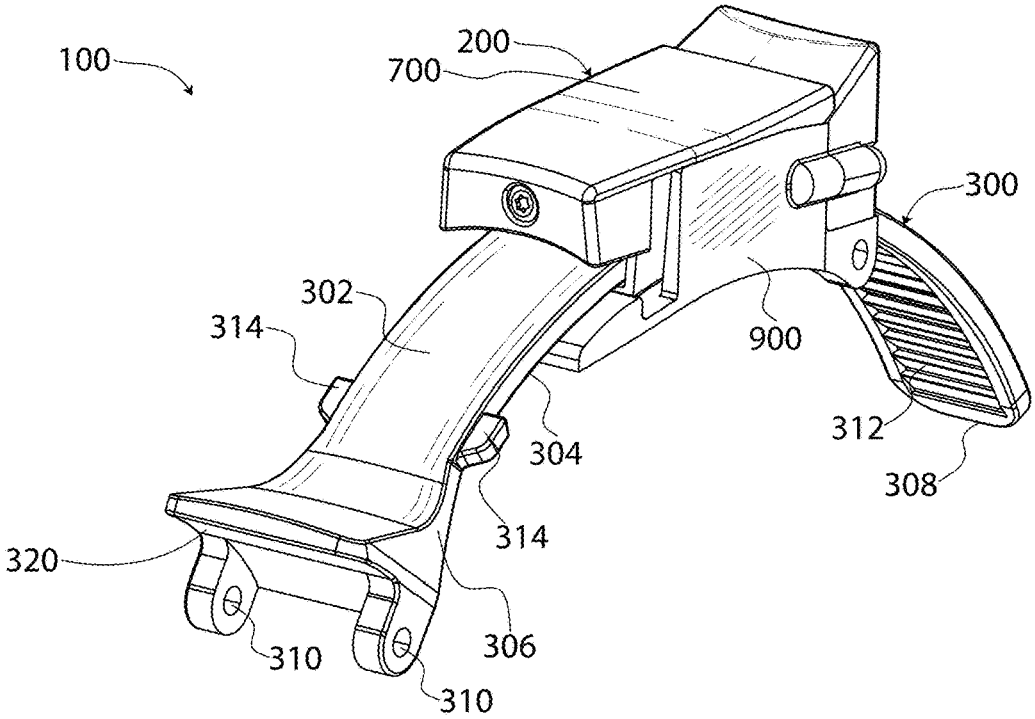
FIG. 3 illustrates a perspective view of an illustrative configuration of a fastening system utilized for objects, such as the footwear illustrated in FIG. 1, the fastening system of FIG. 3 is shown in an engaged condition.

With reference to FIG. 3 illustrating a perspective view of the fastening system 100 in an engaged condition, the fastening system 100 may include the buckle assembly 200 and the strap 300. The strap 300 may be configured to pass and move through the buckle assembly 200. In some configurations, the strap 300 may be formed as an arc structure curving toward the object 10. As illustrated in FIG. 2, this curvature may result in the loose end (distal end 308) of the strap 300 being beside the arch (i.e., the medial side) of the user's foot.

With continued reference to FIG. 3, the strap 300 may further include a proximal end 306 and a distal end 308 oppositely disposed from the proximal end 306. The proximal end 306 may be configured to attach to an object (for example, the object 10, i.e., the footwear). For example, the proximal end 306 of the strap 300 may attach to the object via webbing (e.g., the webbing 104). The proximal end 306 of the strap 300 may include an attachment mechanism to attach to the webbing. For example, the attachment mechanism may include a hinge mechanism such that a first pair of holes 310, provided on the proximal end 306 are configured to couple with the webbing via a pin (not shown in FIGS. 3-5). Alternatively (and explained later herein), the attachment mechanism may be an integrally-formed webbing interface 6310 (FIGS. 63-64).

The strap 300 may further include a front surface 302 disposed between the proximal end 306 and the distal end 308. Further, the strap 300 may include a back surface 304 parallel to and offset from the front surface 302 and defined between the proximal end 306 and the distal end 308. In other words, the strap 300 may be an elongated structure having a width and defining the front surface 302 and the back surface 304 across the width. The strap 300 may further include an array of teeth 312 formed on the back surface 304, and as such, this array of teeth 312 may be positioned adjacent to the object. Further, in some configurations, the array of teeth 312 may be formed within the width of the strap 300 such that the array of teeth 312 does not extend beyond the back surface 304 of the strap 300. It should be noted that due to the curvature of the strap 300, the entire length of the strap 300 may stay urged to contact wrap-like) to the object 10. When positioned as illustrated (in, for example, FIG. 3 and other figures), the array of teeth 312 are adjacent to and/or adjoining the object to protect the array of teeth 312 and/or to promote ejection of debris such as dirt, mud, or other matter.

The strap 300 may further include a stop 314 (or a plurality of stops similar to stop 314) formed along the strap 300. This stop 314 may be configured to block movement of the strap 300 relative to the buckle assembly 200. In other words, the strap 300 cannot move relative to the buckle assembly 200 beyond the stop 314 (e.g., to prevent over-tightening). One particular benefit/utility of the stop 314 may be to provide clearance for the digit (finger) of the user (as shown, for example, in FIGS. 7 and 42).

The strap 300 may further include a digit surface 320. While the digit surface 320 may be formed anywhere on the strap 300, it is particularly well-placed when located at or near the proximal end 306 of the strap 300.

Referring now to FIG. 4 illustrating a side view of the fastening system 100, the digit surface 320 may protrude from the front surface 302 of the strap 300 so that the user can place their finger(s) or thumb (generically referred to as a digit of their hand) thereon. Furthermore, the illustrated buckle assembly 200 includes a base 900 which may be adjoined to the object 10. As will be explained in subsequent sections of this disclosure, the base 900 (of the buckle assembly 200) may include a bottom 916 (FIG. 9) adjoining the object, a top 918 (FIG. 9) oppositely disposed from the bottom 916, and a pawl 920 (FIG. 9) formed on the top 918. The buckle assembly 200 may further include a slider 700 slidingly engaged with the base 900 between a first position (as shown in FIG. 4) and a second position (as shown, for example, in FIG. 7). Further, the fastening system 100 may be configurable between an engaged condition (FIG. 6) and a released condition (FIG. 7). In the engaged condition, the slider 700 may be positioned at the first position. Further, in the engaged condition, the slider 700 may be offset from the top of the base 900 by a first distance. Furthermore, in the engaged condition, the pawl 920 may adjoin the array of teeth 312 of the strap 300. In the released condition, the slider 700 may be positioned at the second position. Further, in the released condition, the slider 700 may be offset from the top of the base 900 by a second distance that is greater than the first distance. Furthermore, in the released condition, the strap 300 may be free to move relative to the buckle assembly 200.

Figure 5:
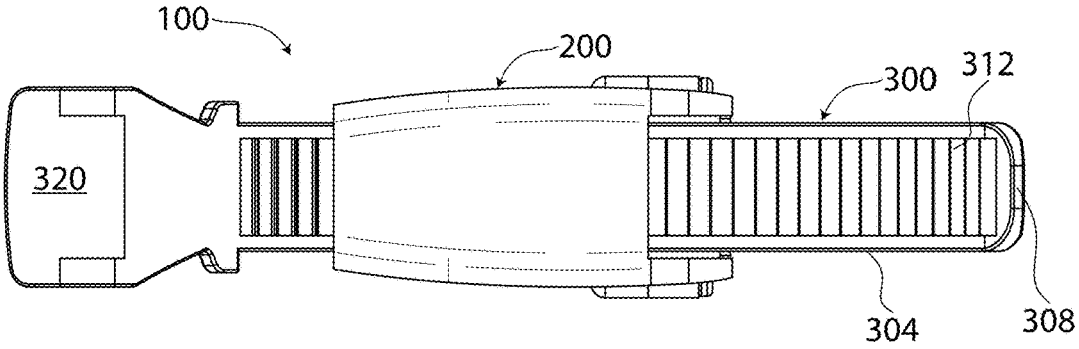
FIG. 5 illustrates a bottom view of the fastening system of FIG. 3.

Referring now to FIG. 5 illustrating a bottom view of the fastening system 100, the teeth 312 of the strap 300 may extend from the proximal end 306 to the distal end 308 as illustrated. Alternatively, the teeth 312 may be limited to a reduced section of the strap 300. If configured with a limited section of teeth 312, the buckle assembly 200 may only be engaged on a particular section of the strap 300, as might be required for specific applications.

Figure 6:
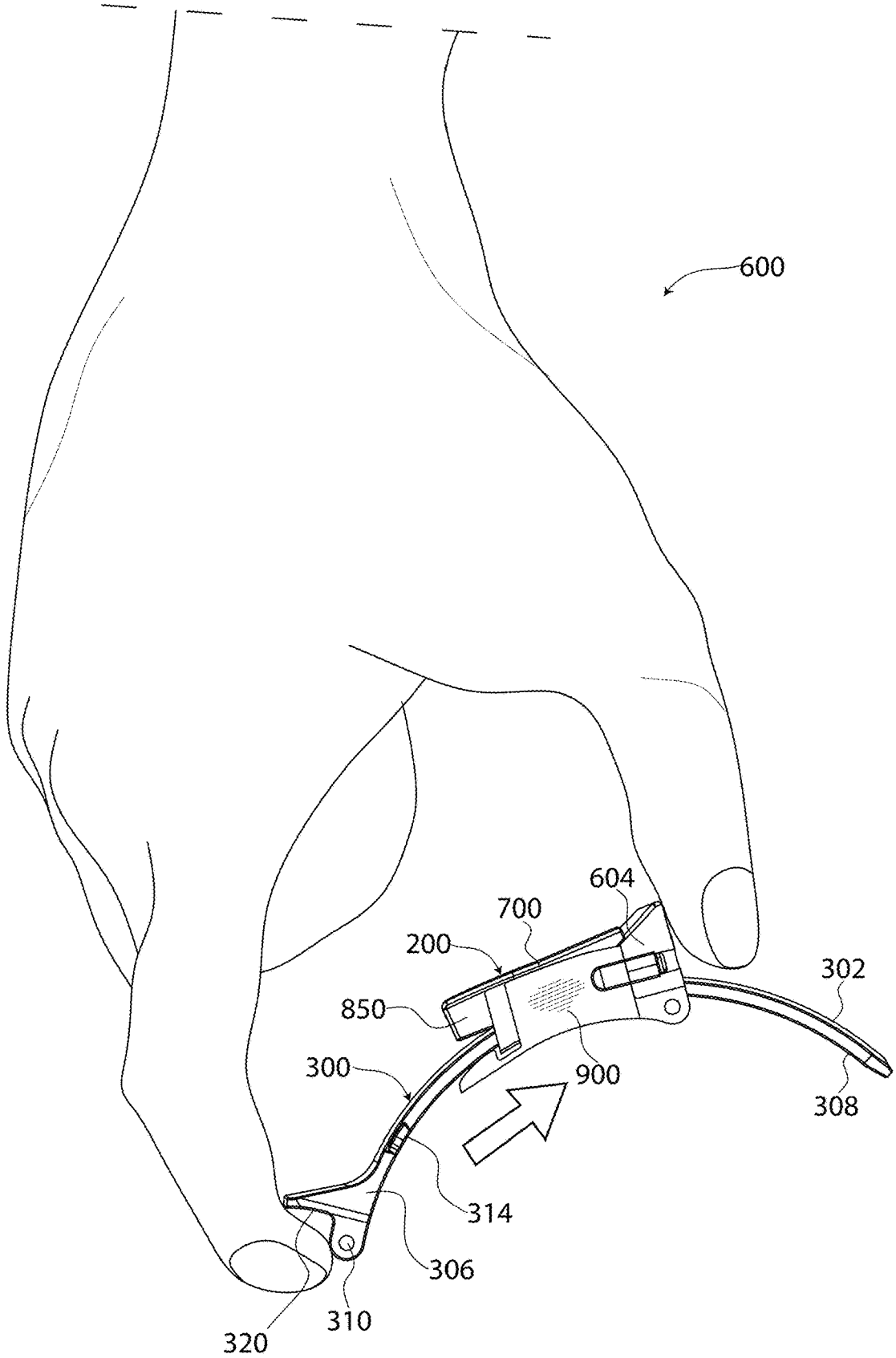
FIG. 6 illustrates a representative method for tightening the fastening system of FIG. 3.
Figure 7:
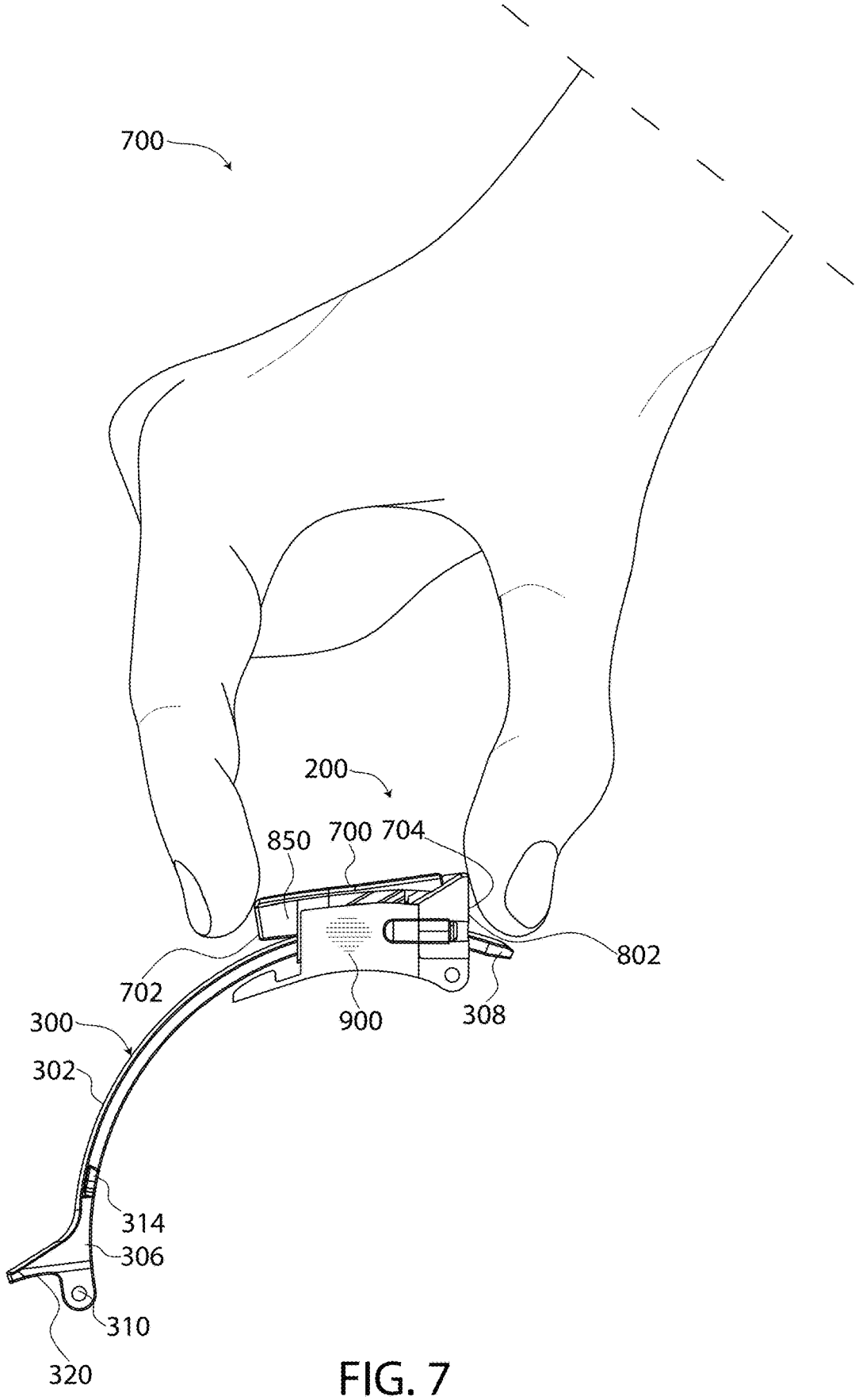
FIG. 7 illustrates a representative method for loosening the fastening system of FIG. 3.

Referring to FIG. 6 illustrating a representative method for tightening the fastening system 100 in an engaged condition 600. FIG. 6 shows the fastening system 100 while being manipulated by the digits of a user. As shown in FIG. 6, the fastening system 100 includes the buckle assembly 200 and the strap 300. The proximal end 306 of the strap 300 may be attached to a webbing (not shown in FIG. 6; refer FIGS. 1-2). In the engaged condition 600, the strap 300 may be locked such that the movement of the strap 300 relative to the buckle assembly 200 is restricted in one direction (e.g., for tightening). For example, as shown in FIG. 6, the strap 300 may be movable only in the tightening direction (as indicated by the arrow) and the movement of the strap 300 may be restricted in the loosening direction by the buckle assembly 200. In order to tighten the object 10 using the fastening system 100, the user may place their thumb on the rear end 604 of the buckle assembly 200 and their index finger on the proximal end 306 of the strap 300. In particular, the user may place their index finger on the digit surface 320 provided, for example, on the proximal end 306 of the strap 300.

Further, to move the strap 300 in the tightening direction, the user may generate a pinching action using their digits such as the thumb and the index finger. This pinching action causes the strap 300 to move in the tightening direction (arrow, FIG. 6), thereby pulling the strap 300 (and, if provided, the webbing 104, FIG. 1) to increase tightening. It should be noted that the fastening system 100 may be in the engaged condition by default, i.e., when the user is not performing any pinching action.

Figure 9:
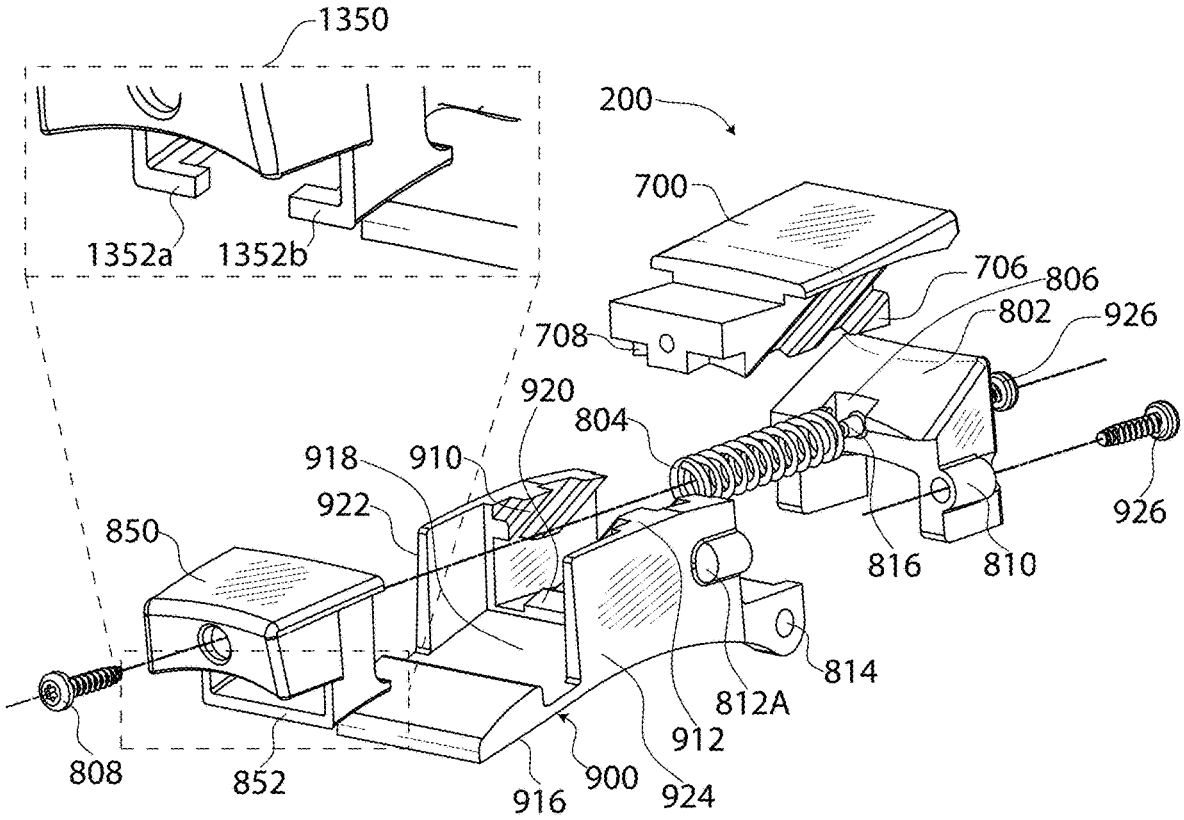
FIG. 9 illustrates an exploded view of one configuration of a buckle assembly of the fastening system of FIG. 8.

Referring now to FIG. 7 illustrating a representative method for loosening the fastening system 100 in a released condition while being operated upon by a hand of a user, the strap 300 may be unlocked/released from the buckle assembly 200 such that the strap 300 may freely move relative to the buckle assembly 200. Further, in this released condition, the strap 300 is free to move in both tightening and loosening directions to tighten or loosen the fastening system. The released condition of the fastening system 100 can be obtained by the pinching action generated by digits of the user's hand that causes the buckle assembly 200 to release the strap 300. As such, to release the strap 300 from the buckle assembly 200, the user may place their thumb on rear end 604 (of the buckle assembly 200) and their index finger on a digit surface 702 of the slider 700 (of the buckle assembly 200) to generate the pinching action. The three separate digit surfaces 320, 702, and 902 (digit surface 902 is illustrated in FIG. 9 and may also be referred to herein as a trigger) may be used to manipulate the fastening system 100 and to move the strap 300 relative to the buckle assembly 30, thereby loosening and tightening the webbing. Specifically, to tighten the strap 300, the digit surface 320 of the strap and the trigger 850 of the base 900 are pinched together. To loosen the strap 300, the trigger 850 of the base 900 and the digit surface 702 of the slider 700 are pinched together. This pinching action may be accomplished by different fingers or even two hands, but the illustrated configuration is intuitive and produces high user satisfaction (in terms of efficacy, speed of use, initial adoption, etc.)

Figure 8:
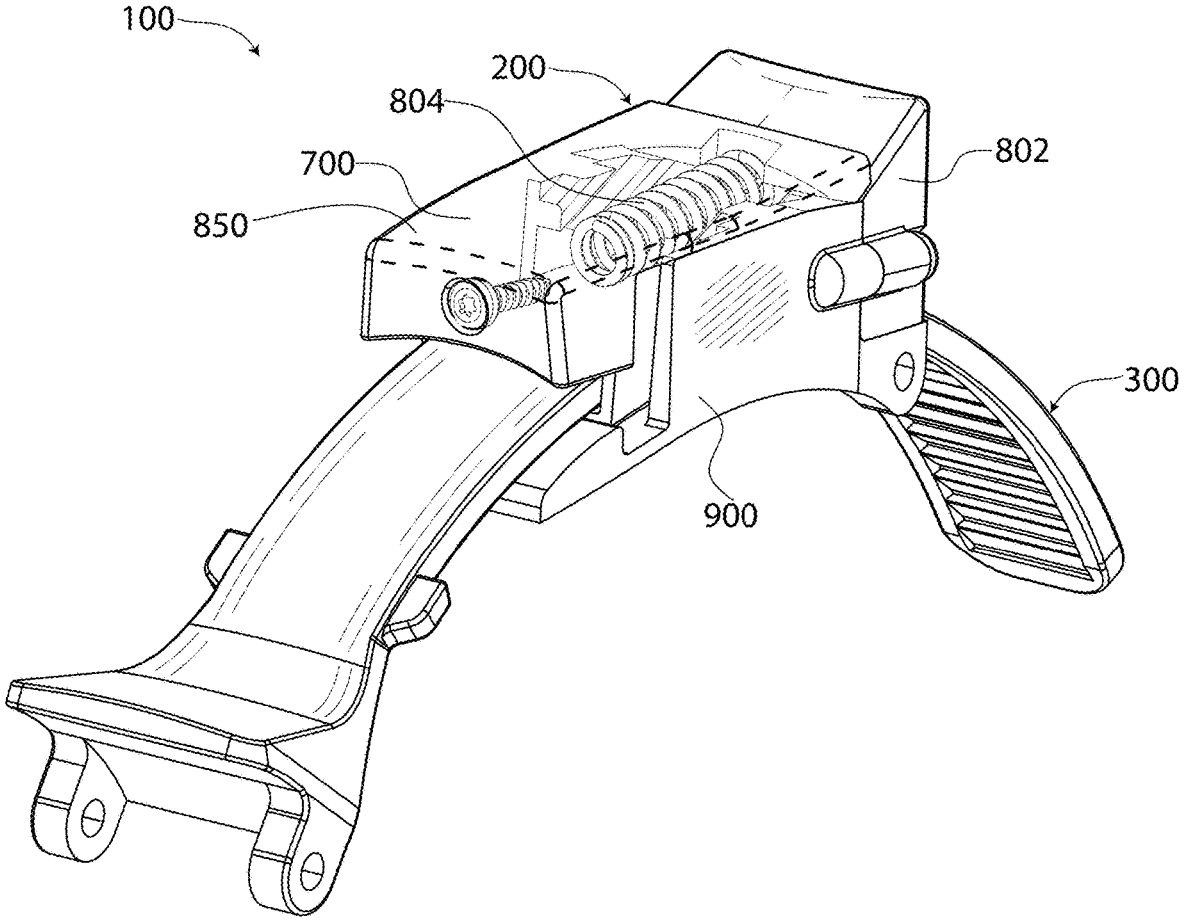
FIG. 8 illustrates a perspective view of an illustrative example of a fastening system showing internal components of the buckle assembly, the internal components are illustrated in an x-ray/phantom illustration.

Referring now to FIG. 8 illustrating a perspective view of the fastening system 100 showing internal components of the buckle assembly 200 with some internal components illustrated in x-ray/phantom, the buckle assembly 200 includes the base 900 and the slider 700. The buckle assembly 200 may further include a cap 802, a biasing member 804, and a trigger 850. In some configurations, the biasing member 804 may include, but is not limited to including, a spring. As such, the biasing member 804 may include any other elastic member. The slider 700 is urged into a position by the biasing member 804.

With reference to FIG. 9 showing an exploded configuration of an illustrative buckle assembly 200, the base and the slider may be fastened together by screws. Other configurations have been contemplated such as a representative configuration in FIGS. 70-77 that configures the fasteners as snaps (integrally manufactured during initial injection molding). The slider 700 may be slidingly engaged with the base 900. Further, in some configurations, the cap 802 may be attached to the base 900, for example, using one or more fasteners like fasteners 926. To this end, the cap 802 may include a first set of fastening channels 810. (Only one fastening channel 810A of the first set of fastening channels 810 is shown in FIG. 9; the other fastening channel 810B of the first set of fastening channels 810 is shown in FIGS. 10, 11, 12, 14). Further, the base 900 may include a second set of fastening channels 812. (Only one fastening channel 812A of the second set of fastening channels 812 is shown in FIG. 9; the other fastening channel 812B of the second set of fastening channels 812 is shown in FIGS. 10, 11, 13, 14). Each of the first set of fastening channels 810 may be configured to be aligned with a respective fastening channel of the second set of fastening channels 812. Once aligned, the fastener 926 such as a screw may be secured into each of the first fastening channel 810 and the respective fastening channel of the second set of fastening channels 812 to thereby fasten the cap 802 to the slider 700.

In some configurations, a cap 802 may be attached to the slider 700 using a rivet, a nut-bolt assembly, a pin, chemical/ultrasonic welding, or an adhesive. Moreover, in yet another configuration, the cap 802 may be formed into the slider 700 as a single molded piece. Alternatively, the fasteners could be configured as snaps as best illustrated in FIGS. 70-77. The cap 802 may include a groove 806 to accommodate a part of the biasing member 804 therewithin, and a locator 816 may be formed in the groove 806 of the cap 802 for positioning the biasing member 804. Further, in some configurations, the buckle assembly 200 may include the trigger 850 (as will be described in subsequent sections of this disclosure), which may be attached to the slider 700 using a fastener 808.

In some configurations, the buckle assembly may include a second pair of holes 814. The second pair of holes 814 may be configured to attach the buckle assembly 200 to the object 10 at the second location. For example, an attachment mechanism like a hinge mechanism may be used to attach the buckle assembly 200 to the object 10, wherein a pin (not shown in FIG. 8) may be used to couple the buckle assembly 200 to the object 10 via the second pair of holes 814.

With continued reference to FIG. 9, the buckle assembly 200 includes the base 900, the slider 700, the cap 802, and the biasing member 804. In other words, the fastening system 100 may be created by assembling the base 900, the slider 700, the cap 802, and the biasing member 804. The buckle assembly 200 further includes the trigger 850 which may be disposed/attached adjacent to the slider 700. In some configurations, the trigger 850 may be fastened to the slider 700, for example, via the fastener 808, which may include a screw. In some alternate configurations, the trigger 850 may be formed into the slider 700, i.e., the trigger 850 and the slider 700 may be molded as a single piece.

The biasing member 804 may be positioned between the trigger 850 and the cap 802. Since the trigger 850 is attached to the slider 700 and the cap 802 is attached to the base 900, the biasing member 804 is disposed between the slider 700 and the base 900. Further, the biasing member 804 biases the trigger 850 (and therefore the slider 700) away from the cap 802 (and therefore the base 900). As such, the user presses the trigger 850 against the biasing member 804 to generate the pinching action on the buckle assembly 200. The first hold locator 816 may be configured to hold one end of the biasing member 804. Further, the slider 700 may include a second hold pin (not shown in figure but shown in FIG. 16 as second hold pin 1602) that is similar to the first hold locator 816 and that may extend towards the cap 802. The second hold pin 1602 of the slider 700 may be configured to hold the other end of the biasing member 804.

The base 900 may further include a first wall 922 protruding from the top 918 and a second wall 924 protruding from the top 918. The second wall 924 may be parallel to and offset from the first wall 922 by a width sufficient to accommodate the strap 300 (not shown in FIG. 9) and allow the strap 300 to slide therebetween. The base 900 may further include a first ramp 910 formed on the first wall 922 and a second ramp 912 formed on the second wall 924. The first ramp 910 and the second ramp 912 may be formed on the respective walls of the base. In other words, the base 900, the first wall 922 with the first ramp 910, and the second wall 924 with the second ramp 912 may be formed as a single piece. Alternatively, the first ramp 910 and the second ramp 912 may be attached separately to the first wall 922 and the second wall 924, for example, by welding, by an adhesive, or by a fastener like a screw, nut-bolt assembly etc.

In some configurations, as shown in FIG. 9, each of the first ramp 910 and the second ramp 912 may include at least one groove. Further, in some configurations, as shown in FIG. 9, each of the first ramp 910 and the second ramp 912 may be inclined relative to the top 918 of the base 900 to cause movement of the strap 300 relative to the base 900.

In some configurations, the slider 700 may include a first guide 706 and a second guide 708. Each of the first guide 706 and the second guide 708 may include at least one groove with these grooves corresponding to grooves in the first ramp 910 and the second ramp 912 (refer FIGS. 17-19). Further, in some configurations, as shown in FIG. 9, each of the first guide 706 and the second guide 708 may be inclined to the horizontal. Furthermore, an angle of inclination of the first guide 706 and the second guide 708 may be same as an angle of inclination of the of the first ramp 910 and the second ramp 912 of the base 900. The first guide 706 and the second guide 708 may be formed into the slider 700 or may be attached separately to the slider 700, for example, by welding, by an adhesive, or by using a fastener like a screw, nut-bolt assembly, pin, etc.

The first guide 706 may be configured to slidingly engage with the first ramp 910, and similarly the second guide 708 may be configured to slidingly engage the second ramp 912. This engagement of the first guide 706 and the second guide 708 with the first ramp 910 and the second ramp 912 enables the slider 700 to slidingly move relative to the base 900. Further, due to the incline of the first guide 706, the second guide 708, the first ramp 910, and the second ramp 912, the slider 700 may slidingly move relative to the base 900 along the incline. In other words, the sliding movement of the slider 700 may include a horizontal displacement and a vertical displacement relative to the base 900. As such, when the slider 700 is provided a horizontal displacement, for example, by a pinching action of the user, the slider 700 automatically undergoes a vertical displacement. As such, in the engaged condition of the fastening system 100, the slider 700 is positioned at the first position and is offset from the top of the base 900 by a first distance, and the pawl is adjoining the array of teeth. In the released condition, the slider 700 is positioned at the second position and is offset from the top of the base 900 by a second distance greater than the first distance.

During operation of the fastening system 100, when the strap 300 (FIG. 8) is inserted into the buckle assembly 200, the strap is positioned between the base 900 and the slider 700. As mentioned above, the base 900 may include the pawl 920 formed on the top 918. As used herein, the term 'pawl' may mean any geometry capable of engaging with and retaining another object (such as the strap 300), While a pawl may, in certain instances, be a movable object with one tooth, it may be a plurality of teeth either fixedly attached or movable relative-to the base 900. The pawl 920 may adjoin the array of teeth 312 (FIG. 3) provided on the strap 300 (FIG. 3), thereby engaging the array of teeth 312. The fastening system 100 may be configured to be in the engaged condition due to the biasing member 804. In the engaged condition, the slider 700 is offset from the top of the base 900 by a first distance, and the pawl 920 is engaged with the array of teeth 312. In other words, the strap 300 is pressed against the pawl 920, which prevents movement of the strap in the release direction. To configure the fastening system 100 in the released condition, the user may generate a pinching action at the buckle assembly 200 at the trigger 850 and the cap 802 causing the slider 700 to undergo the horizontal displacement as well as the vertical displacement, thereby offsetting the slider from the top of the base 900 by a second distance (greater than the first distance). This may further cause the pawl 920 to be disengaged from the array of teeth 312, thereby allowing bi-directional movement of the strap 300 through the buckle assembly 200.

As mentioned above, the slider 700 may further include the trigger 850. The trigger 850 may be formed at a front part of the slider 700. The trigger 850 may include a lifter 852. The lifter 852 is also referred to herein as a jack. When the strap 300 is inserted into the buckle assembly 200, the strap may pass through the lifter 852 of the trigger 850. As such, the lifter 852 of the trigger 850 may be configured to receive the strap 300 and allow passage of the strap 300 therethrough. Further, as the slider 700 undergoes the vertical displacement along the lifter 852 of the trigger 850 (since the trigger 850 is attached to the slider 700), the lifter 852 causes the strap 300 to be lifted from the pawl 920, thereby causing the array of teeth 312 of the strap 300 to be disengaged from the pawl 920. As will be appreciated, in the released condition of the fastening system 100, this disengagement of the array of teeth 312 from the pawl 920 allows movement of the strap 300 in both directions through the buckle assembly 200.

Figure 10:
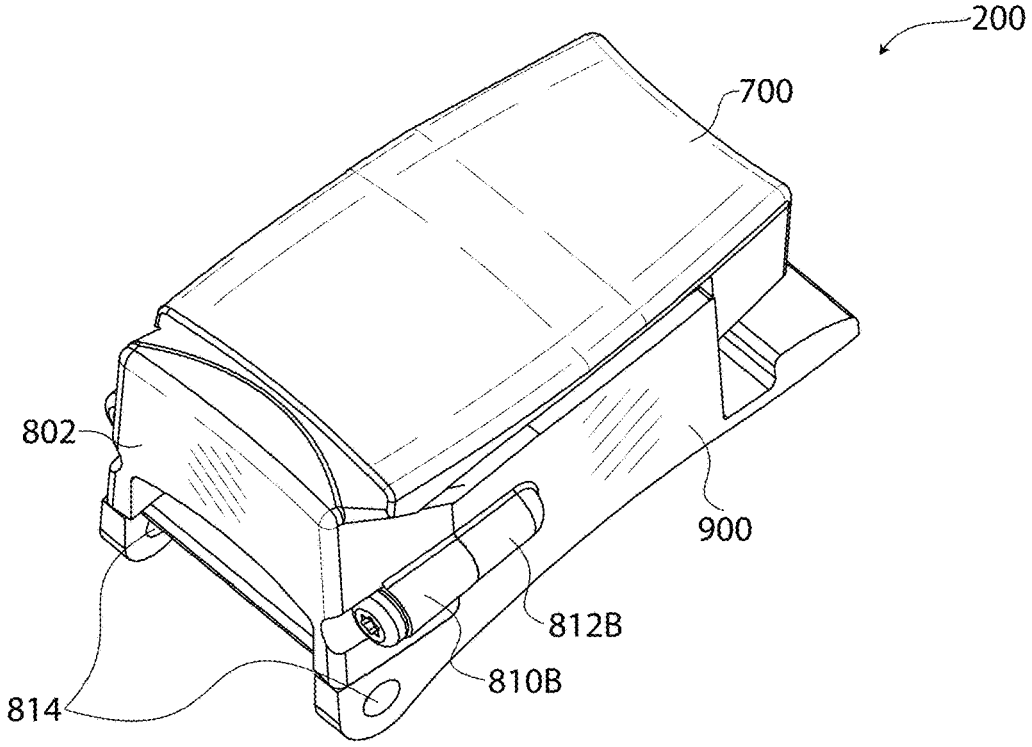
FIG. 10 illustrates a top perspective view of an illustrative example of the buckle assembly of FIG. 9 in an assembled state.

FIG. 10 illustrates a top perspective view of an illustrative example of the buckle assembly 200 of FIG. 9 in an assembled state.

Figure 11:
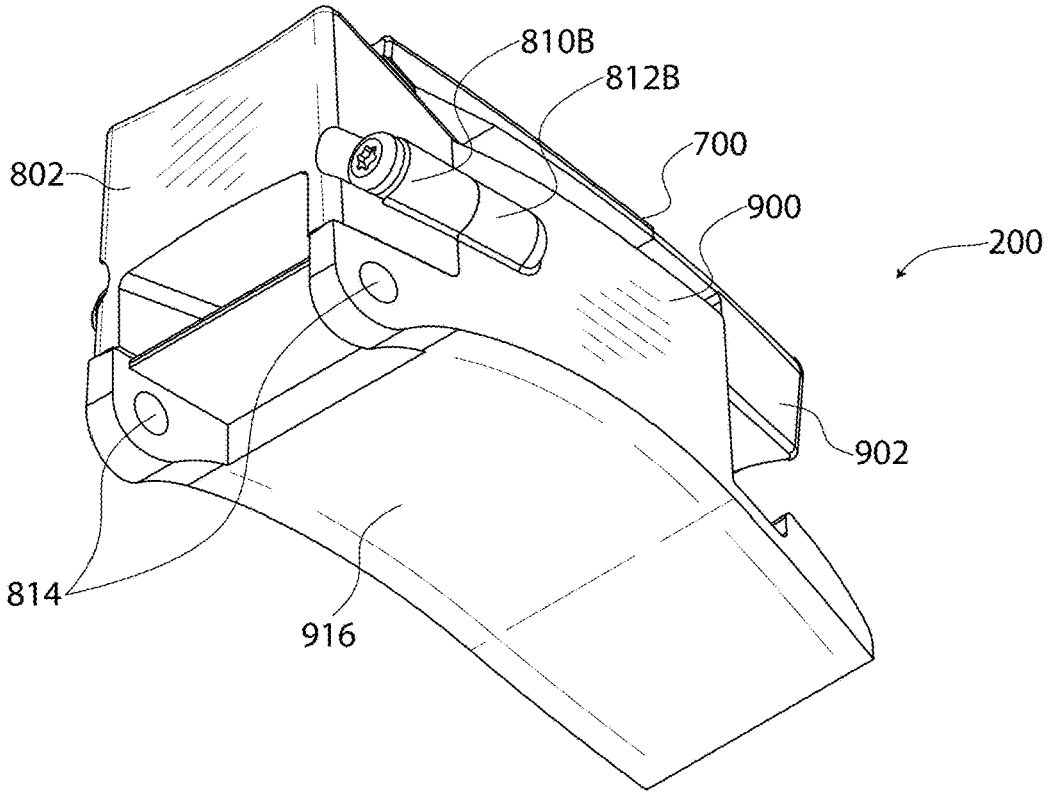
FIG. 11 illustrates a bottom perspective view of the buckle assembly of FIG. 10.

FIG. 11 illustrates a bottom perspective view of the buckle assembly 200 of FIG. 10.

Figure 12:
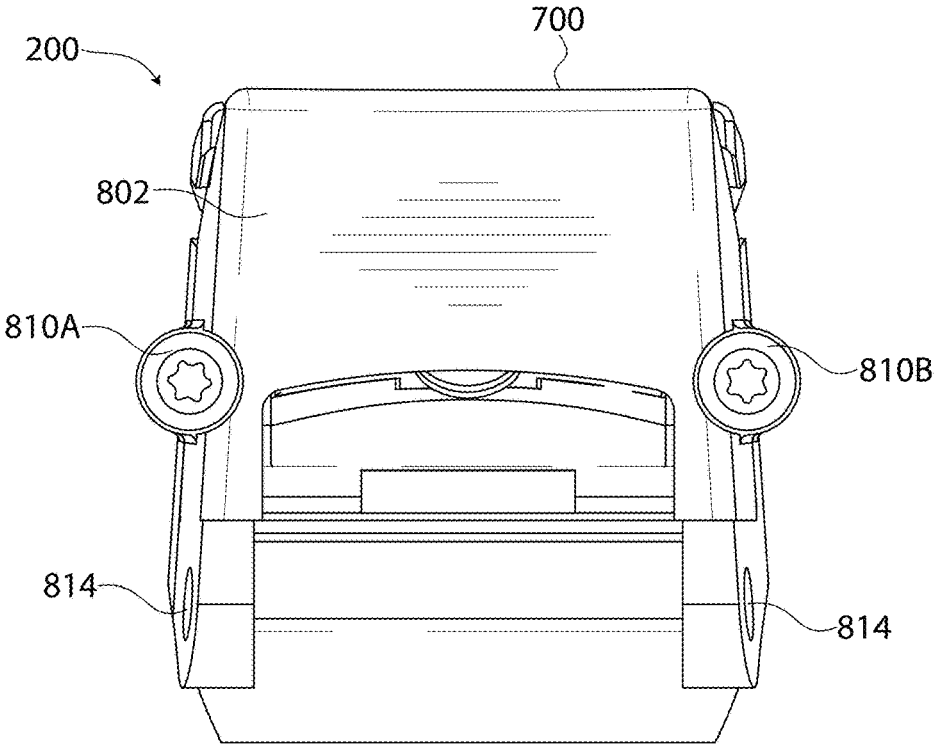
FIG. 12 illustrates a rear view of an illustrative example of a buckle assembly.

FIG. 12 illustrates a rear view of an illustrative example of a buckle assembly 200.

Figure 13:
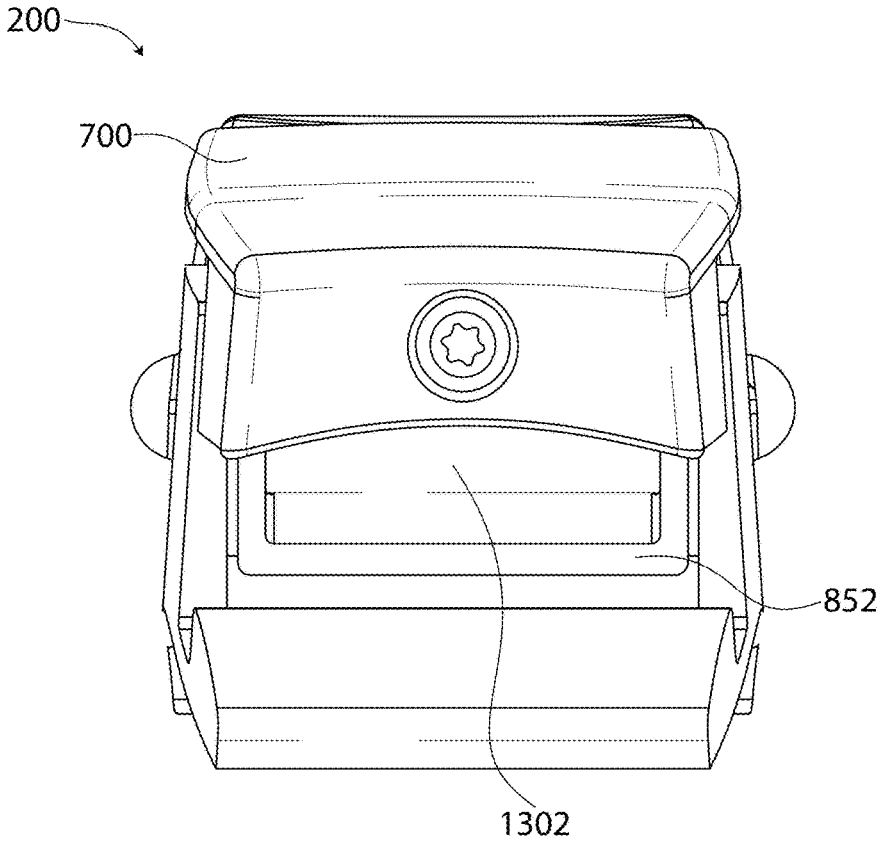
FIG. 13 illustrates a front view of the buckle assembly of FIG. 12.

With reference to FIG. 13 illustrating a front view of the buckle assembly 200, in some configurations, the lifter 852 formed in the trigger 902 may be a closed loop as shown. However, the shape and configuration of the lifter 852 may be altered. For example, the lifter 852 may include two L-shaped members facing each other and configured to accommodate the strap 300. In other words, instead of being a closed, loop-like structure, the clamp may be open ended. In other configurations, the lifter 852 may be a metal ring formed by extrusion or by a stamping process. The lifter 852 may be further configured as any structure capable of moving the strap 300 from a first location to a second location relative to the base 900 (e.g. rib with an undercut that tracks in a matching cut feature in the trigger 902 and/or the slider.

With continued reference to FIG. 13, the buckle assembly 200 may include an interior channel 1302 through which the strap 300 may be run. In some configurations, the lifter 852 of the trigger 850 may be provided in conjunction with the channel 1302. The channel 1302 may be configured to receive and hold the strap 300, and it may also allow the strap 300 to move either in a single direction or, when the strap 300 is free-to-move relative to the buckle assembly 200, back-and-forth.

Figure 14:
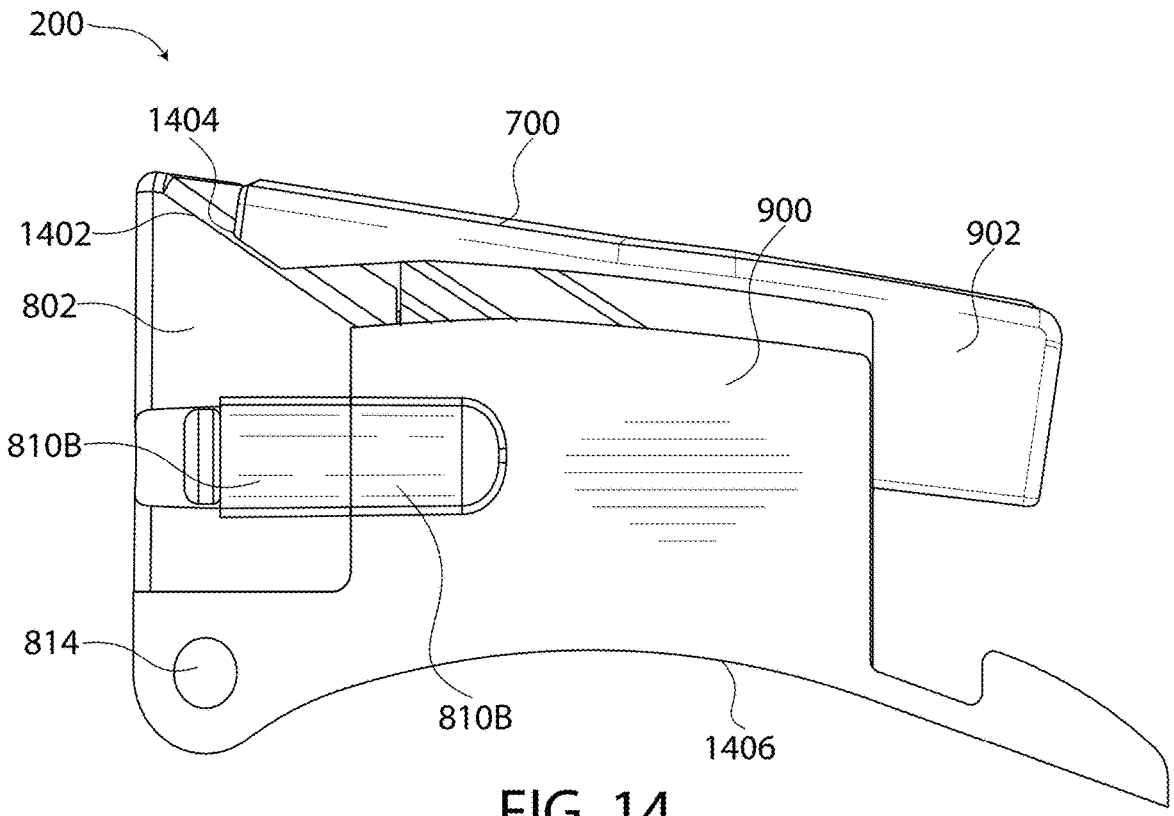
FIG. 14 illustrates a left-side view of the buckle assembly of FIG. 12.
Figure 15:
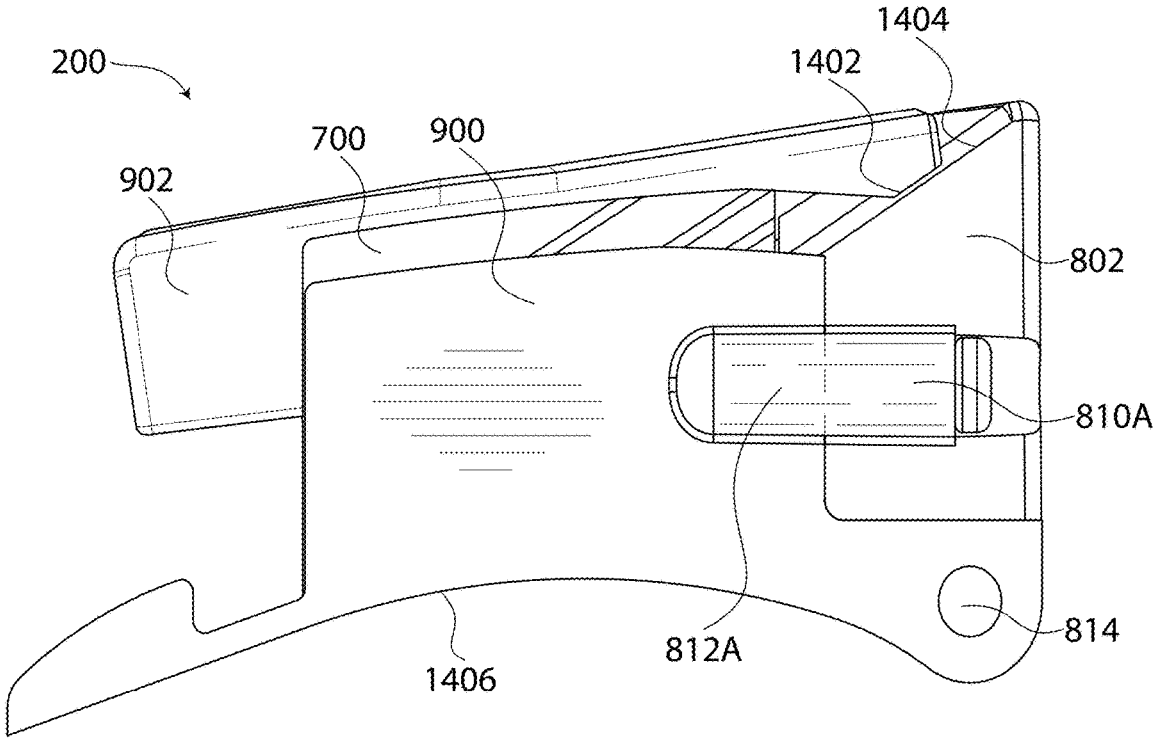
FIG. 15 illustrates a right-side view of the buckle assembly of FIG. 12.

With reference to FIGS. 14 and 15 respectively illustrating left-side and right-side views, the lower surface 1406 of the base 900 may have a curved profile. This curved profile allows the buckle assembly 200 to be aligned with the contours of the object (e.g., a footwear) on which the fastening system 100 is used. As illustrated, the cap 802 may include an inclined top surface 1402, and the slider 700 may include an inclined slide surface 1404 corresponding to an inclined top surface 1402 of the cap 802. An angle of inclination of the inclined top surface 1402 may match an angle of inclination of the inclined slide surface 1404. Matching the slope of the inclined top surface 1402 and the slope of the inclined slide surface 1404 may enable ease of sliding of therebetween and thereby ease the horizontal and vertical displacement of the slider 700 relative to the base 900.

Figure 16:
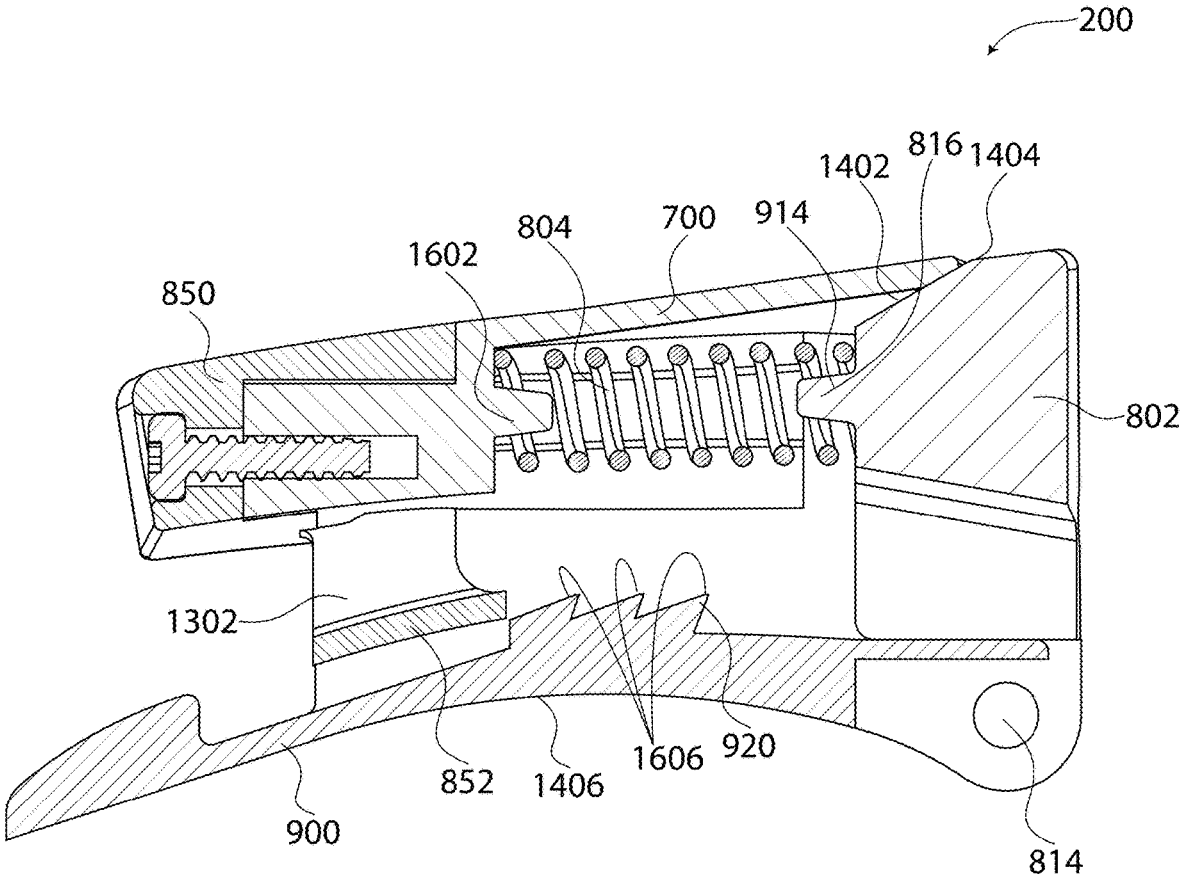
FIG. 16 illustrates a right-side sectional view (taken across a central plane) of an illustrative configuration of a buckle assembly.

With reference to FIG. 16 showing a cross-sectional view of the buckle assembly 200, the cap 802 may include the locator 816 (FIG. 16), which may be extending towards the slider 700. The locator 816 may be configured to hold one end of the biasing member 804. Further, the slider 700 may include the second hold pin 1602 similar to the first hold locator 816 that may be extending towards the cap 802. The second hold pin 1602 of the slider 700 may be configured to hold the other end of the biasing member 804. As clearly shown in FIG. 16, the base 900 includes the pawl 920. The pawl 920 may include an array of counter teeth 1606. In some configurations, the array of counter teeth 1606 may selectively engage the array of teeth 312 of the strap 300 (refer FIG. 5) when the strap 300 passes through the buckle assembly 200.

Figure 17:
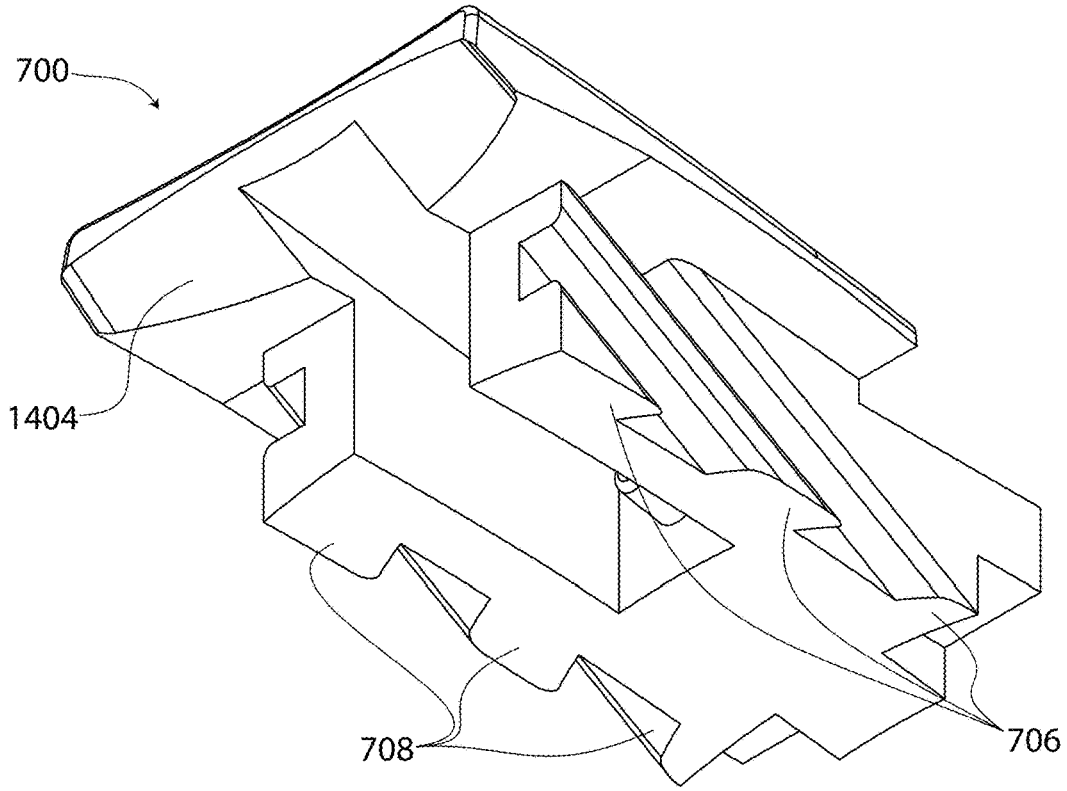
FIG. 17 illustrates a bottom perspective view of an illustrative configuration of a trigger configured as a slider of the buckle assembly.
Figure 18:
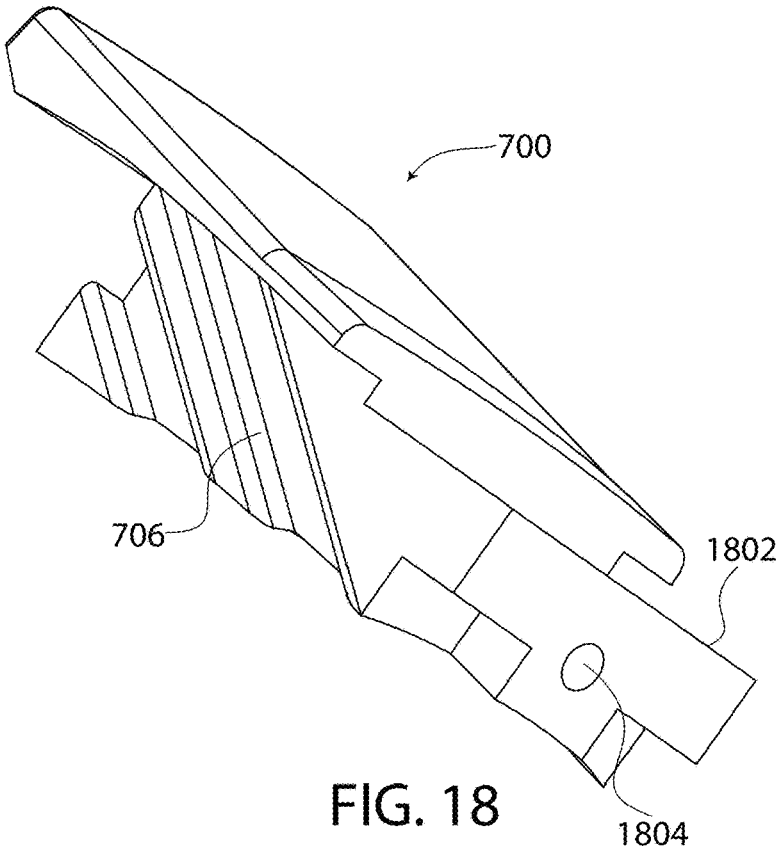
FIG. 18 illustrates a side perspective view of the slider of FIG. 17.
Figure 19:
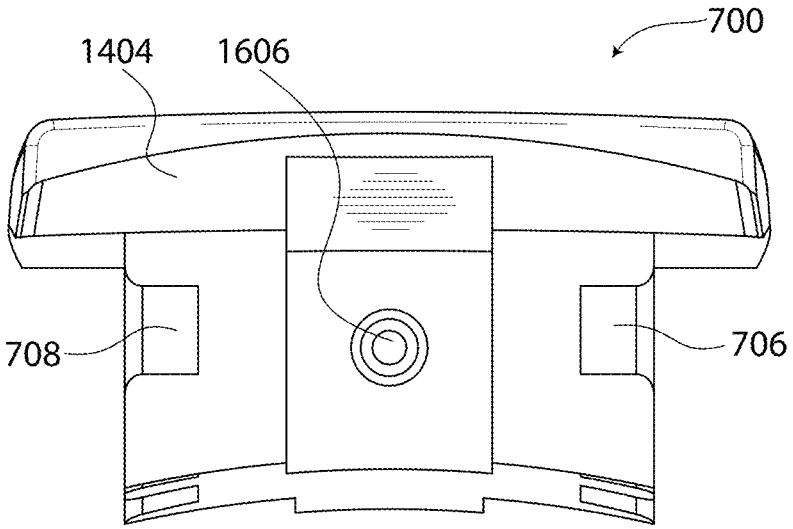
FIG. 19 illustrates a rear view of the slider of FIG. 17.
Figure 20:
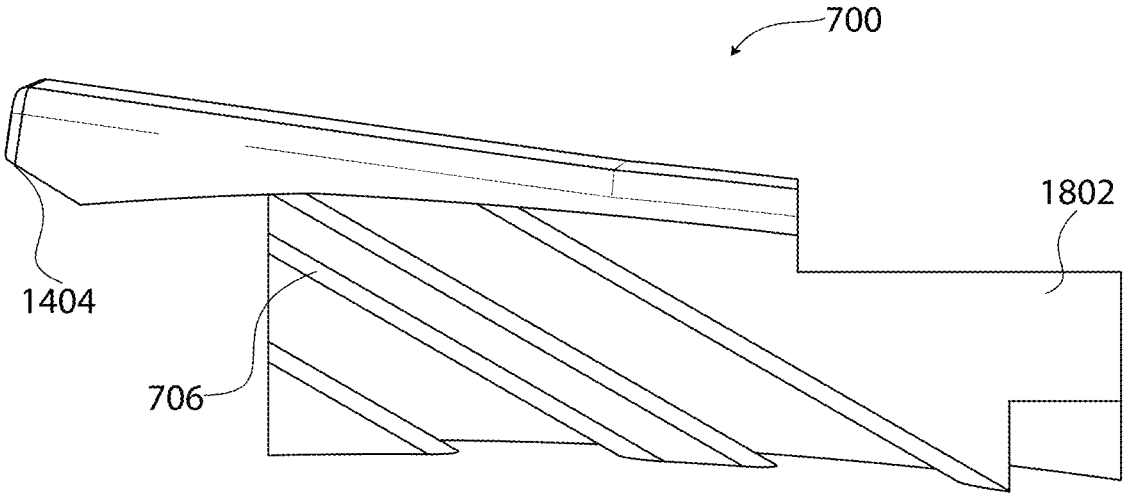
FIG. 20 illustrates a right-side view of the slider of FIG. 17.
Figure 21:
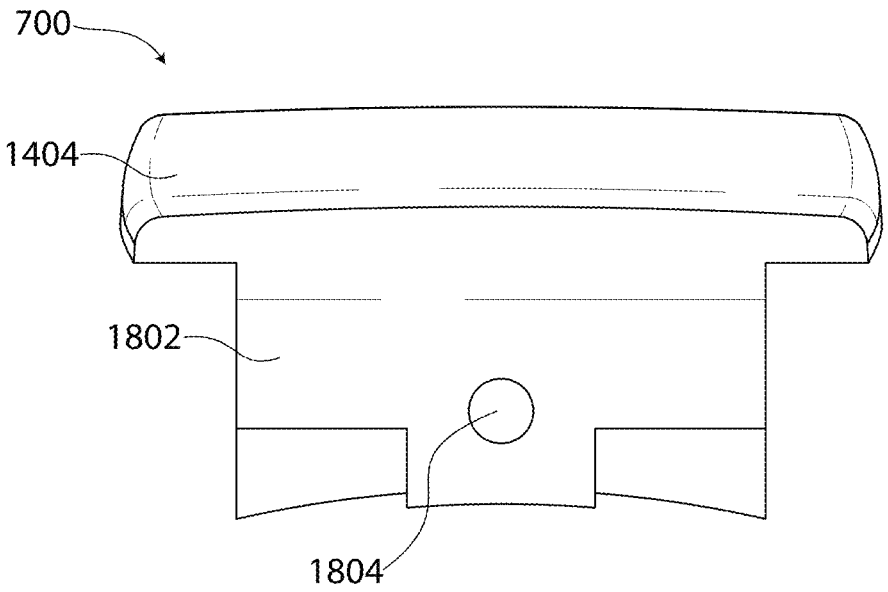
FIG. 21 illustrates a front view of the slider of FIG. 17.
Figure 22:
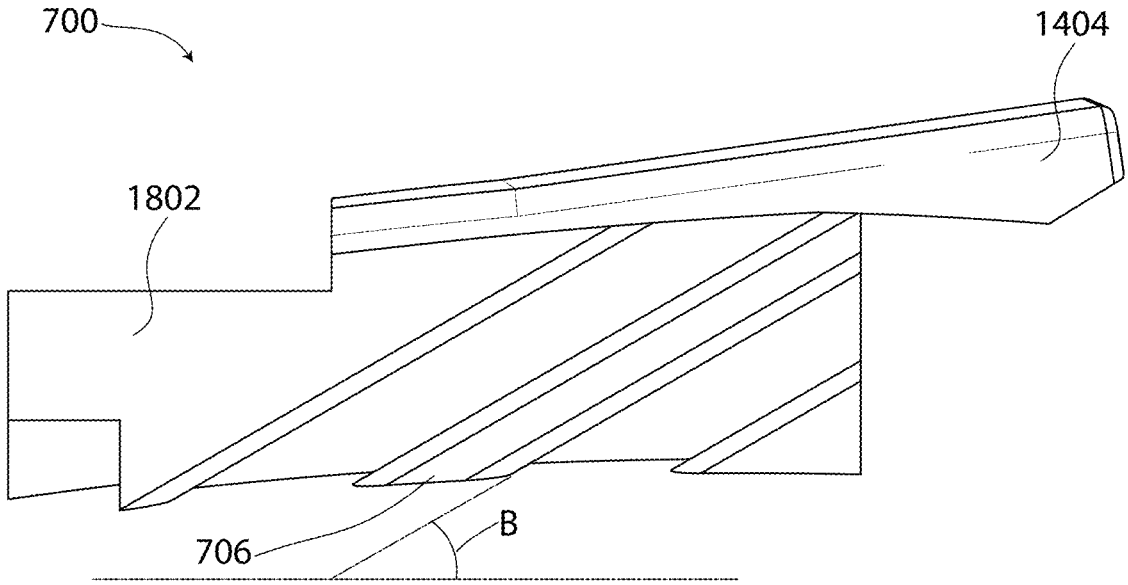
FIG. 22 illustrates left-side view of the slider of FIG. 17.
Figure 23:
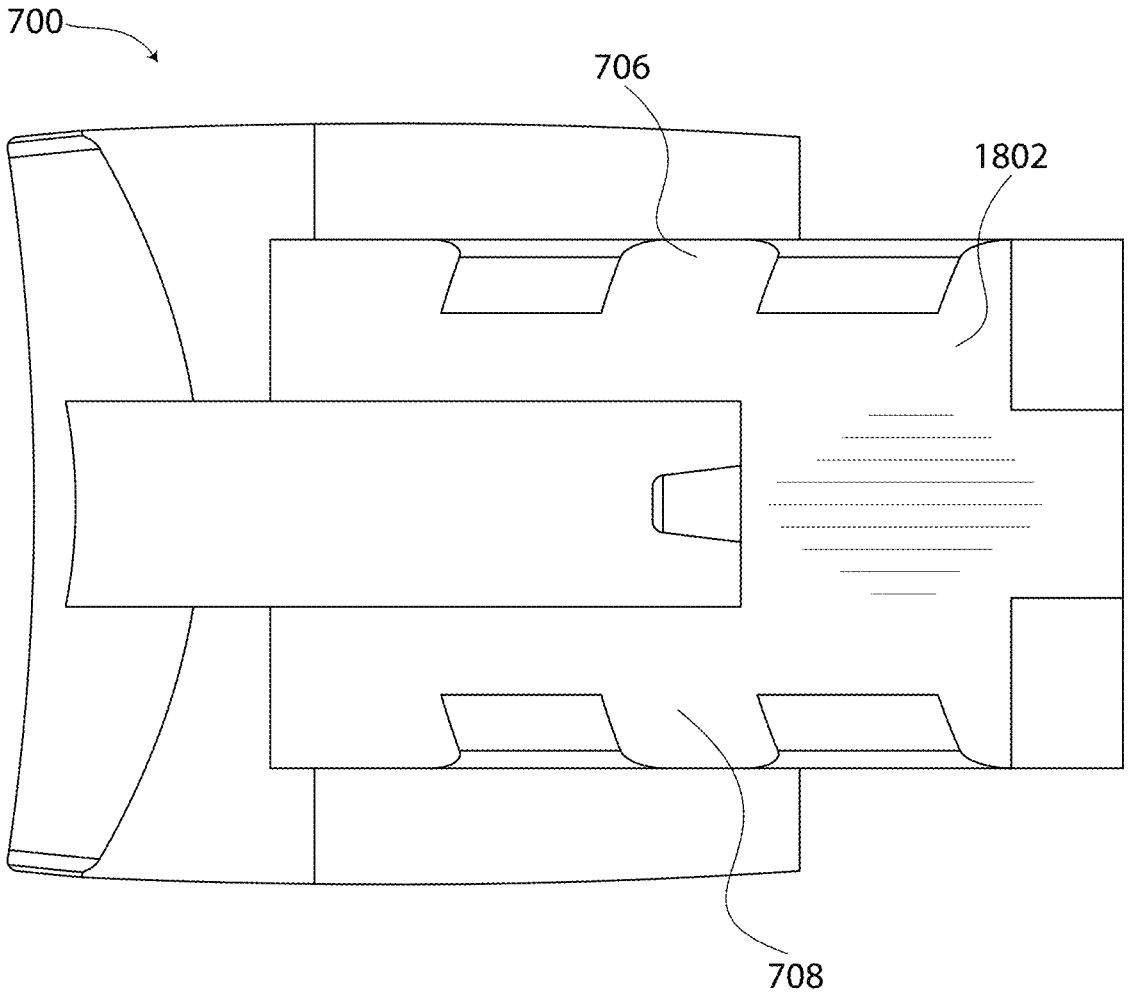
FIG. 23 illustrates a bottom view the slider of FIG. 23.

FIGS. 17-23 illustrate various different views of the slider 700 of the buckle assembly 200. In particular, FIG. 17 illustrates a bottom perspective view of the slider 700. FIG. 18 illustrates a side perspective view of the slider 700. FIG. 19 illustrates a rear view of the slider 700. FIG. 20 illustrates a right-side view of the slider 700. FIG. 21 illustrates a front view of the slider 700. FIG. 22 illustrates a left-side view of the slider 700. FIG. 23 illustrates a bottom view of the slider 700.

As mentioned above and as shown in FIGS. 17, 18, 19, 20, 22, the slider 700 may include the first guide 706 and the second guide 708 such that the first guide 706 and the second guide 708 may each include at least one groove with these grooves respectively corresponding to grooves in the first ramp 910 and the second ramp 912 of the base 900. Further, each of the first guide 706 and the second guide 708 may be inclined to the horizontal, and an angle of inclination of the first guide 706 and the second guide 708 may be the same as, slightly greater than, or substantially greater than an angle of inclination of the first ramp 910 and the second ramp 912 of the base 900. In some example configurations, the angle of inclination of the first guide 706 and the second guide 708 may be between 0 and 60 degrees. The first guide 706 and the second guide 708 may be formed into the slider 700 or may be attached separately to the slider 700. The first guide 706 may be configured to slidingly engage with the first ramp 910, and similarly the second guide 708 may be configured to slidingly engage the second ramp 912. This engagement of the first guide 706 and the second guide 708 with the first ramp 910 and the second ramp 912 enables the slider 700 to slidingly move relative to the base 900. Further, due to the incline of the first guide 706, the second guide 708, the first ramp 910, and the second ramp 912 relative to the base top 918 (Refer FIG. 9), the slider 700 may slidingly move relative to the base 900 to perform a horizontal displacement as well as a vertical displacement relative to the base 900. The inclined slide surface 1404 of the slider 700 and the inclined top surface 1402 of the cap 802 may ease this horizontal and vertical displacement of the slider 700 relative to the base 900.

As shown in FIG. 18, one end of the slider 700 opposite the inclined slide surface 1404 may be formed as a T-shaped structure 1802. The T-shaped structure 1802 may further include a groove 1804. In some configurations, the trigger 850 may be aligned and fastened to the T-shaped structure 1802 using the fastener 808. Further, as shown in FIG. 19, in some configurations, the second hold pin 1602 may be formed central to the slider 700.

Figure 24:
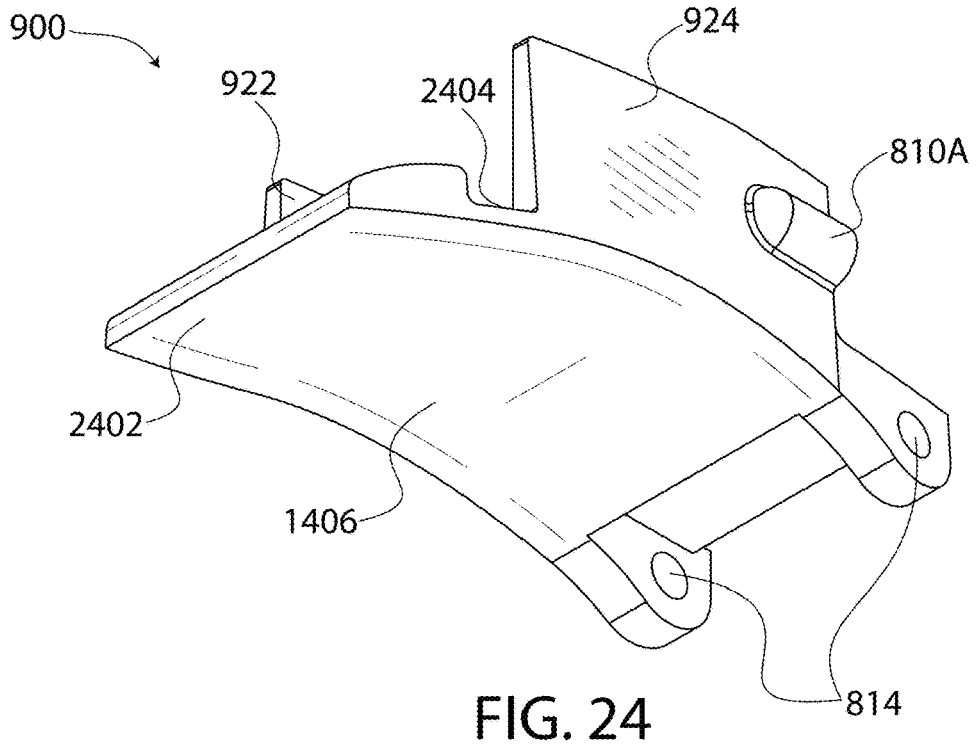
FIG. 24 illustrates a bottom perspective view of an illustrative configuration of a base of the buckle assembly.
Figure 25:
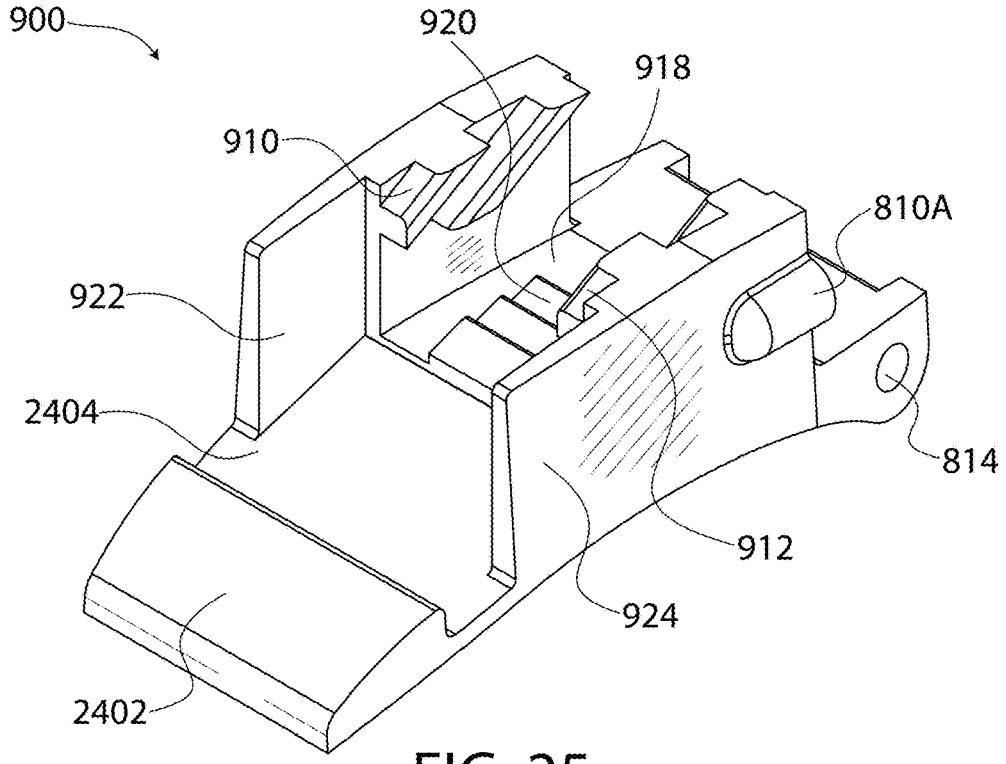
FIG. 25 illustrates a top perspective view of the base of FIG. 24.
Figure 26:
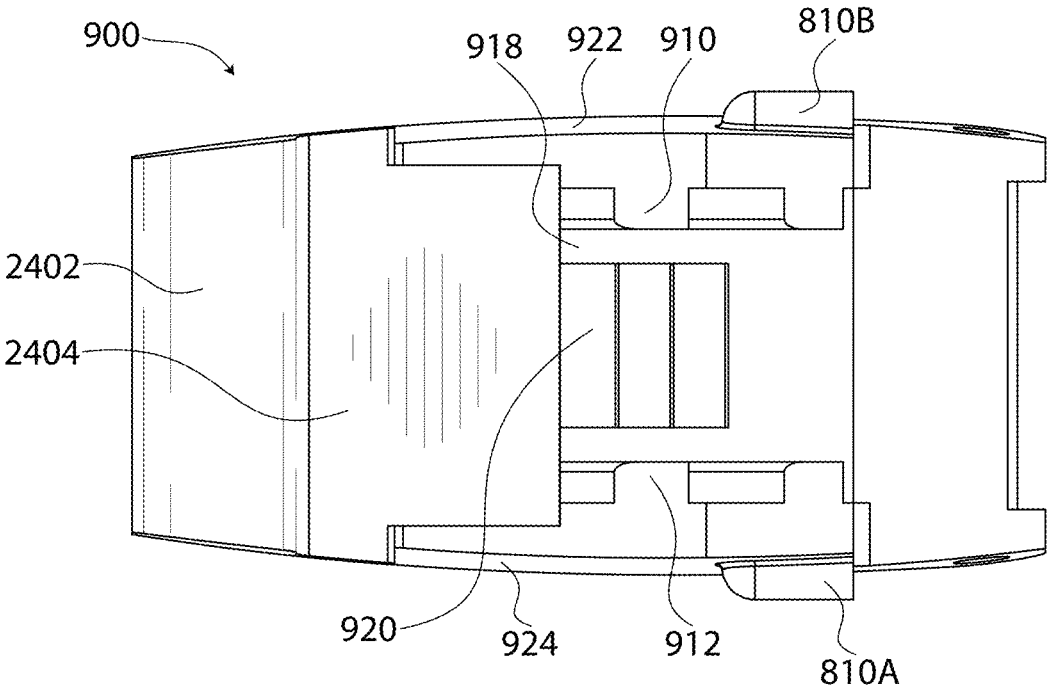
FIG. 26 illustrates a top view of the base of FIG. 24.
Figure 27:
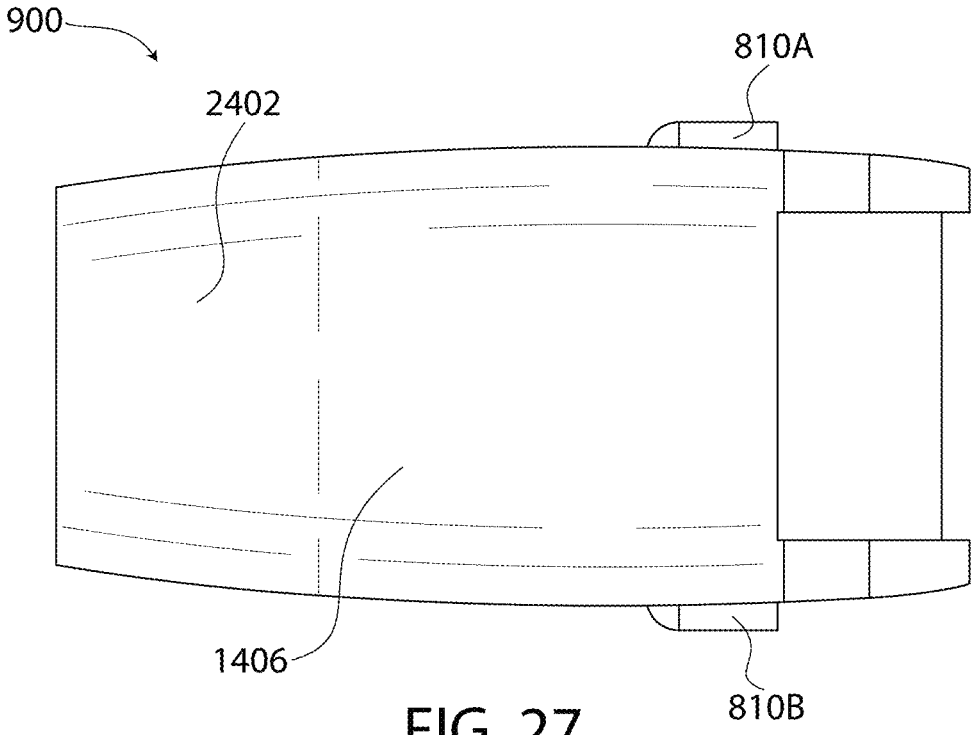
FIG. 27 illustrates a bottom view of the base of FIG. 24.
Figure 28:
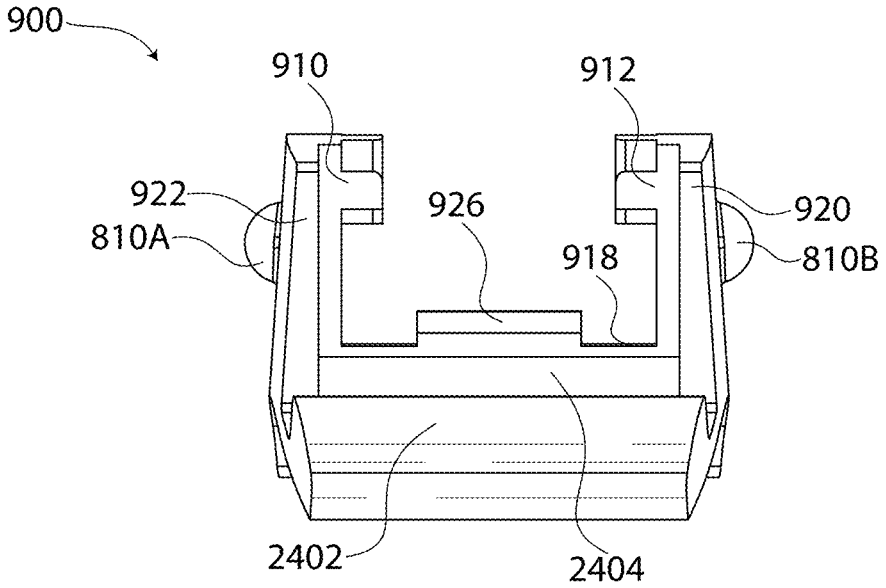
FIG. 28 illustrates a front view of the base of FIG. 24.
Figure 29:
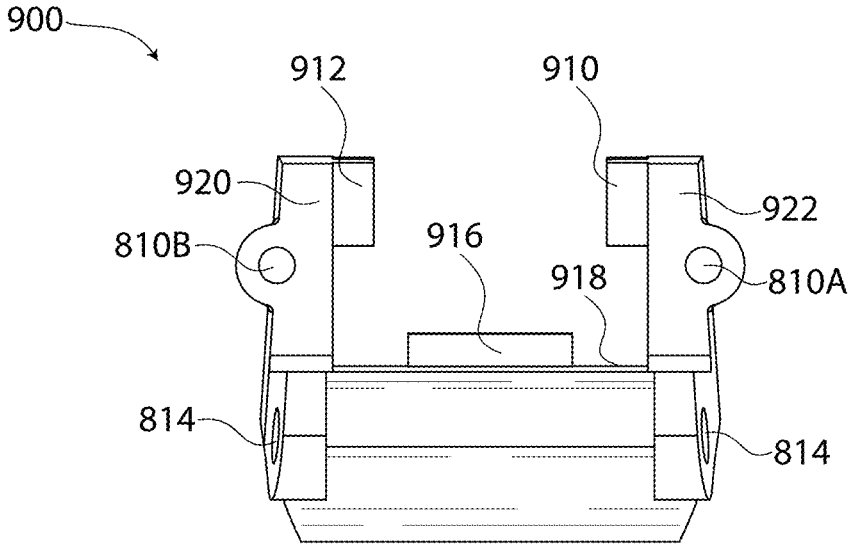
FIG. 29 illustrates a rear view of the of the base of FIG. 24.
Figure 30:
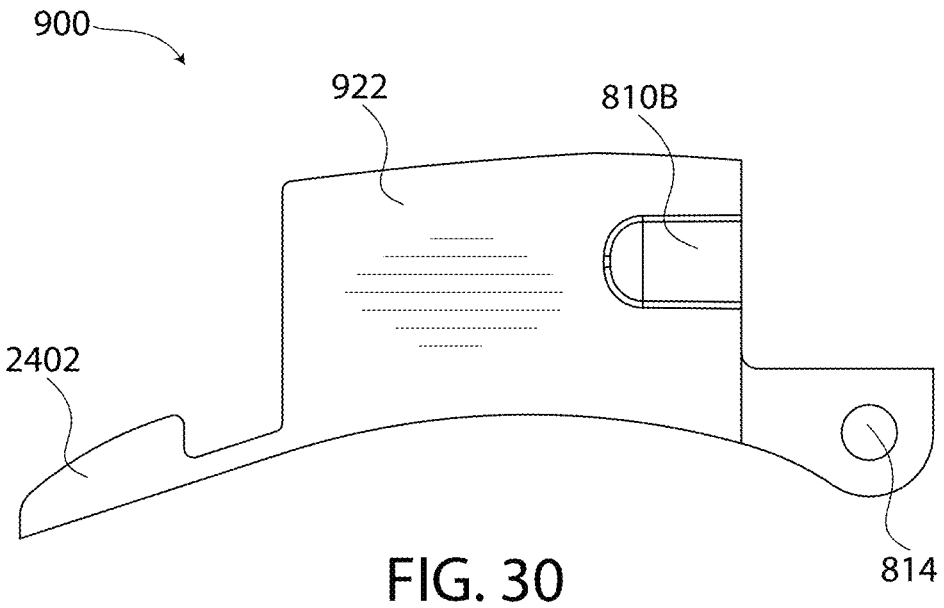
FIG. 30 illustrates right-side view of the base of FIG. 24.
Figure 31:
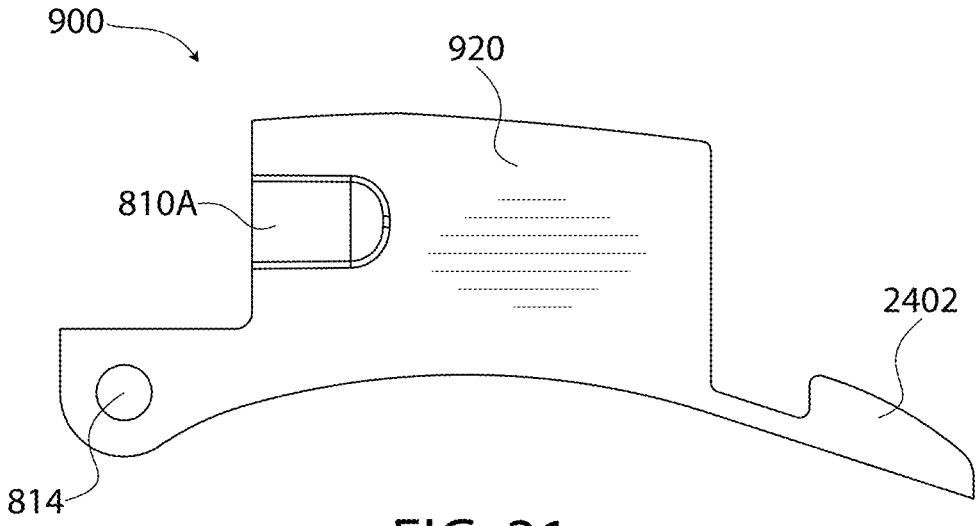
FIG. 31 illustrates a left-side view of the base of FIG. 24.

FIGS. 24-31 illustrate different views of the base 900. In particular, FIG. 24 illustrates a bottom perspective view of the base 900. FIG. 25 illustrates a top perspective view of the base 900. FIG. 26 illustrates a top view of the base 900. FIG. 27 illustrates a bottom view of the base 900. FIG. 28 illustrates a front view of the base 900. FIG. 29 illustrates a rear view of the base 900. FIG. 30 illustrates a right-side view of the base 900. FIG. 31 illustrates a left-side view of the base 900.

As shown above and clearly illustrated in FIGS. 24-31, the base 900 may include the first wall 922 and the second wall 924. The second wall 924 may be parallel to and offset from the first wall 922. In some configuration further illustrated by FIG. 25, the first wall 922 and the second wall 924 may protrude from the top 918. In such configurations, the first wall 922 and the second wall 924 may be separated by a width such that the strap 300 may be allowed to pass therebetween.

In some configurations, the slider 700 may include a stopper 2402. The stopper 2402 may be formed at the front end of the base 900 and may be configured to restrict the movement of the slider 700 relative to the base 900. In this configuration, the first wall 922 and the second wall 924 may include the first ramp 910 and the second ramp 912, respectively. Further, a pathway 2404 may be between the stopper 2402 on one end and the first wall 922 and the second wall 924 on the sides. This region may act as a pathway 2404 for the movement of the slider 700 as the fastening system 100 is reconfigured between the engaged condition and the released condition. The pawl 920 may be formed adjacent to this pathway 2404. As such, the pathway 2404 may be formed between the stopper 2402 and each of the first wall and the second wall of the base 900. The movement of the trigger 850 may be confined within the pathway 2404 and force carried by the strap 300 is carried by the stopper 2402 instead of the lifter (e.g. lifter 852, FIG. 9).

Further, as shown in FIG. 26, the pawl 920 is formed between the first wall 922 and the second wall 924, adjacent to the pathway 2404. Further, as shown in FIGS. 28-29, the first ramp 910 and the second ramp 912 may protrude respectively from the first wall 922 and the second wall 924 toward each other and toward the middle of the base 900. In this configuration, the pawl 920 may further protrude from the top 918. As shown in FIGS. 30-31, the first set of fastening channels 810A and 810B may be formed respectively on the inner surfaces of the first wall 922 and the second wall 924. In such configurations, the second set of fastening channels 812 may be parallel to and offset from the first.

Figure 32:
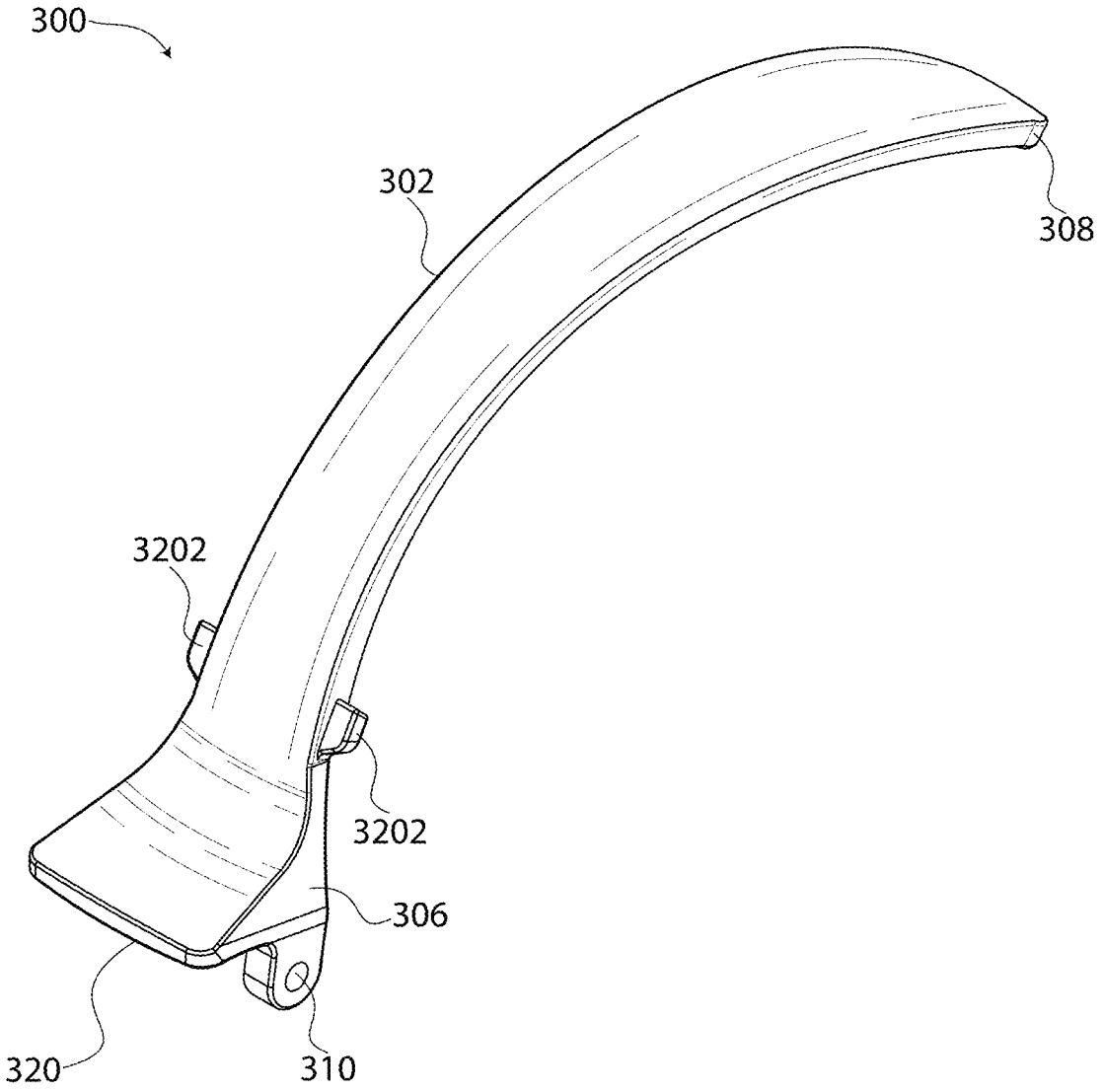
FIG. 32 illustrates a top perspective view of an illustrative strap for a fastening system.
Figure 33:
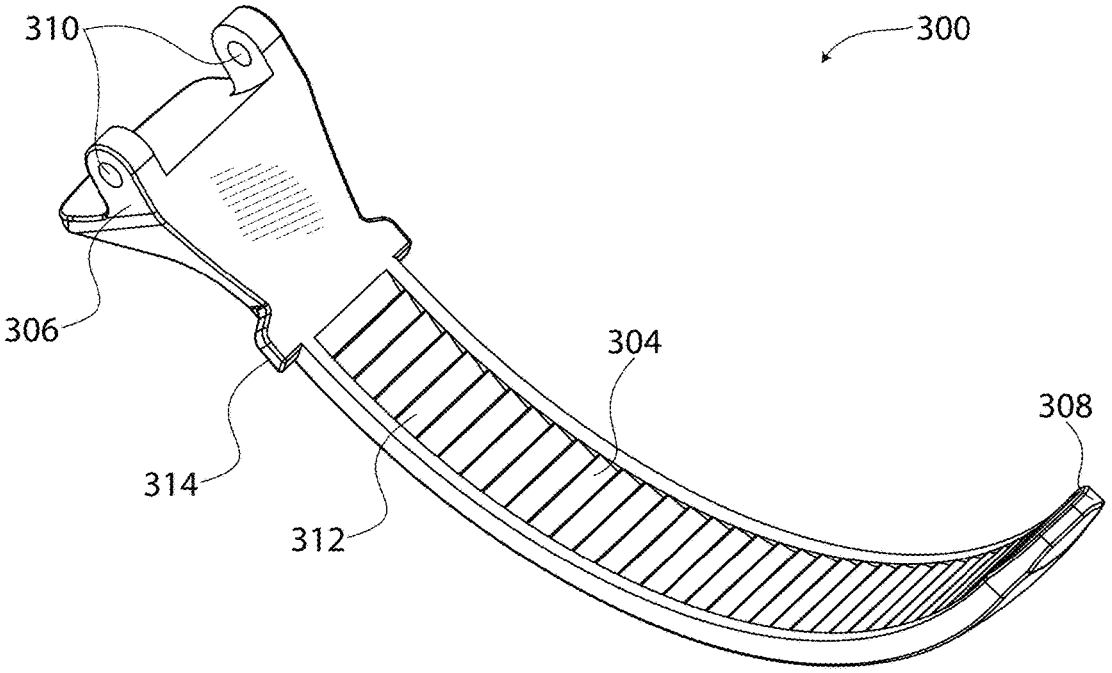
FIG. 33 illustrates a bottom perspective view of the strap of FIG. 32.
Figure 34:
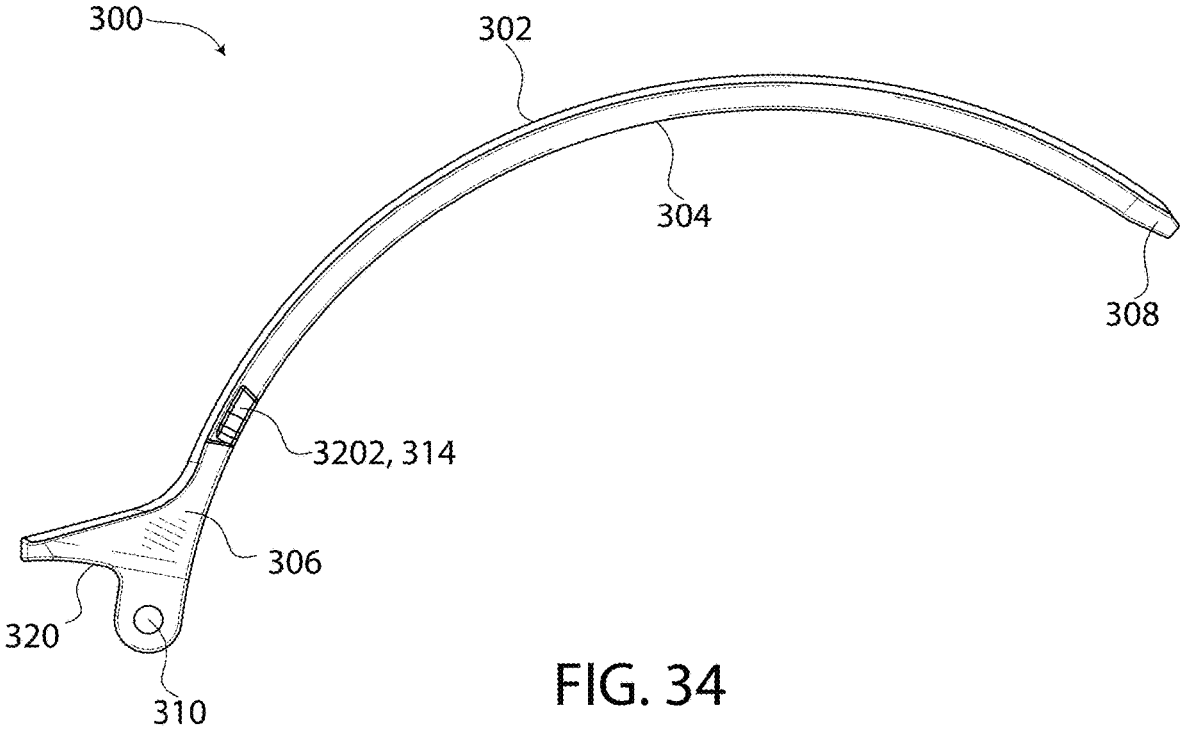
FIG. 34 illustrates a right-side view of the strap of FIG. 32.
Figure 35:
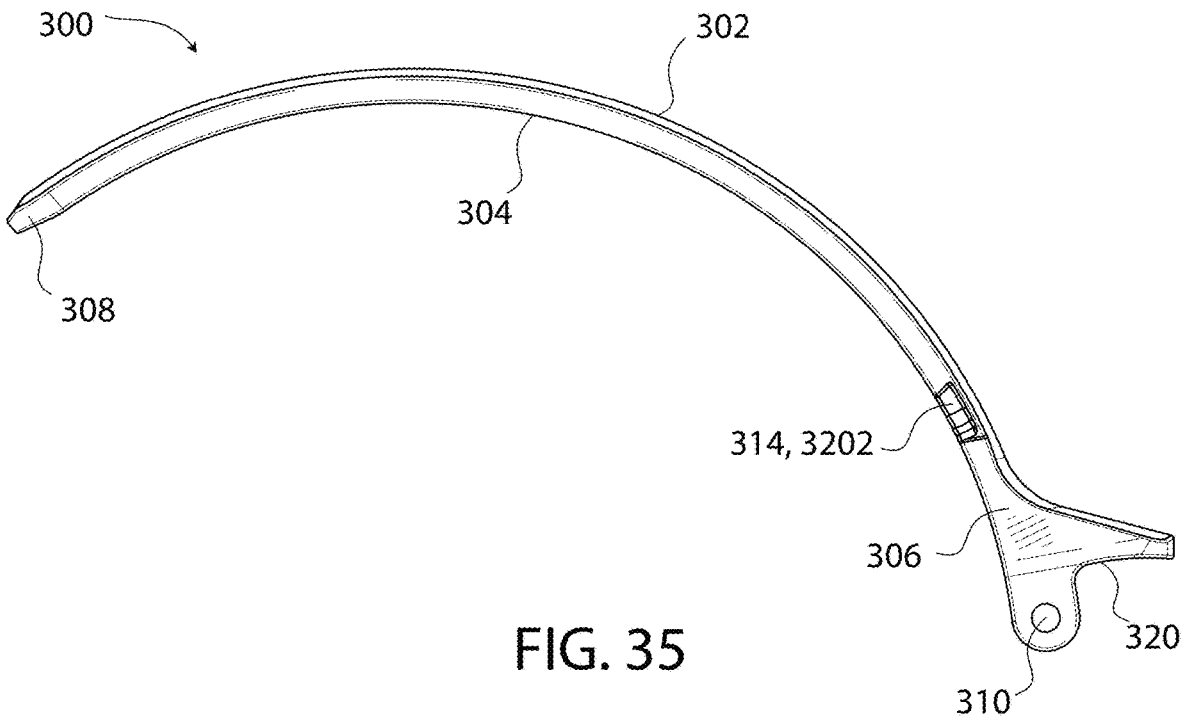
FIG. 35 illustrates a left-side view of the strap of FIG. 32.
Figure 36:
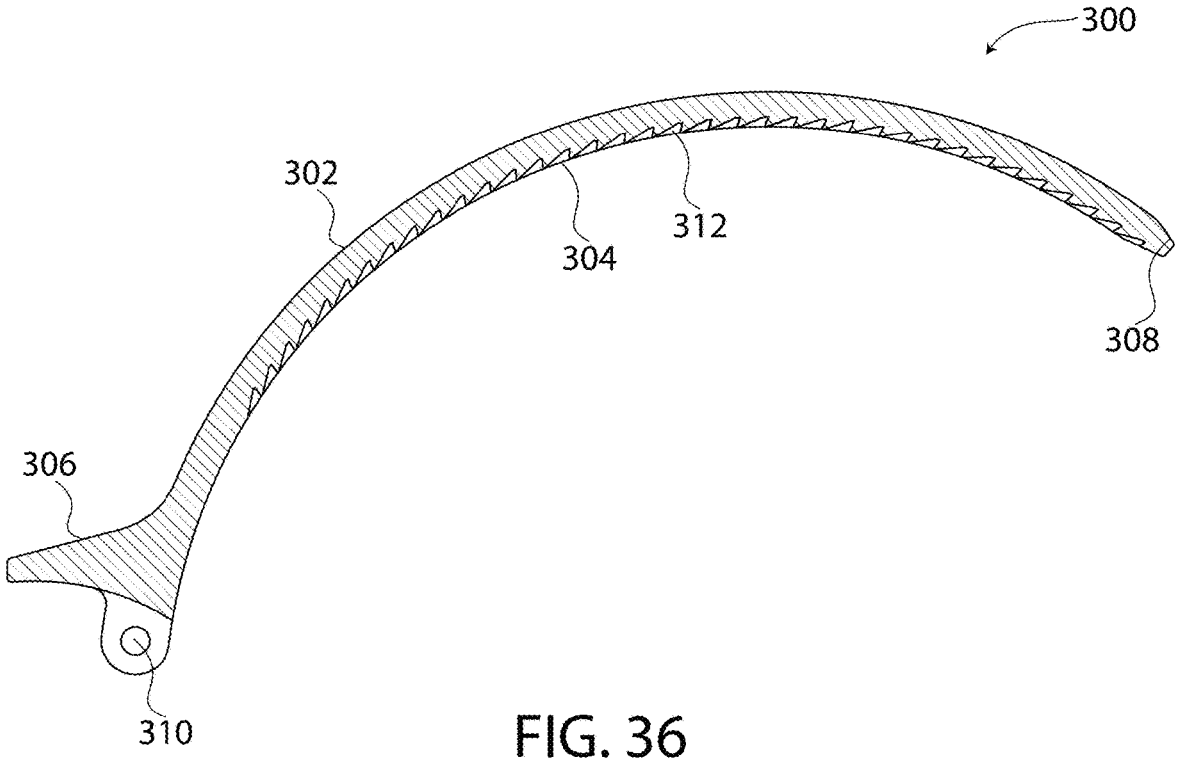
FIG. 36 illustrates a cross-sectional view across a central plane of the strap of FIG. 32.
Figure 37:
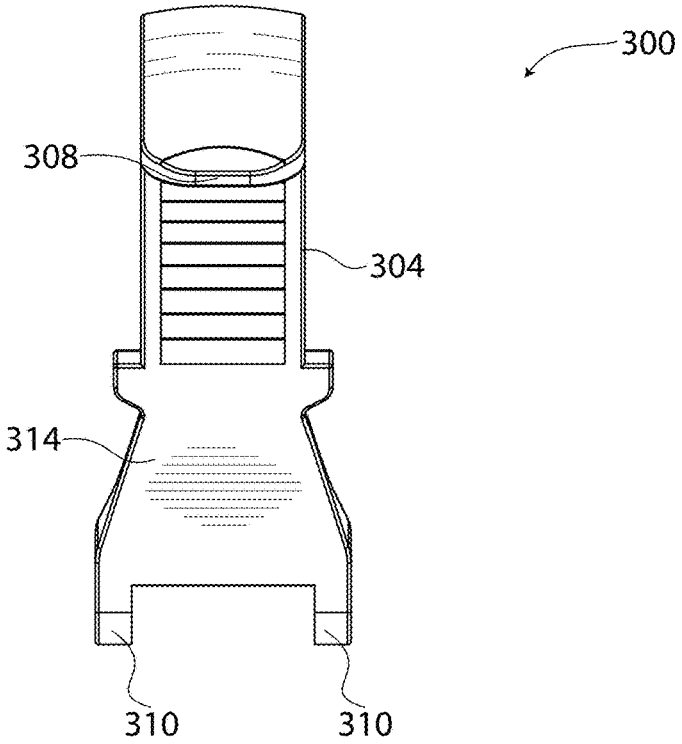
FIG. 37 illustrates a rear view of the strap of FIG. 32.
Figure 38:
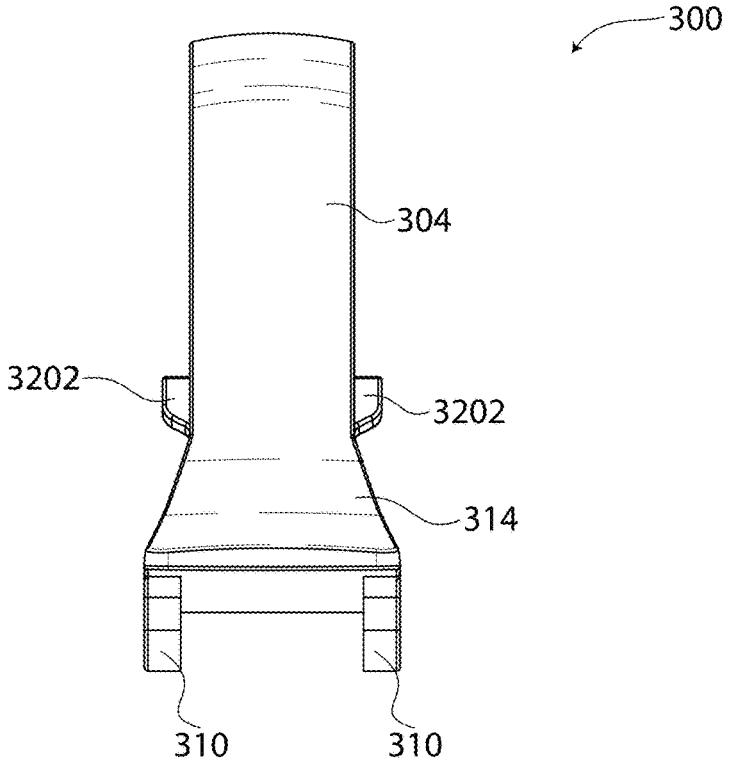
FIG. 38 illustrates a front view of the strap of FIG. 32.

FIGS. 32-38 illustrate various views of the strap 300. In particular, FIG. 32 illustrates a top perspective view of the strap 300 showing the back surface 304 of an illustrative configuration of the strap 300. FIG. 33 illustrates a bottom perspective view of the strap 300. FIG. 34 illustrates a right-side view of the strap 300. FIG. 35 illustrates a left-side view of the strap 300. FIG. 36 illustrates a cross-sectional view across a central plane of the strap 300. FIG. 37 illustrates a rear view of the strap 300. FIG. 38 illustrates a front view of the strap 300.

As shown in FIGS. 32-38, the strap may include the proximal end 306 and the distal end 308. The proximal end 306 may be oppositely disposed from the distal end 308. In this configuration, at least one protrusion 3202 (or as illustrated a pair of protrusions 3202) may be formed on the strap 300. At least one protrusion 3202 may be configured to restrict the movement of the strap 300 relative to the buckle assembly 200 (to allow release of the strap from the buckle assembly via a digit). Therefore, the movement of the strap 300 is restricted beyond at least one protrusion 3202. In an alternative configuration, a single protrusion may be formed on the front surface 302 of the strap 300. In an alternative configuration, the slider 700 of the buckle assembly 200 may include an indentation (not shown in FIGS. 32-38) to accommodate at least one protrusion 3202. In another configuration, the proximal end 306 of the strap 300 may further include a first pair of holes 310. A pair of holes 310 may be configured to house a pin (not shown in the figures) to which the webbing (e.g., the webbing 104) may be coupled.

Figure 39:
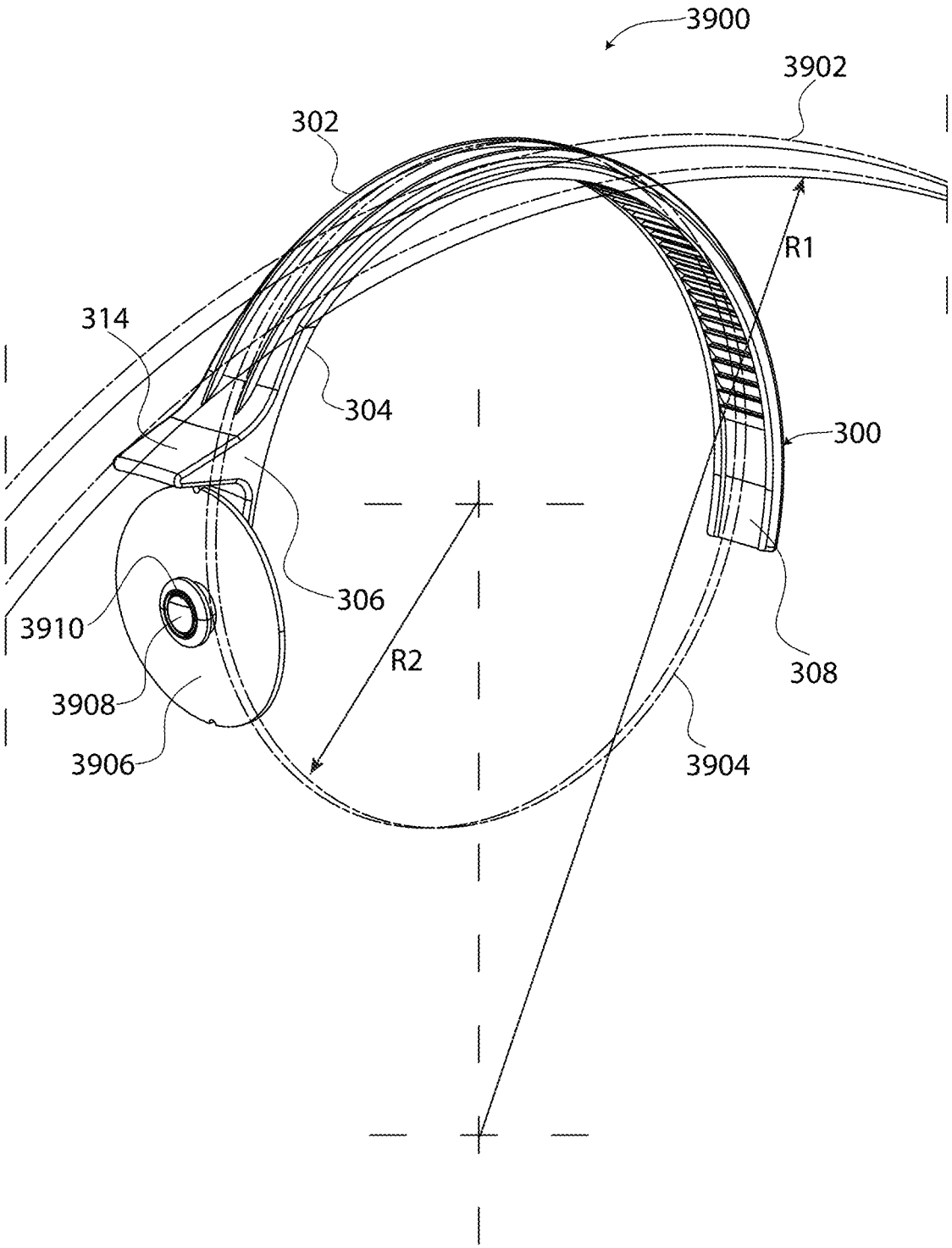
FIG. 39 is a schematic diagram of an illustrative strap formed with curvature that improves the routing of the distal end of the strap.

FIG. 39 illustrates a schematic diagram 3900 of the strap 300 and a curvature 3902 associated with the top 918 of the base 900 of the buckle assembly 200 (not shown in FIG. 39). The curvature 3902 may improve the routing of the distal end 308 of the strap 300. As mentioned above, a curvature 3902 (i.e., curved profile) may be followed on the buckle assembly 200 to allow the buckle assembly 200 to be aligned with the contours of the object (e.g., a footwear) on which the fastening system 100 is used. Further, as mentioned above, the strap 300 may include a curvature 3904 which causes the strap 300 to stay aligned with the contours of the object on which the fastening system 100 is used. As shown in FIG. 39, the buckle assembly 200 (specifically the top 918) may define a first radius of curvature R1, and the strap 300 may define a second radius of curvature R2. The second radius of curvature R2 of the strap 300 may be smaller than the first radius of curvature R1 of the buckle assembly 200. As will be appreciated, due to the different radiuses of curvature, the strap 300 may by default be biased away from the top 918 of the base 900. Therefore, when the buckle assembly 200 is configured in the released configuration, the curvature 3904 of the strap 300 may cause the array of teeth 312 of the strap 300 to automatically disengage from a pawl 920 on the top 918 of the buckle assembly 200.

Further, as mentioned above, the proximal end 306 of the strap 300 may include an attachment mechanism (e.g., a hinge mechanism) to attach the strap 300 to the object 10. To this end, the attachment mechanism may include an anchor 3906 as shown in FIG. 39. The anchor 3906 may be configured to attach to the strap 300, for example, via the first pair of holes 310 and an associated pin (refer FIG. 3). The anchor 3906 may be affixed to the object 10 to thereby couple the strap 300 with the object. As best illustrated in FIG. 39, the anchor 3906 may interface with a post 3908. The post 3908 may be formed with a button-top in which a cutout 3910 is formed. The cutout 3910 can interface with an undercut of the anchor 3906 to allow for a ¼-turn release mechanism. If provided with this ¼-turn release mechanism, the strap 300 may be rotated to a position where it is translatable relative to the anchor 3906. This translation of the strap 300 relative to the anchor 3906 may be provided to improve servicing and/or customization of the strap 300 (through quick release of the strap).

Figure 40:
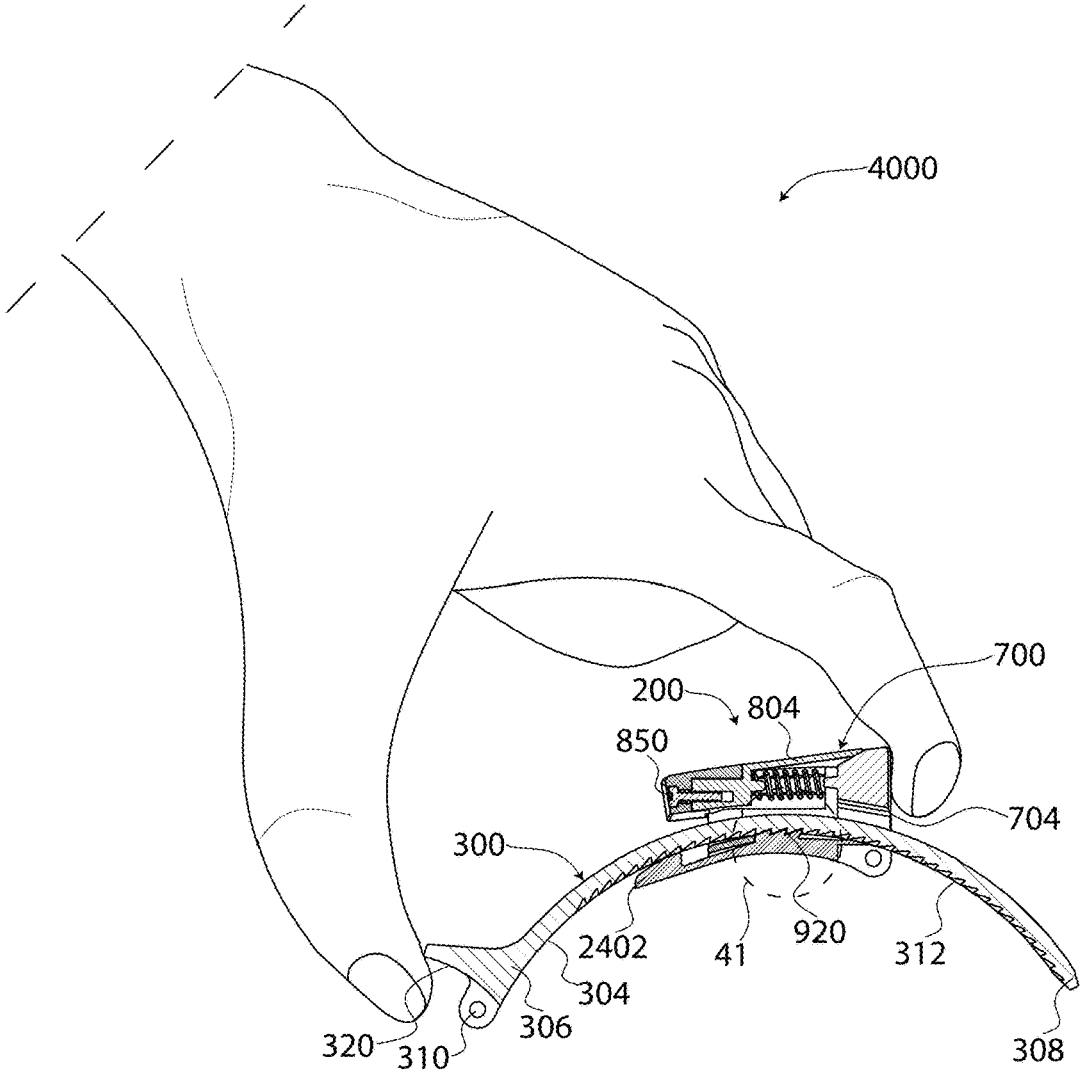
FIG. 40 illustrates a cross-sectional side view of an illustrative configuration of a fastening system in an engaged condition.

With reference to FIG. 40 illustrating a cross-sectional side view 4000 of the fastening system 100 in the engaged condition, the fastening system 100 may be configurable between the engaged condition and the released condition. In the engaged condition, the slider 700 may be initially positioned at the first position. In the first position, the slider 700 may be offset from the top 918 of the base 900 by the first distance. The first distance can be envisioned as a gap between the trigger 850 and the top 918. Further, in the engaged configuration, the pawl 920 formed on the top 918 may engage with the array of teeth 312 formed on the back surface 304 of the strap 300. In order to fasten the object (on which the fastening system 100 is provided), the user may place their index finger on the stop 314 (i.e., on the digit surface 320 formed on the stop 314) and place the thumb on the digit surface 704 (i.e., the rear end 604) of the buckle assembly 200. When the user applies a pinching force between the digit surface 320 and the digit surface 704, the strap 300 may undergo a rotation in the clockwise direction (refer FIG. 36). Rotation of the strap 300 in the clockwise direction may pull the webbing 104 (refer FIG. 1), which may tighten or fasten the object 10. In the engaged condition, as the array of teeth 312 and the pawl 920 are engaged, rotation of the strap 300 in the counterclockwise direction is inhibited.

Figure 41:
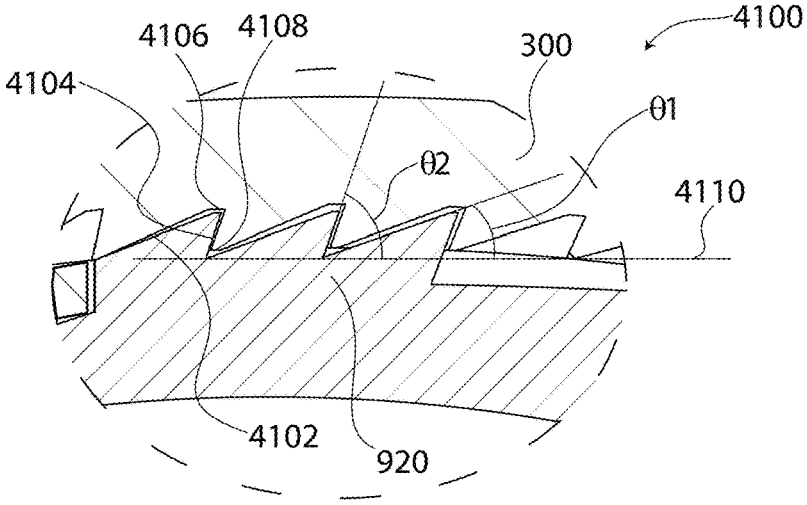
FIG. 41 illustrates a magnified view (indicated as 41, FIG. 40) of the fastening system of FIG. 40 in the engaged condition and showing an array of teeth of an illustrative strap and an illustrative pawl(s) of the buckle assembly.

With reference to FIG. 41 illustrating a magnified view 4100 of the fastening system 100 in the engaged condition and showing the array of teeth 312 of the strap 300 and the pawl 920 of the buckle assembly 200, in the engaged condition, the pawl 920 formed on the top 918 of the base 900 is engaged with the array of teeth 312 formed on the back surface 304 of the strap 300.

In some configurations, each tooth of the array of teeth 312 may include a slope 4102 and a flank 4104. Further, a peak 4106 may be defined at an intersection of the slope 4102 and the flank 4104 of each tooth of the pawl 920. Further, a root 4108 may be defined at an intersection of the slope 4102 and the flank 4104 of two respective adjacent teeth of pawl 920. In some configurations, if an imaginary line 4110 tangential to the osculating circle indicated by the second radius of curvature R2 (refer FIG. 39) and passing through a root 4108 defined for an adjacent pair of teeth of the pawl 920, the slope 4102 may be inclined to the tangential line 4110 through the root 4108 at a first angle θ1. Further, the flank 4104 may be inclined to the tangential line 4110 through the root 4108 at a second angle θ2. As shown in FIG. 41, each of the first angle θ1 and the second angle θ2 may be acute, (i.e., less than 90 degrees). Similarly, as will be understood, the counter teeth on the pawl 920 of the buckle assembly 200 may also define a slope, a flank, a peak, a root, a first angle, and a second angle, corresponding to that of the array of teeth 312 of the strap 300. In some configurations, the first angle θ1 and/or the second angle θ2 may be driven by a guide angle B (see FIG. 22) of the first guide 706 and/or the second guide 708 formed on the slider 700. The guide angle B may, in one configuration may be slightly greater than, or slightly less than the first angle θ1; and, in a very specific configuration, the guide angle B may be less than the first angle θ1 by a range of 1 to 10 degrees. This configuration allows the slider 700 to release the strap 300 from the base 900 without binding or damaging the fastening system 100.

Figure 42:
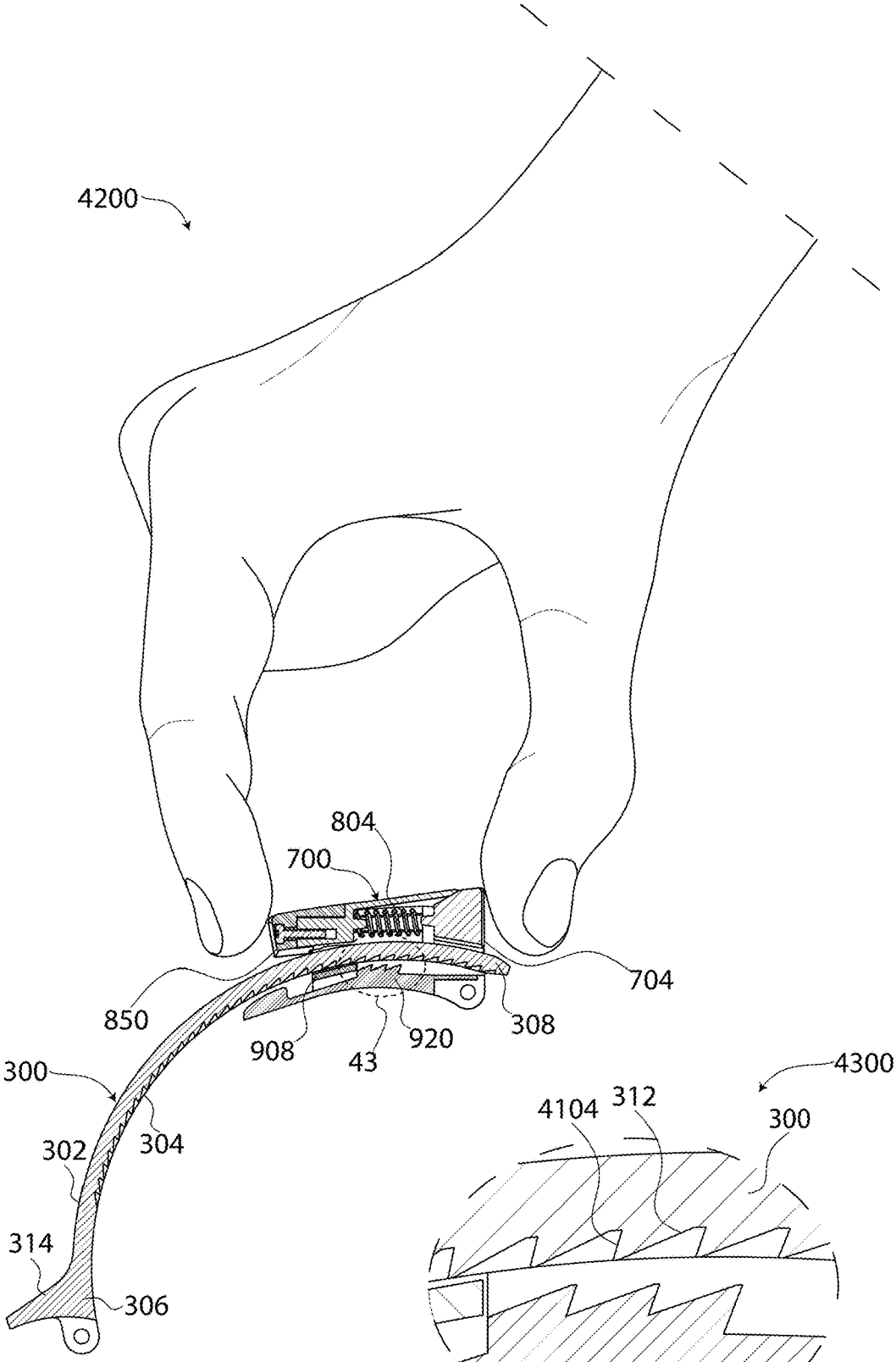
FIG. 42 illustrates a side cross-sectional view of an illustrative configuration of a fastening system in a released condition.

With reference to FIG. 42 illustrating a side cross-sectional view 4200 of the fastening system 100 in the released condition, the slider 700 is alternatively transitioned from the first position to the second position. To configure the fastening system 100 in the released condition, the user may place their index finger on the digit surface 702 and their thumb on the digit surface 704 of the buckle assembly 200. Further, the user may apply a pinching action between the digit surface 702 and the digit surface 704 to move the slider 700 from the first position to the second position. In the second position, the slider 700 is offset from the top 918 of the base 900 by a second distance, which is envisioned as the gap between the trigger 850 and the top 918. The second distance may be greater than the first distance (refer FIG. 40). As mentioned earlier, the engagement of the first guide 706 with the first ramp 910 and the second guide 708 with the second ramp 912 (refer FIG. 9) may enable sliding of the first guide 706 on the first ramp 910 and sliding of the second guide 708 on the second ramp 912. This sliding motion may enable the transition of the slider 700 from the first position to the second position. Further, the sliding of the slider 700 to the second position may cause the trigger 850 to lift the strap 300, thus disengaging the pawl 920 from the array of teeth 312. As such, in the released condition, the array of teeth 312 and the pawl 920 are disengaged, and the strap 300 is free to move relative to the buckle assembly 200 in the clockwise direction as well as the anti-clockwise direction.

Figure 43:
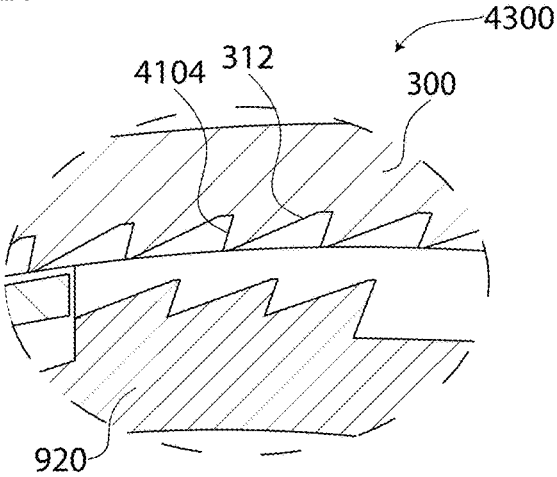
FIG. 43 illustrates a magnified view (indicated as 43, FIG. 42) of the fastening system in the released condition and showing the array of teeth of an illustrative strap and an illustrative pawl(s) of the buckle assembly.

With reference to FIG. 43 illustrating a magnified view 4300 of the fastening system 100 in the released condition and showing the array of teeth 312 of the strap 300 and the pawl 920 of the buckle assembly 200, in the released condition, the array of counter teeth of the pawl 920 may be disengaged from the array of teeth 312.

Figure 44:
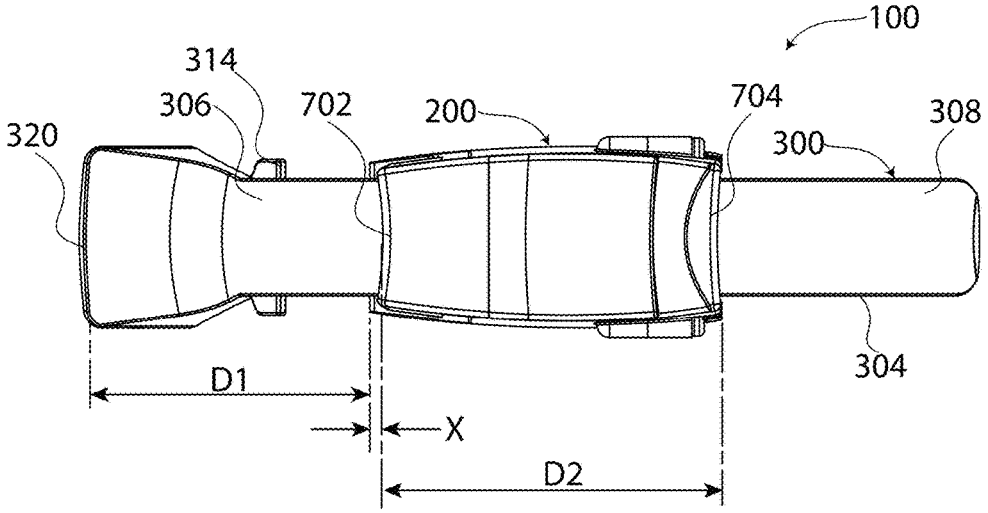
FIG. 44 illustrates a top view of the fastening system in an engaged condition wherein an illustrative trigger, configured as a slider, is biased such that movement of a strap is limited to a single/tightening direction.
Figure 45:
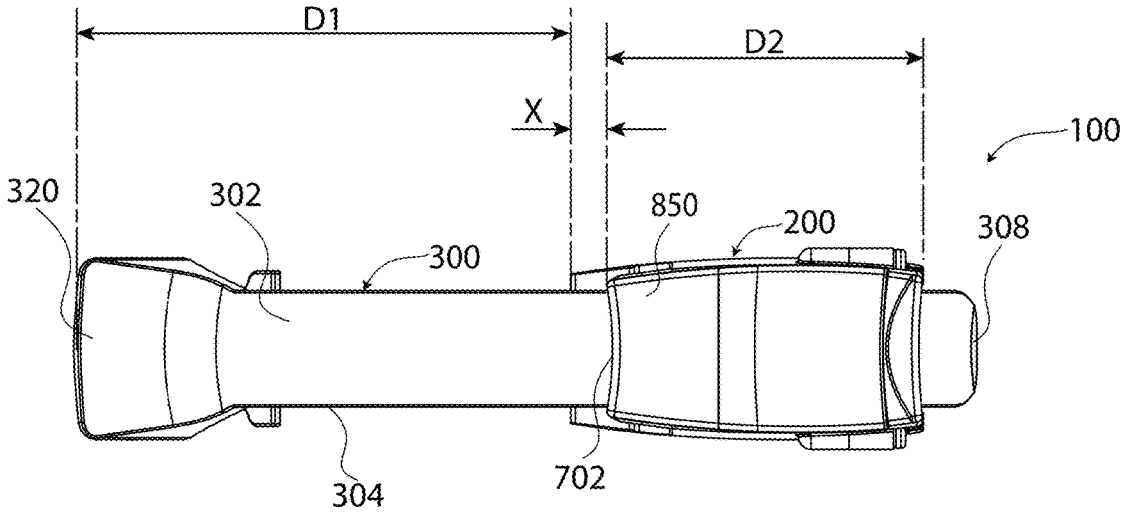
FIG. 45 illustrates a top view of the fastening system of FIG. 44 in the released condition wherein the trigger has been moved by distance X such that movement of the strap is not limited and thereby able to travel in the tightening and/or loosening directions.

FIGS. 44-45 illustrate top views of the fastening system 100 (corresponding to FIGS. 40 and 42) in the engaged condition and the released condition, respectively. As shown in FIG. 44, in the engaged condition, the slider 318 may be biased such that movement of a strap is limited to a single (tightening) direction. The slider 700 may be positioned at the first position (offset from the top 918 of the base 900 with the pawl 920 adjoining the array of teeth 312). As a result of the slider 700 being positioned at the first position, the digit surface 702 and the digit surface 704 are separated by a first distance D1. Further, a strap distance L1 is extant between the digit surface 320 and the digit surface 704 in the engaged condition. It should be noted that in order to obtain the engaged condition, in some example configurations, the pawl 920 (refer FIG. 9) is engaged with the array of teeth 312 (refer FIG. 3) while due to the manual application of equal and opposite forces to the digit surface 704 and the digit surface 320, the strap 300 slides the strap distance L1 through the buckle assembly 200.

In some configurations, the engaged condition may be obtained by manually applying forces to the buckle assembly 200 and the strap 300 such that the strap 300 covers a first stroke distance D1. It should be noted that the first stroke distance may be the minimum distance by which the strap 300 needs to be moved relative to the buckle assembly 200 to engage the strap 300 with the buckle assembly 200. As shown in FIGS. 44-45, the strap 300 needs to be moved relative to the buckle assembly 200 by the first stroke distance D1 to engage the strap 300 with the buckle assembly 200. As such, the first stroke distance D1 may be the minimum distance by which the digit surface 320 (of the strap 300) is moved relative to the buckle assembly 200 from a position when the strap 300 is completely disengaged from the buckle assembly 200 to a position when the engaged section (located between the base 900 and the slider 700) of the strap 300 is engaged with the pawl 920 of the buckle assembly 200.

As mentioned earlier, in the released condition shown in FIG. 45, the user applies equal and opposite forces on the digit surface 702 and the digit surface 704 of the buckle assembly 200. In the released condition, the strap 300 is free to move. In the released condition, the digit surface 702 and the digit surface 704 are separated by a second distance D2. As the slider transitions from the first position to the second position, the digit surface 702 moves closer to the digit surface 704 by a sliding distance X. As such, the second distance D2 is smaller in the released condition (second position). Further, it should be noted that to obtain the released condition, the pawl 920 may be disengaged from the array of teeth 312 by manually applying equal and opposite forces to the digit surface 702 and the digit surface 704 such that the slider 700 covers the sliding distance X. For obtaining the released position, the user may manually apply a pinching force to the slider 700 such that the slider 700 moves relative to the base 900 (i.e. the sliding distance X). The second stroke distance X (or the sliding distance X) is the distance by which the first digital surface 702 of the buckle assembly 200 is displaced (under the effect of the pinching action manually applied by the user) to completely release the strap from the buckle assembly 200. In the released condition, the strap 300 may be free to move relative to the buckle assembly 200.

Figure 46:
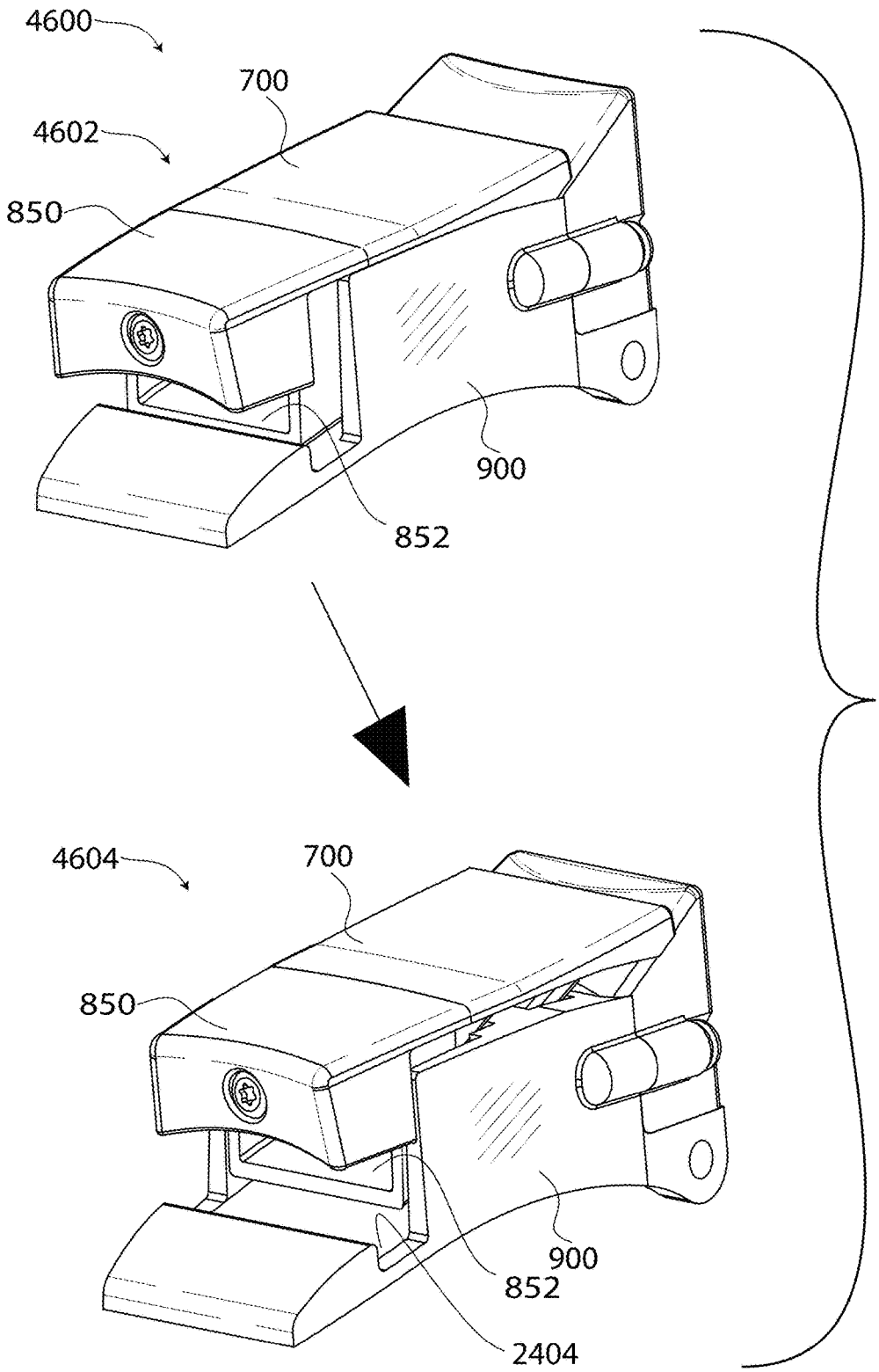
FIG. 46 illustrates a process of configuring an illustrative fastening system between an engaged condition and a released condition by moving a trigger/slider relative to a base.

With reference to FIG. 46 illustrating a process 4600 of configuring the fastening system 100 between the engaged condition and the released condition, the fastening system 100 may be configured in the engaged condition 4602 by default wherein the strap is long enough for the array of teeth 312 of the strap 300 to be removably engaged to the base 900. As mentioned above, in the engaged condition, the slider 700 is positioned at the first position and is offset from the top 918 of the base 900 by a first distance, and the pawl 920 is adjoining the array of teeth 312 (FIGS. 3, 9). Further, as a result of the slider 700 being positioned at the first position, the digit surface 702 and the digit surface 704 may be separated by the first distance D1.

The fastening system 100 may be configured in the released condition 4604 wherein the strap 300 easily removed and inserted for full opening when, for example, removing a foot from a wearable. In order to configure the fastening system 100 in the released condition, the user may apply a pinching force to the digit surface 702 and the digit surface 704 of the buckle assembly 200. Due to this pinching action, the digit surface 702 and the digit surface 702 may be separated by the second distance D2, which is smaller than the first distance D2. In the released condition, the strap 300 is free to rotate in both the clockwise and anti-clockwise directions relative to the buckle assembly 200.

Figure 47:
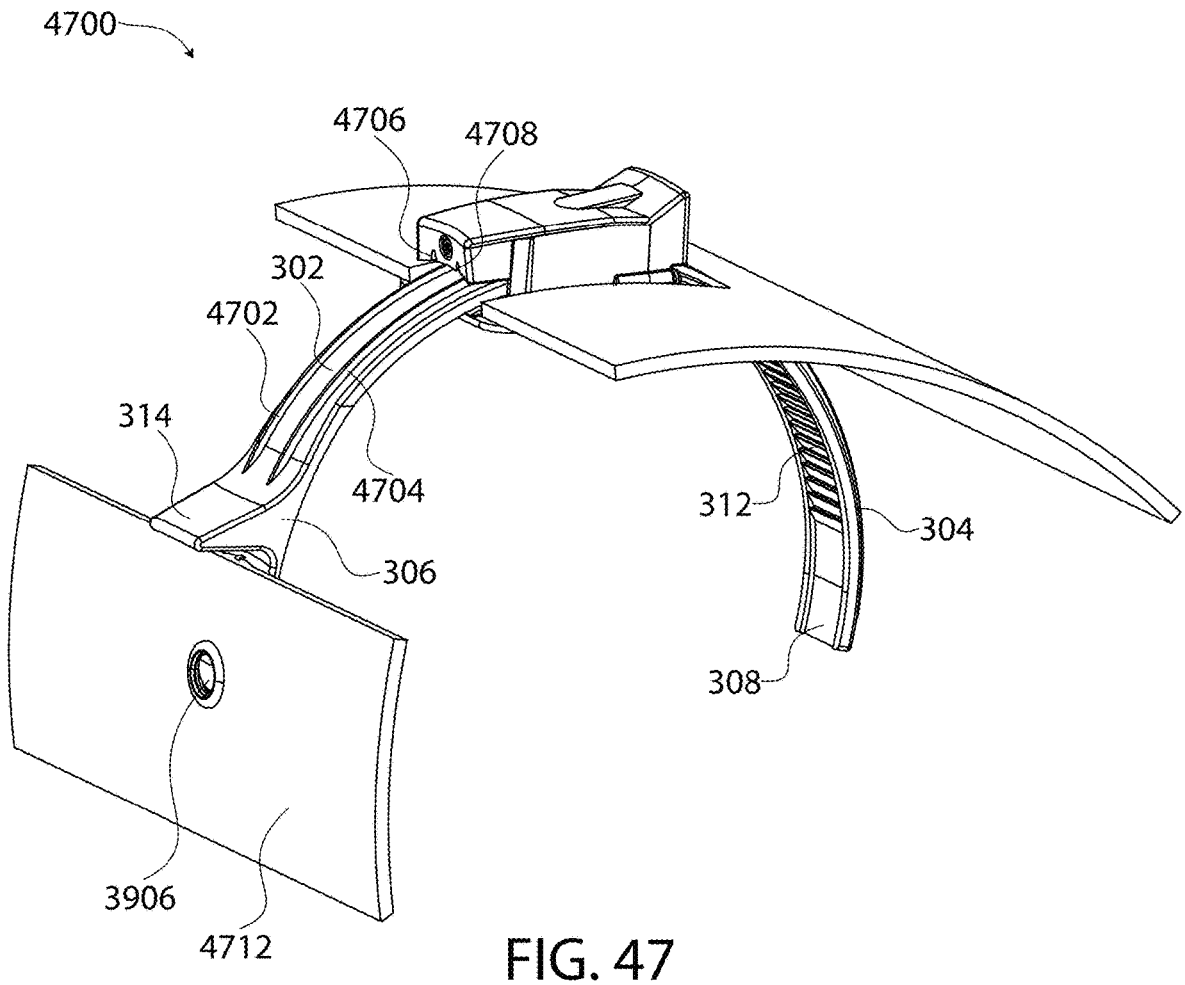
FIG. 47 illustrates a perspective view of an illustrative fastening system wherein a strap and a buckle assembly are fastened to an object (e.g., a shoe) and ribs are formed on the strap.

With reference to FIG. 47 illustrating a perspective view of a fastening system 4700, in accordance with an alternate configuration of the present disclosure, the fastening system 4700 may include the buckle assembly 200 and the strap 300 in a manner similar to their inclusion in the fastening system 100. Additionally, in this configuration, a first rib 4702 and a second rib 4704 may be formed on the front surface 302 of the strap 300. The first rib 4702 and the second rib 4704 may be configured to provide structural strength to the strap 300. Further, in such configurations, the buckle assembly 200 may include a first rib guideway 4706 and a second rib guideway 4708 that may slidingly engage the first rib 4702 and the second rib 4704, respectively. In particular, the first rib guideway 4706 and the second rib guideway 4708 may be formed in slider 700 of the buckle assembly 200. The first rib guideway 4706 may slidingly engage with the first rib 4702 to reduce friction therebetween. Similarly, the second rib guideway 4708 may slidingly engage with the second rib 4704 to reduce friction therebetween. Each of the first rib 4702 and the second rib 4704 may be formed parallel to the length of the strap 300. Further, the first rib guideway 4706 may be offset from the second rib guideway 4708 by a predefined gap distance.

Further, as shown in FIG. 47, the buckle assembly 200 of the fastening system 4700 may be fixedly attached to the object at a first location such as a webbing 4712 (similar to the webbing 104) of the object via one end of the buckle assembly 200. The buckle assembly 200 may be fixedly attached to the webbing 4712 via, for example, an adhesive joint, a clamp, a sewing joint, or by using a fastener like a clip, a screw, a nut-bolt assembly, etc. Similarly, the strap 300 or a webbing to which the strap 300 is attached may be fixedly attached to the object at a second location, for example, the webbing 4712.

Figure 48:
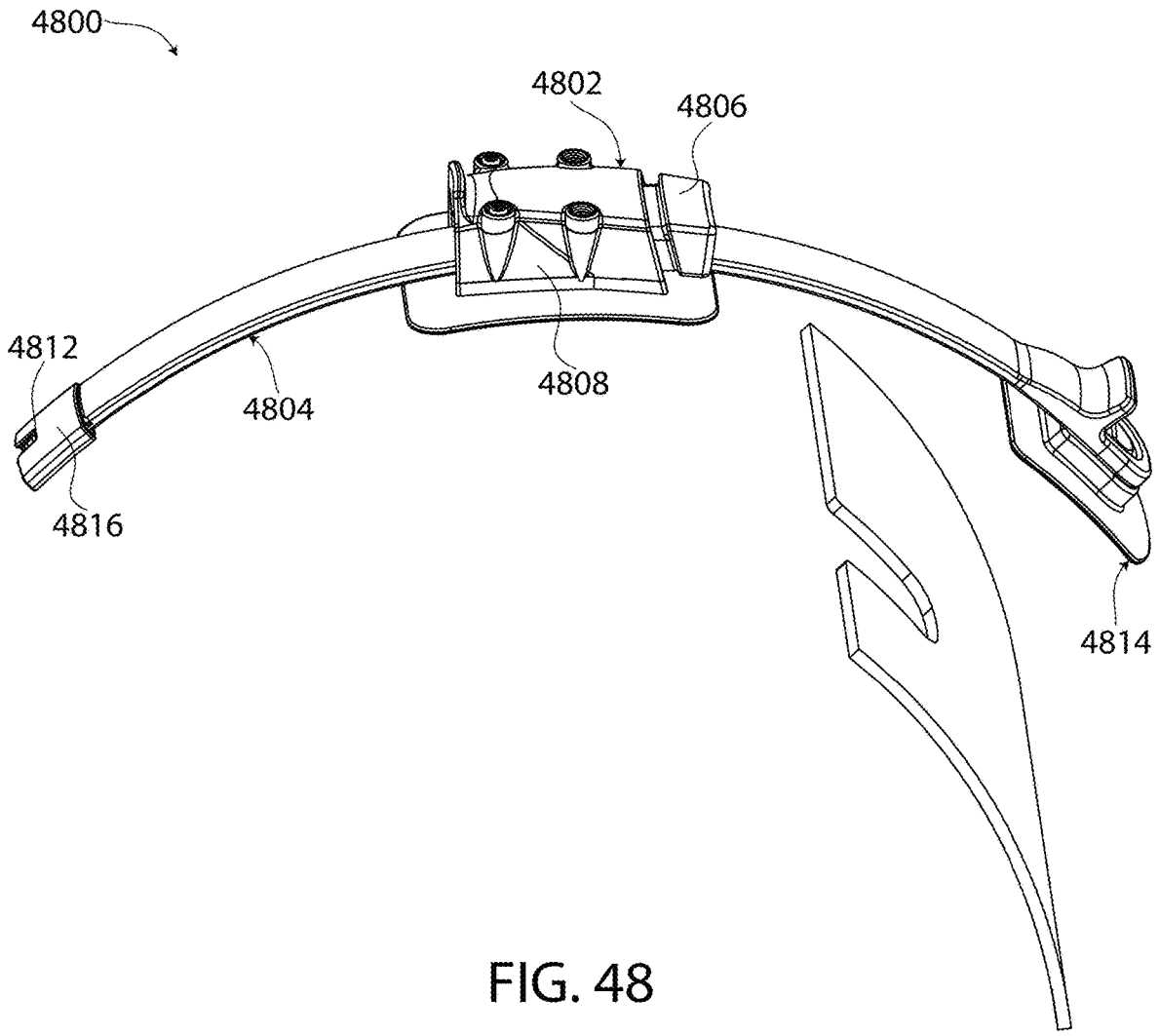
FIG. 48 illustrates a perspective view of an illustrative fastening system in which a removable portion of a base encloses components of a trigger configured as a slider, also illustrated are various interface components for a strap.

With reference to FIG. 48 illustrating a perspective top view of a fastening system 4800, in accordance with a yet another configuration of the present disclosure, the fastening system 4800 may include a buckle assembly 4802 (corresponding to the buckle assembly 200) and a strap 4804 (corresponding to the strap 300). The buckle assembly 4802 may be fixated on the contour of an object (e.g., the object 10). The buckle assembly 4802 may include a slider 4806 and a base 4808. In this configuration, the base 4808 may be formed as a hollow box-type structure. In this configuration, the base 4808 may enclose the slider 4806. The slider 4806 may be configured to slide into the hollow box-type structure of the base 4808, similar to a push-button mechanism. In the same configuration, the strap 4804 may further include a proximal end 4810 (refer FIG. 49) and a distal end 4812. The proximal end 4810 may be affixed to the object 10 or to a webbing (e.g., webbing 4712) via an anchor 4814. Additionally, a grip 4816 may be affixed to the distal end 4812. The grip 4816 may allow the strap 4804 to be easily inserted into the buckle assembly 4802. It should be noted that the fastening system 4800 illustrated herein may operate in an engaged condition and a released condition. The strap 4804 may also include an array of teeth (not shown in FIG. 48 but similar to the array of teeth 312 of FIG. 3) which may be configured to engage with a pawl (not shown in FIG. 48 but similar to the pawl 920 of FIG. 9) in the buckle assembly 4802. When the fastening system 4800 is configured from the engaged condition to the released condition, the slider 4806 may be pushed into the base 4808. This may cause the array of teeth of the strap 4804 to be released from the pawl (similar to the process 4600 of FIG. 46). As a result, the strap 4804 may move freely relative to the buckle assembly 4802.

Figure 49:
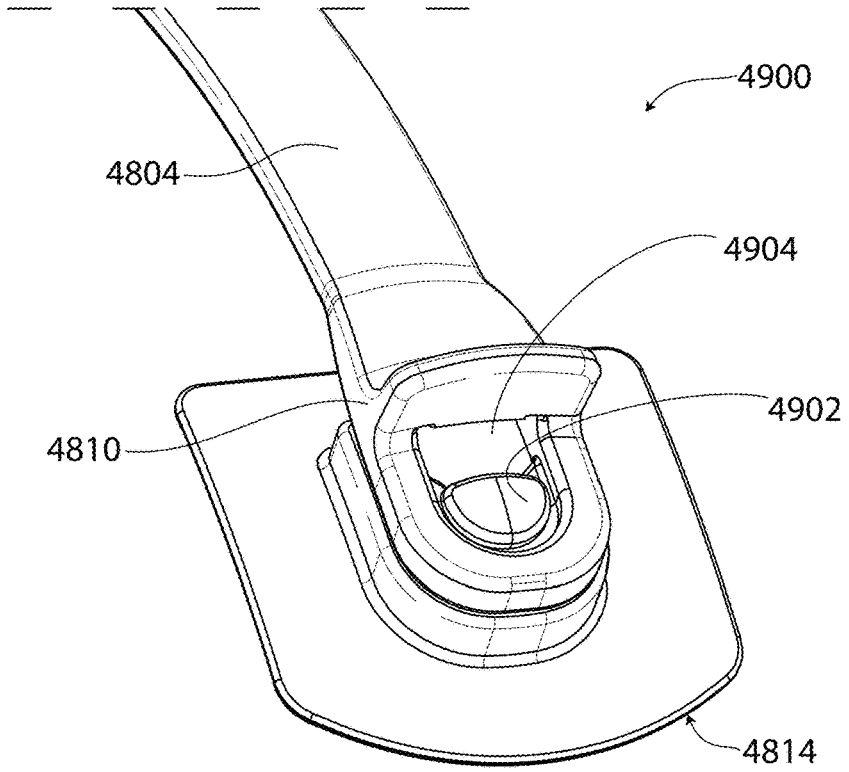
FIG. 49 illustrates a perspective view of a part of the fastening system of FIG. 48 (towards proximal end)

With reference to FIG. 49 illustrating a perspective view 4900 of a part of the fastening system 4800 (towards the proximal end 4810), the strap 4804 includes the anchor 4814 as previously shown in FIG. 48. The anchor 4814 may be fixed on the body of an object (e.g., the object 10) and may include an anchor pin 4902. Further, a semi-cylindrical groove 4904 may be formed on the proximal end 4810 of the strap 4804. In this configuration, to removably fix the strap 4804 on to the object, the semi-cylindrical groove 4904 may engage with the anchor pin 4902. In some configurations, to separate the strap 4804 from the object 10, the strap 4804 may be slid past one or more detents by a pulling force to disengage the semi-cylindrical groove 4904 from the anchor pin 4902.

Figure 50:
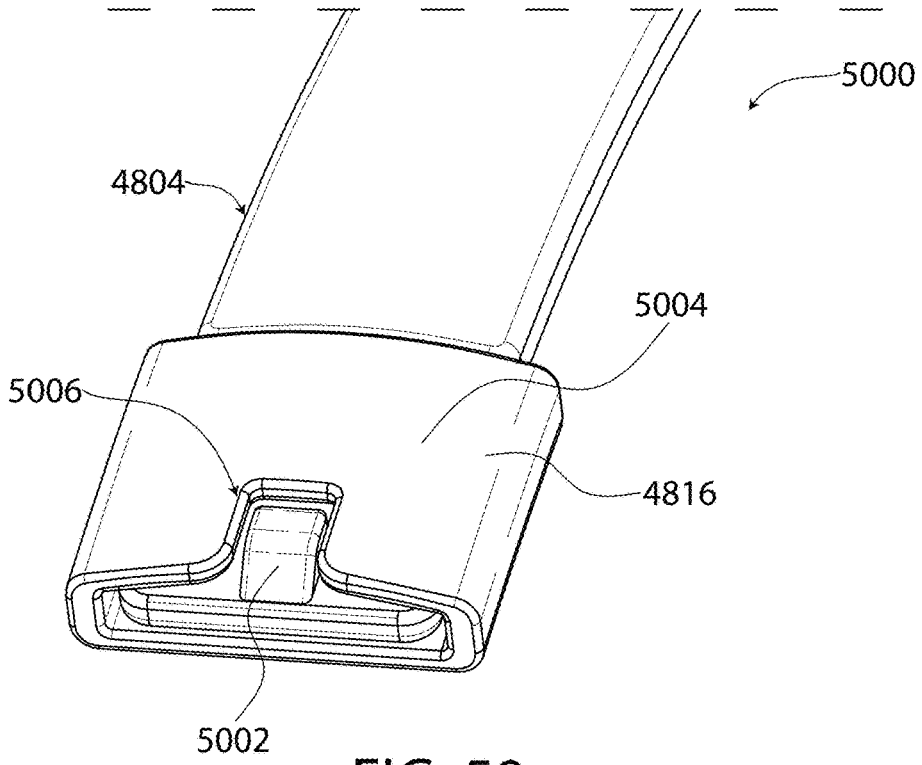
FIG. 50 illustrates a perspective view of another part of the fastening system of FIG. 48 (towards distal end)

With reference to FIG. 50 illustrating a perspective view 5000 of another part of the fastening system 4800 (towards the distal end 4812), the distal end 4812 of the strap 300 may be integrated with the grip 4816. The grip 4816 may be snap-fitted to the distal end 4812. The distal end 4812 may further include a stopper 5002. The grip 4816 may include a top surface 5004. Further, a U-shaped cut 5006 may be formed on the top surface 5004. As such, the U-shaped cut 5006 may be configured to engage with the stopper 5002 so that the grip 4816 may be affixed to the distal end 4812 of the strap 4804. When configured with the stopper 5002, the strap 300 and the buckle assembly (not shown) are always interfaced.

Figure 51:
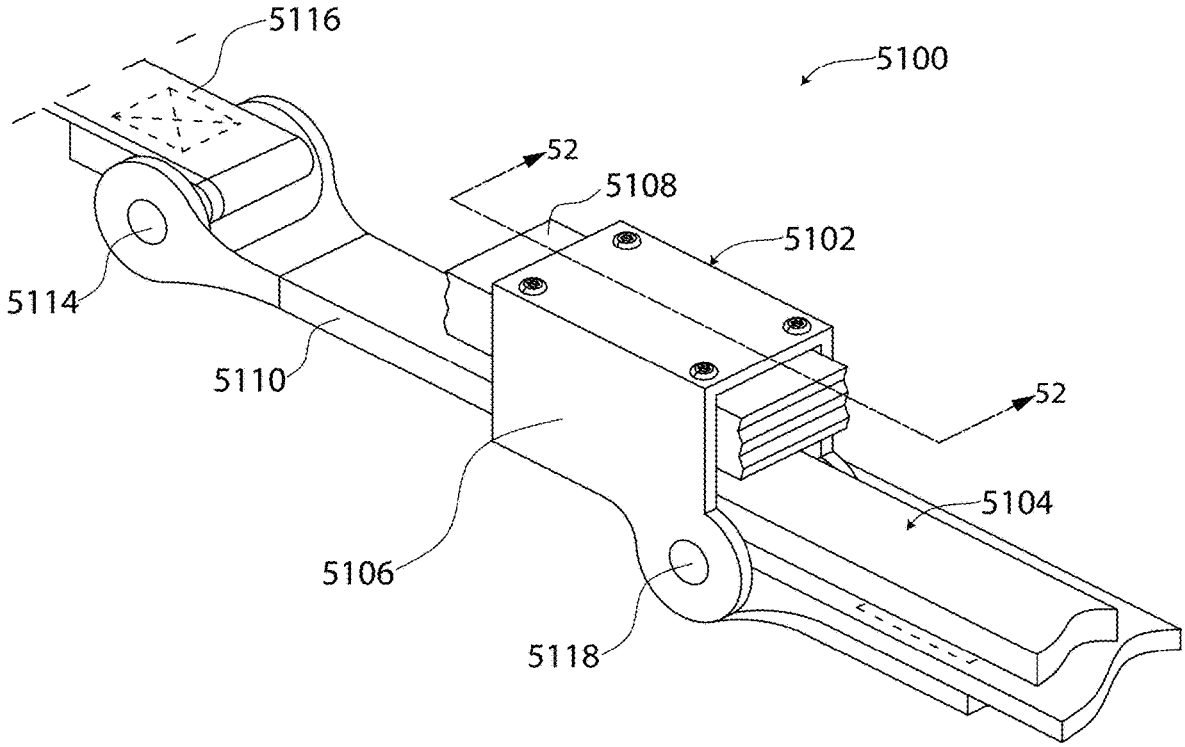
FIG. 51 illustrates a perspective view of an illustrative fastening system incorporating robust trigger and industrialized base.
Figure 52:
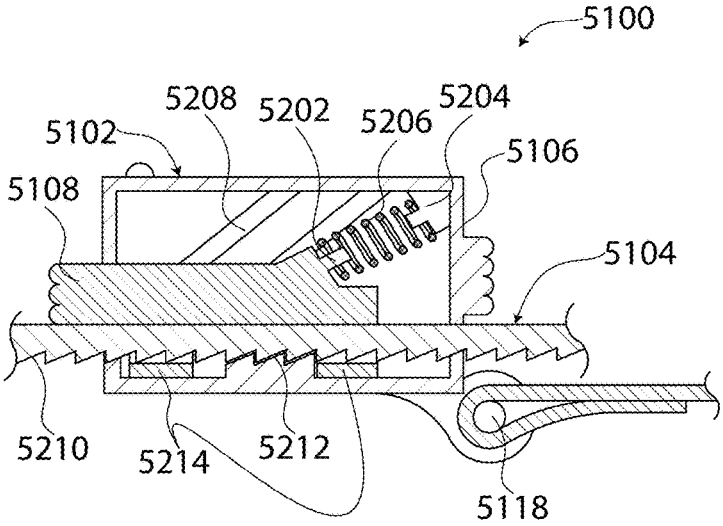
FIG. 52 illustrates a side cross-sectional view taken across a central plane of the fastening system of FIG. 51.

With reference to FIGS. 51-52 illustrating a perspective view and a side cross-sectional view, respectively, of a fastening system 5100 (corresponding to the fastening system 100), in accordance with some alternate configurations of the present disclosure, the fastening system 5100 may include the buckle assembly 5102 (similar to the buckle assembly 200) and the strap 5104 (similar to the strap 300). As seen, the buckle assembly 5102 may be formed as a box-type structure, which includes a base 5106 and a slider 5108. The buckle assembly 5102 allows the strap 5104 to pass therethrough. The strap 5104 may include a proximal end 5110, which may include an attachment mechanism such as a hinge mechanism through which a webbing 5116 (similar to the webbing 104) may be attached to the strap 5104. To this end, the proximal end 5110 may include a first pair of holes 5114 (similar to the first pair of holes 310 illustrated in FIG. 3) to attach the strap 5104 to an object or to the webbing 5116. Further, the buckle assembly 5102 may include a second pair of holes 5118 (similar to the second pair of holes 814, as illustrated in FIG. 8) to attach the buckle assembly 5102 to the object.

The fastening system 5100 may be configured to operate between an engaged condition and a released condition. In the engaged condition, the slider 5108 may be positioned at a first position. In the released condition, the slider 5108 may be pushed into the base 5106 to thereby disengage the strap 5104 from the buckle assembly 5102. The rest of the construction of the buckle assembly 5102 may be similar to that of the buckle assembly 200. As such, the buckle assembly 5102 may include the base 5106 with a pawl 5212 formed inside the hollow-box structure. In some configurations, lifter 5214 (similar to the trigger 850) may be formed into the slider 5108. The strap 5104 may pass through the buckle assembly 5102 via the lifter 5214. Further, the slider 5108 may include a first hold pin 5202 similar to the first hold locator 816 (refer FIG. 9). The base 5106 may further include a second hold pin 5204 similar to the second hold pin 1602 (refer FIG. 16). Between the first hold pin 5202 and the second hold pin 5204, a biasing member 5206 may be affixed which biases the slider 5108 relative to the base 5106. The base 5106 may further include a first ramp 5208 similar to the first ramp 910 and a second ramp (not shown in figure) similar to the second ramp 912. Accordingly, the slider 5108 may include a first guide and a second guide (not shown in figure). Similar to the mechanism described in previous configurations (refer FIG. 9), the first guide and the second guide may be configured to engage the first ramp 5208 and the second ramp, respectively.

It must be noted that the fastening system 5200 may operate in an engaged condition and in a released condition. In the engaged condition, the array of teeth 5210 of the lifter 5214 may engage with the pawl 5212 to enable a ratcheting mechanism. In the released condition, the user may be configured to manipulate the slider 5108 from the first position to the second position, the result of which is to enable the lifter 5214 to lift the strap 5104. The lifting of the strap 5104 may disengage the pawl 5212 and the array of teeth 5210, thereby enabling the strap 5104 to move freely relative to the buckle assembly 5102.

Figure 53:
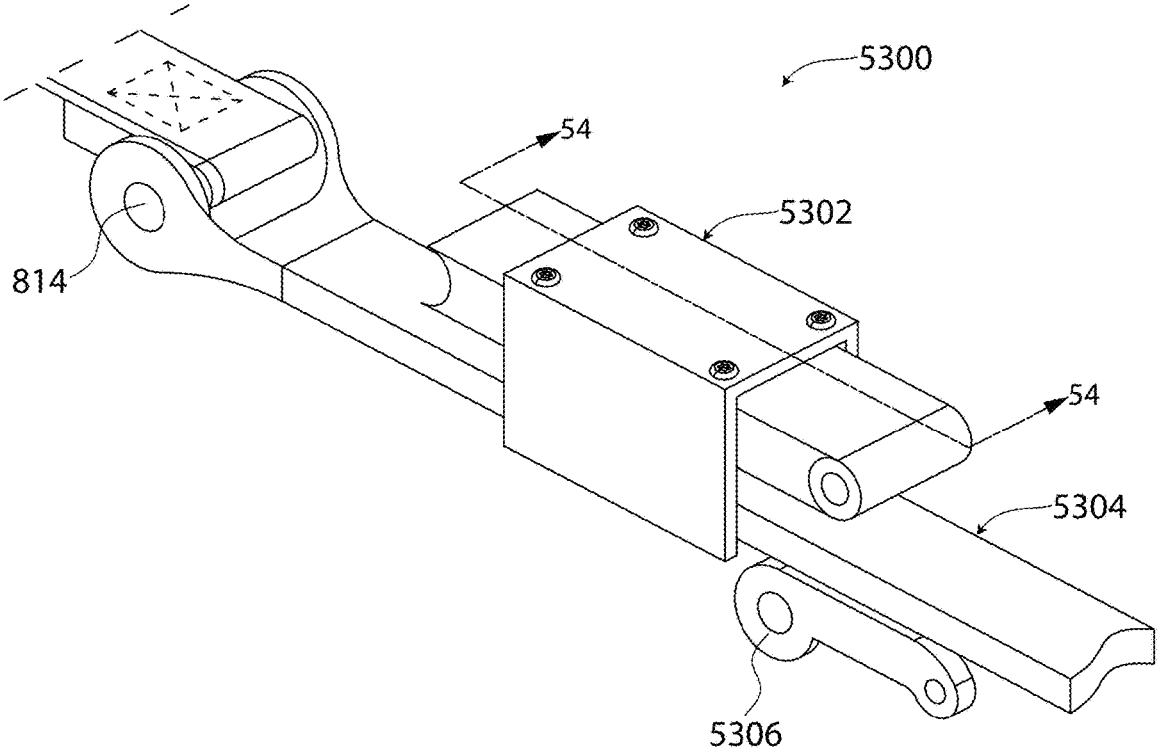
FIG. 53 illustrates a perspective view of an illustrative fastening system.
Figure 54:
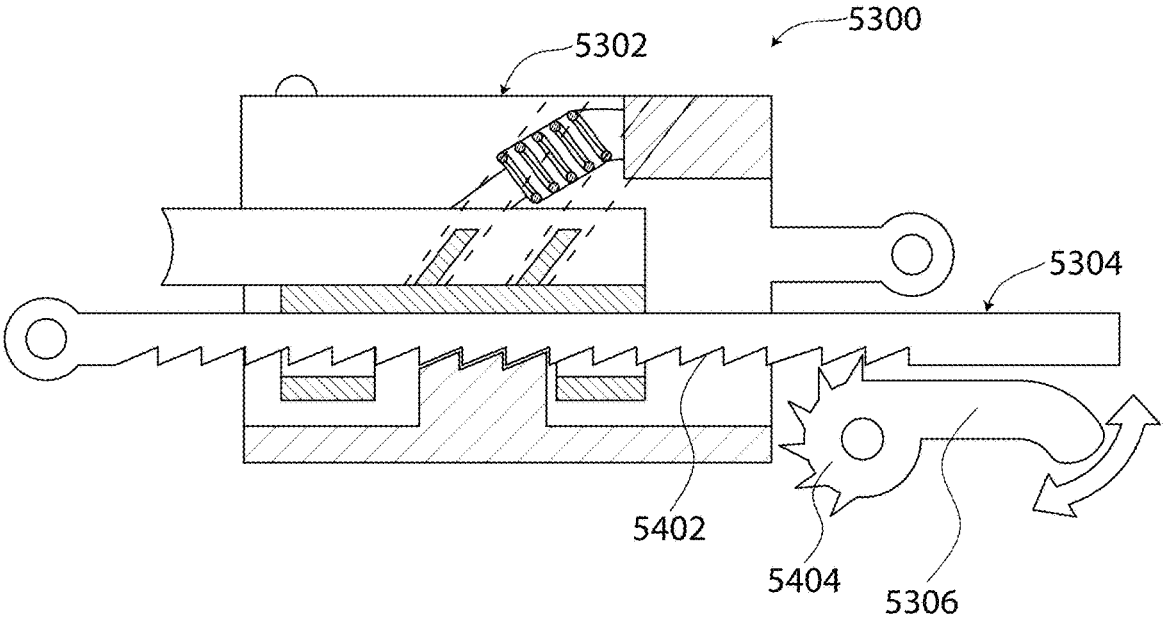
FIG. 54 illustrates a side cross-sectional view taken across a central plane of the fastening system of FIG. 53.

FIGS. 53-54 illustrate a perspective view and a side cross-sectional view, respectively, of a fastening system 5300 in accordance with some alternate configurations of the present disclosure. The fastening system 5300 includes the buckle assembly 5302 (similar to the buckle assembly 5102) and a strap 5304 (similar to the strap 5104). The fastening system 5300 may also include a tension helper lever 5306. The tension helper lever 5306 may be configured to engage with the strap 5304 and, in particular, with an array of teeth 5402 provided on the strap 5304. Further, the tension helper lever 5306 may be configured to induce an additional effect of pulling the strap 5304. The tension helper lever 5306 may include a set of teeth 5404 which may engage with the array of teeth 5402 of the strap 5304. Upon the set of teeth 5404 engaging with the array of teeth 5402, the tension helper lever 5306 may be rotated in a clockwise direction to pull the strap 5304 and create additional tension in the strap 5304.

Figure 55:
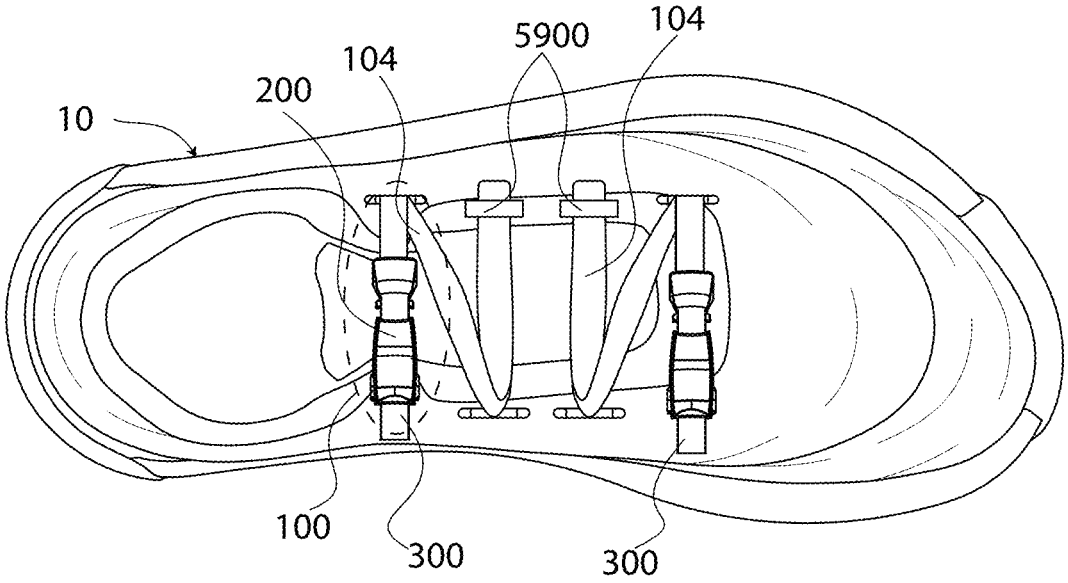
FIG. 55 illustrates a top view of an object equipped with two fastening systems interfaced with a pair of webbing and a pair of anchors.

FIG. 55 illustrates a top view of the object 10 (of FIG. 1) equipped with two fastening systems 100 (of FIG. 2) interfaced with a pair of webbings and a pair of anchors. In this configuration, two webbings 104 are provided on the object 10, and each of the two webbings 104 may be fixated to each of the two fastening systems 100, i.e., to the strap 300 of the respective fastening system 100. Further, for each of the two webbings 104, the anchor 5900 may be provided to fixate the webbing 104 on the object 10. Such configuration may allow multiple tightening positions on the object 10. As described here, length of the webbing 104 can be tuned according to the volume of a specific foot. To be clear, in some applications, a foot has a high volume and the webbing is used without being shortened. Alternatively, in a different application with a small volume foot, the webbing may be passed through the anchor 5900, cut (e.g. with a pair of scissors, knife, heat-knife, etc.), and if desired, sealed by application of heat to keep the webbing from unraveling.

Figure 56:
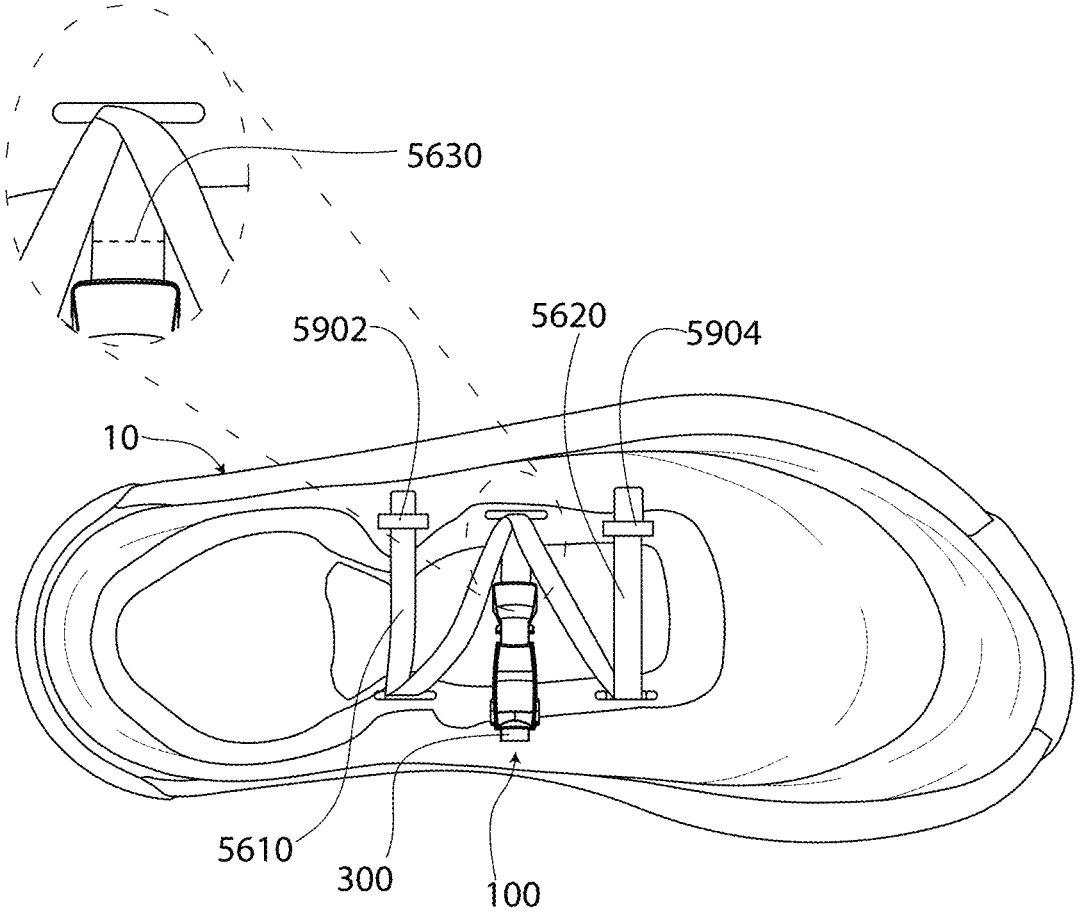
FIG. 56 illustrates a top view of an object equipped with a single fastening system with a pair of anchors and a pair of webbing.

FIG. 56 illustrates a top view of the object 10 equipped with a single fastening system 100 using a pair of anchors and a webbing in accordance with an alternative configuration of the present disclosure. In this configuration, the webbing may be folded and stitched in a way which produces sections of the webbing referenced as a first webbing 5610, a second webbing 5620. One end of the webbing may be fixated to the object 10 at a first position using the anchor 5902. One end of the second webbing 5620 may be fixated to the object 10 at a second position using a second anchor 5904. Ends of the first webbing 5610 and the second webbing 5620 may be configured as a loop created by, for example, a stitch 5630. When configured as illustrated, the second webbing 5620 that extends from the second anchor 5904 may be cut off to tune the volume of the footwear.

Figure 57:
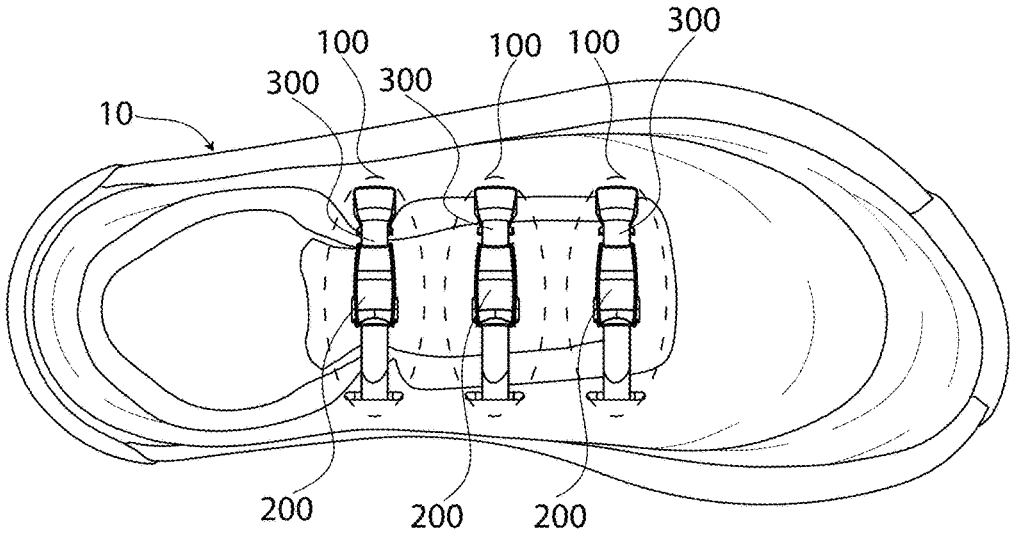
FIG. 57 illustrates a top view of an object equipped with three fastening systems.

FIG. 57 illustrates a top view of the object 10 equipped with three fastening systems 100 in accordance with some alternative configurations of the present disclosure. Such configuration achieves tightness on the object 10 without using any webbings to create a precise fitting system. In such a configuration, one end of the strap 300 of each of the three fastening systems 100 may be fixated on the object 10 at its respective position. Further, the buckle assembly 200 of each of the three fastening systems 100 may be fixated on its respective position on the object 10. Further, it should be noted that three fastening systems 100 may be aligned with and offset from each other. While the individual fastening systems 100 are shown with each strap 300 directed to the lateral side, in one configuration each of the fastening systems 100 could be rotated 180 degrees wherein the strap 300 is directed to the medial side.

Figure 58:
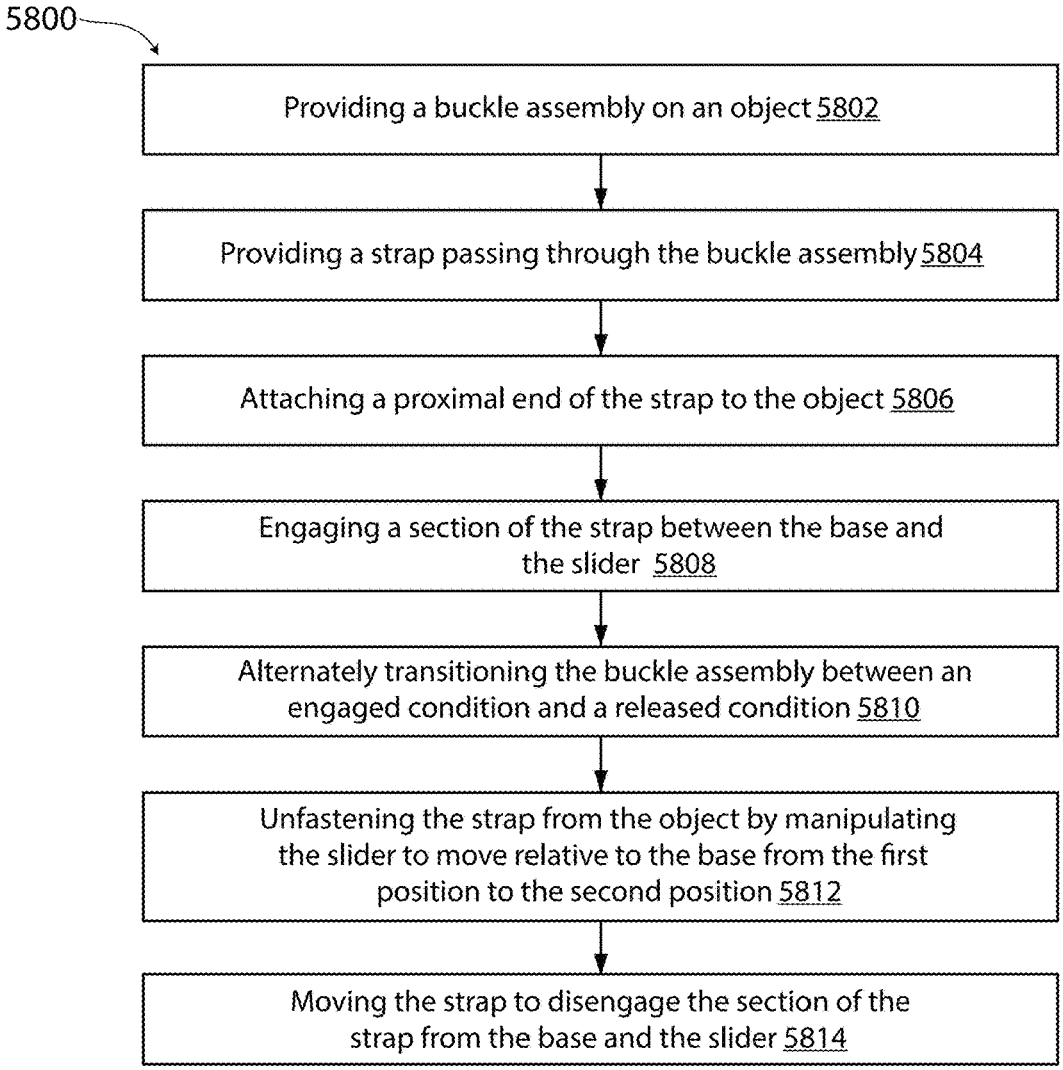
FIG. 58 illustrates a flow chart of a method of operating the fastening system.

FIG. 58 is a flow chart of a method 5800 of operating the fastening system 100. At step 5802, a buckle assembly 200 may be provided on the object 10. As mentioned above, the buckle assembly 200 may include the base 900 and the slider 700. The base 900 may include the top 918, which may further include the pawl 920. The pawl 920 may be formed on the top 918. The base 900 may further include the bottom 916, which may adjoin the object 10. The slider 700 may be slidingly engaged with the base 900 and may be configured to slide between the first position and the second position relative to the base 900. The buckle assembly 200 may further include a first wall 922 protruding from the top 918 of the base 900 and a second wall 924 protruding from the top 918 of the base 900 parallel to and offset from the first wall 922 by a width configured so that the strap 300 can slide therebetween. Further, a first ramp 910 may be formed on the first wall 922, and a second ramp 912 may be formed on the second wall 924. The slider 700 may slidingly engage with first ramp 910 and the second ramp 912. To this end, the first guide 706 of the slider 700 may be engaged with the first ramp 910 of the base 900. Similarly, the second guide 708 of the slider 700 may be engaged with the second ramp 912 of the base 900. The first guide 706 and the second guide 708 may align the slider 700 as the slider 700 travels between the first position and the second position. The buckle assembly 200 may include the biasing member 804 disposed between the slider 700 and the base 900. For example, the biasing member 804 may be a spring. The biasing member 804 may be configured so as to bias the slider 700 into the first position by default. As such, to move the slider 700 to the second position, the slider 700 has to be moved against the compression of the biasing member 804.

At step 5804, the strap 300 may be provided. The strap 300 may be attached to the object 10 directly or via the webbing 104. The strap 300 may include the front surface 302, the back surface 304, the proximal end 306, and distal end 308. The front surface 302 and the back surface 304 may be disposed between the proximal end 306 and the distal end 308. Further, the front surface 302 may be parallel to and offset from the back surface 304. The back surface 304 may include the array of teeth 312. An engaged section of the strap 300 may be located between the base 900 and the slider 700. In some configurations, the strap 300 may include the first rib 4702 formed on the front surface 302 or indicia (e.g. text or logo) formed on the front surface 302. It should be noted that the rib may be a protruding formation and the indicia may be a groove formed in the strap. Correspondingly, the slider 700 may include the first rib guideway 4706 formed thereon and configured to slidingly engage with the first rib 4702 of the strap 300 to reduce friction therebetween. In a similar way, the strap 300 may further include the second rib 4704 formed on the front surface 302 (or another indicia formed on the front surface 302) parallel to and offset from the first rib 4702. The slider 700 may further include the second rib guideway 4708 formed thereon and configured to slidingly engage with the second rib 4704 of the strap 300 to reduce friction therebetween. As will be understood, in case of indicia provided on the strap, each of the first rib guideway 4706 and the second rib guideway 4708 may be in the form of a protrusion that engages with the groove of the indicia. The first rib 4702 may pass through the first rib guideway 4706, and the second rib 4704 may pass through the second rib guideway 4708. In some configurations, the buckle assembly 200 may be be formed with the first radius of curvature R1. Further, the strap 300 may be formed with the second radius of curvature R2. The second radius of curvature R2 may be smaller than the first radius of curvature R1 as explained above. Further, in some configurations, the stop 314 may be formed along the strap 300. The stop 314 may be configured to block movement of the strap 300 relative to the buckle assembly 200.

With continued reference to FIG. 58, at step 5806, the proximal end 306 of the strap 300 may be attached to the object 10. In order to attach the strap 300 to the object 10, an engaging mechanism may be formed between the proximal end 306 of the strap 300 and the object 10. The engaging mechanism may be configured to attach the proximal end 306 of the strap to the object 10.

At step 5808, a section of the strap 300 may be engaged between the base 900 and the slider 700. To this end, the trigger 850 may be disposed adjacent to the slider 700. The trigger 850 may be either fastened to the slider 700 or formed into the slider 700. Thereafter, the strap 300 may be guided into the lifter 852 of the trigger 850 and the channel 1302 between the base 900 and the slider 700 to engage the strap 300 with the buckle assembly 200. The trigger 850 through the lifter 852 may lift the strap 300 to separate the pawl 920 and the array of teeth 312 when the slider 700 moves from the first position to the second position.

At step 5810, the fastening system 100 may be alternately transitioned between an engaged condition and a released condition. In the engaged condition, the slider 700 may be positioned at a first position and may be offset from the top 918 of the base 900 by a first distance. In the released condition, the slider 700 may be positioned at a second position and may be offset from the top of the base 900 by a second distance. The second distance may be greater than the first distance. As such, in the released condition, the strap 300 may be free to move relative to the buckle assembly 200.

At step 5812, the strap 300 may be unfastened from the object 10 by manipulating the slider 700 to move it relative to the base 900 from the first position to the second position. When the slider 700 is moved to the second position, the slider 700 may be offset from the top of the base 900 by the second distance, thereby releasing the strap 300. The base 900 of the buckle assembly 200 includes the stopper 2402. The stopper 2402 may be disposed at the distal end of the base 900 with a pathway thereby formed between the stopper 2402, the first wall 922, and the second wall 924. The movement of the trigger 850 may be confined to the pathway.

As represented in FIG. 28, at step 5814, once the strap 300 is released from the buckle assembly 200, the strap 300 may be moved to disengage the engaged section of the strap 300 from the base 900 and the slider 700. The fastening system 100 further includes the first radius of curvature R1 defined by the buckle assembly 200 and the second radius of curvature R2 associated with the strap 300. The second radius of curvature R2 is smaller than the first radius of curvature R1. Due to the above difference of radiuses of curvature, the strap 300, by default, is biased to be positioned away from the top 918 of the base 900. Therefore, when the buckle assembly 200 is configured in the released configuration, the curvature 3904 of the strap 300 may cause the array of teeth 312 of the strap 300 to automatically disengage from the pawl 920 provided on the top 918 of the buckle assembly 200.

Additionally, in some configurations, the method 5800 may further include engaging the pawl 920 with the array of teeth 312. The engaged condition may be obtained by manually applying forces to the slider 700 and the strap 300 such that the strap 300 covers a first stroke distance. It should be noted that the first stroke distance may be the minimum distance by which the strap 300 needs to be moved relative to the buckle assembly 200 in order to engage the strap 300 with the buckle assembly 200. In other words, the first stroke distance may be the minimum distance by which the stop 314 of the strap 300 may be moved relative to the buckle assembly 200 to change from a position in which the strap 300 may be disengaged from the buckle assembly 200 to a position in which the engaged section (located between the base 900 and the slider 700) of the strap 300 is wholly engaged with the pawl 920 of the buckle assembly 200. The method may include disengaging the pawl 920 from the array of teeth 312. To this end, a user may manually apply a pinching action to the slider 700 such that the slider 700 covers a second stroke distance or a sliding distance to obtain the released condition. The second stroke distance or the sliding distance is distance by which the first digital surface 702 of the buckle assembly 200 is displaced (under the effect of the pinching action manually applied by the user) to completely release the strap from the buckle assembly 200. In the released condition, the strap 300 may be free-to move relative to the buckle assembly 200.

With reference to FIG. 59A illustrating a top perspective view of a configuration of an anchor 5900 provided for attaching webbing to an object (e.g., footwear as shown in FIG. 1 as the anchor 5900, 5900), the anchor 5900 includes a base 5910 and a cam 5950. The base 5910 may include a left protrusion 5912 and a parallel/offset second protrusion 5914. A left hole 5916 (FIG. 61) may be formed in the left protrusion 5912. A right hole 5918 may be formed in the right protrusion 5914. FIG. 59B illustrates an exploded view of the illustrative anchor 5900 of FIG. 59A.

With reference to FIG. 60 illustrating a top perspective view of the anchor 5900, the base 5910 of the anchor 5900 may be configured with a skirt 5920 for attaching the anchor 5900 to an object, for example by stitching through the object and the skirt 5920 to fixedly attach the anchor 5900 to the object. Other examples of attaching include integral molding (e.g., injection molding), adhesive, riveting, etc. The left protrusion 5912 may be formed with a left detent 5922, and the offset second protrusion 5914 may be formed with a right detent 5924.

With continued reference to FIG. 60, the cam 5950 may be provided with a left pivot 5952 and a right pivot 5954 that are coaxial and serve as an axis of rotation for the cam 5950. The rotation of the cam 5950 is confined and in some cases removably held by the left detent 5922 and the right detent 5924.

Figure 61:
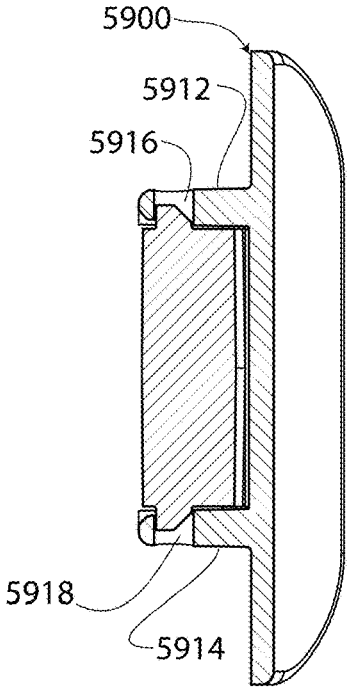
FIG. 61 illustrates a cross-sectional view of the anchor of FIGS. 59A and 59B taken across plane 61-61 (FIG. 60)

With reference to FIG. 61 illustrating a cross-sectional view of the anchor 5900 of FIG. 60 taken across plane 61-61 (FIG. 60), the cam 5950 and the base 5910 form a small gap through which webbing (not shown) is positioned. The webbing is trapped between the cam 5950 and the base 5910.

With reference to FIGS. 62A,B,C illustrating a cross-sectional view of the anchor 5900 of FIG. 60 taken across plane 62-62 (FIG. 60), the base 5910 may be provided with a detent 5930 formed in the base 5910. If provided with the detent 5930, the profile is cordial to the axis of rotation defined by the left hole 5916, the offset second protrusion 5914, the left pivot 5952, and the right pivot 5954. The base 5910 may be provided with a terminal edge 5932. The terminal edge 5932 may improve the holding force of the webbing. The cam 5950 may be provided with a simple clamping face 5960 with a fixed diameter (about the axis of rotation), or it may be formed with at least one tooth (e.g., the illustrated plurality of teeth 5962). The teeth 5962 may have peaks that are separated by a tooth distance that is informed by a separation distance between ribs in a webbing. As illustrated in FIG. 62A, the cam 5950 rotates relative to the base 5910 to provide access so webbing can be installed therein. When the cam 5950 is rotated to a closed position, the webbing is trapped between the cam 5950 and the base 5910. As illustrated in in FIG. 62C, excess (i.e., unused section) of the webbing may be cut-off as illustrated by scissors. Due to the features of the anchor 5900, specifically the terminal edge 5932 and the teeth 5962, tension in the webbing causes a self-closing anchor 5900.

With reference to FIG. 63 illustrating a bottom perspective of an illustrative buckle assembly 6300 configured with an integrally-formed webbing interface 6310 in the base 6302 of the buckle assembly 6300, the integrally-formed webbing interface 6310 provides an attachment point for a fold or loop of webbing (not shown) rather than the previously described pin. The integrally-formed webbing interface 6310 may be a solid bar receiving webbing looped thereover, or it can be configured with a gap 6312 as illustrated. The gap 6312, if provided, enables a previously formed loop (e.g., stitched, woven, folded, etc.) to be passed through the gap and attached to the illustrative buckle assembly 6300.

With reference to FIG. 64 illustrating a bottom view of the buckle assembly of FIG. 63, the integrally-formed webbing interface 6310 may be configured with any configuration of gap 6312. In one configuration, the gap 6312 is formed with an angle to help direct the webbing as it is passed through the gap 6312. In one configuration, the gap 6312 is formed with an angle 6314 that is greater than zero, for example 45 degrees+/−40 degrees, or in one configuration, 35 degrees+/−10 degrees. This gap 6312 with an angle 6314 greatly improves serviceability of the fastening system because components can be upgraded and/or changed by the user.

With reference to FIG. 65 illustrating a bottom view of an illustrative strap 6500 configured with a gap 6510, the specific geometry of the gap 6510 may mirror the angle 6314 of the gap 6312 (FIG. 64 for the illustrative buckle assembly 6300).

With reference to FIG. 66 illustrating a top view of one configuration of webbing 6600, the webbing 6600 may be configured with front-side indicia 6602, 6604, or 6606 (FIG. 68) or friction-modifying pads 6610, 6612 (FIG. 68) or 6614 (FIG. 68). When folded or routed over an object, a front side and a back side of the webbing 6600 may be shown. Additionally, some portions of the webbing 6600 may be subjected to rings that may impart friction. Therefore, in some instances, the front side of the webbing 6600 may be provided with front-side indicia 6602, friction-modifying pads 6610, or front-side indicia 6604 depending on the number of rings. In some instances, the friction-modifying pad may be printed out of a plastic such as polyethylene, thermoset rubber, thermoplastic rubber, urethane, thermoset ink with glass spheres suspended therein, etc.

With reference to FIG. 67 illustrating a side view of the webbing of FIG. 66, the webbing 6600 may be made of material having a plurality of ribs 6620 formed by weft yarns with a uniform separation distance referred to herein as a rib separation distance 6622. The rib separation distance 6622 is a result of the production method of the webbing 6600. As illustrated in FIG. 67, the friction-modifying pads 6610 may be aligned with the indicia (e.g., 6602, 6604, 6606).

With reference to FIG. 68 illustrating a bottom view of the webbing 6600 of FIG. 66 illustrating back-side indica 6606 and a pair of friction-modifying pads 6612, 6614, the flexible webbing may have indicia and friction-modifying pads applied during manufacturing or in a post-production step. In one configuration, these features may be applied via roll-to-roll inline processing or piece-by-piece processing (e.g., pad printing).

With reference to FIG. 69 illustrating a top view of a webbing 6900 (similar to webbing 6600, FIG. 66) configured with indicia 6602, 6606 and friction-modifying pads 6610, 6612, the webbing 6600 may interface with a plurality of rings 6910, 6912, 6914 for purposes best illustrated in, for example, FIGS. 1, 2, 55 and 56.

With reference to FIGS. 70-77, an ornamental appearance of an illustrative fastening system may include features as illustrated, or it may have various features omitted. For example, the plurality of teeth may be reduced or increased, the surface having the plurality of teeth may be modified, the fasteners may be configured as clips, etc.

With reference to FIGS. 78-85, an ornamental appearance of an illustrative buckle assembly may include features as illustrated, or it may have various features omitted. For example, the plurality of teeth may be reduced or increased, the surface having the plurality of teeth may be modified, the fasteners may be configured as clips, etc.

With reference to FIGS. 86-93, an ornamental appearance of an illustrative strap may include features as illustrated, or it may have various features omitted. For example, the plurality of teeth may be reduced or increased, the surface having the plurality of teeth may be modified, the fasteners may be configured as clips, etc.

With reference to FIGS. 94-101, an ornamental appearance of an illustrative strap may include features as illustrated, or it may have various features omitted. For example, the plurality of teeth may be reduced or increased, the surface having the plurality of teeth may be modified, the fasteners may be configured as clips, etc.

With reference to FIG. 102A illustrating an embodiment of an anchor 10200 in an open condition and configured with additional features described herein. FIG. 102A illustrates the anchor 10200 in a perspective view for attaching webbing to an object (e.g., footwear). The anchor 10200 includes a base 10210 and a cam 10212. The base 10210 and the cam 10212 may, in one configuration, be similar to the anchor 5900 and cam 5950, respectively (FIGS. 59A/B to 62A/B/C) with additional features such as a first protrusion 10214, a second protrusion 10216, a first receptacle 10218, and a second receptacle 10220.

With continued reference to FIG. 102A, the cam 10212 is hinged to enable webbing (not shown) to pass between the base 10210 and the cam 10212. Since the first protrusion 10214 and second protrusion 10216 impact the webbing, they introduce holes in the webbing to improve holding force of the anchor 10200.

With reference to FIG. 102B illustrating the anchor 10200 in a closed condition, the webbing (not shown) is pierced by the first protrusion 10214 and the second protrusion 10216. The first protrusion 10214 engages with the first receptacle 10218. In a similar manner the second protrusion 10216 engages with the second receptacle 10220.

With reference to FIG. 103 illustrating a bottom perspective view of the anchor 10200, the base 10210 of the anchor 10200 may be configured with a skirt 10230 for attaching the anchor 10200 to an object, for example by stitching through the object and the skirt 10230 to fixedly attach the anchor 10200 to the object. As illustrated, the second receptacle 10220 may be formed through the entire body of the base 10210. The first receptacle 10218 may be similar formed. This may, for example, enable injection molding requirements to be met or provide a chute for any broken material from the webbing to clear through the hole. In a similar regard, the thruhole configuration of the receptacles 10218, 10220 may clear dirt and debris from the area to enable full actuation.

With reference to FIG. 104 illustrating a front view of the anchor 10200, the anchor 10200 may be provided with the first protrusion 10214 configured with a first spike 10234. In a similar regard, the second protrusion 10216 may be configured with a second spike 10236. The first and second spikes 10234, 10236 further aid the ability to pierce through the webbing when moving from the open condition (FIG. 102A) to the closed condition (102B).

With reference to FIG. 105 illustrating a side view of the anchor 10200, the cam 10212 rotates relative to the base 10210.

With reference to FIG. 106A taken across plane 106A/B (FIG. 103), the anchor 10200 first protrusion first protrusion 10214 is configured w/r/t the geometry of the first receptacle 10218 to pass through the webbing and into the first receptacle 10218.

With reference to FIG. 106B, the anchor 10200 is illustrated in the closed condition across a sectional plane illustrated by plane 106A/B in FIG. 103.

Clause 1. A fastening system for a wearable, the fastening system comprising: a buckle assembly comprising: a base comprising: a bottom adjoining the wearable; a top oppositely disposed from the bottom; and a pawl formed on the top; a slider slidingly engaged with the base between a first position and a second position; a strap comprising: a proximal end configured to attach to the wearable; a distal end oppositely disposed from the proximal end; a front surface disposed between the proximal end and the distal end; a back surface parallel to and offset from the front surface; and an array of teeth formed on the back surface, wherein the array of teeth comprise: a portion of the array of teeth is adjacent to the wearable; and an engaged section located between the proximal end and the distal end; an engaged condition wherein: the slider is positioned at the first position; the slider is offset from the top of the base by a first distance; and the pawl is adjoining the array of teeth; a released condition wherein: the slider is positioned at the second position; the slider is offset from the top of the base by a second distance that is greater than the first distance; and the strap is free-to-move relative to the buckle assembly.

Clause 2. The fastening system of clause 1, the base further comprising: a first wall protruding from the top of the base; a second wall protruding from the top, wherein the second wall is parallel-to and offset-from the first wall, and wherein the second wall is separated from the first wall by a distance that is greater than a width of the strap; a first ramp formed on the first wall; and a second ramp formed on the second wall, wherein the slider slidingly engages with first ramp and the second ramp.

Clause 3. The fastening system of clause 2, the slider further comprising: a first guide slidingly engaged with the first ramp of the base; and a second guide slidingly engaged with the second ramp of the base, wherein the first guide and the second guide align with the slider at the first position, the second position, and therebetween.

Clause 4. The fastening system of clause 2, the buckle assembly further comprising: a lifter adjoining the slider, and wherein the lifter is one of: fastened to the slider, or formed on the slider.

Clause 5. The fastening system of clause 4, wherein the lifter is further configured to: separate the array of teeth of the strap from the pawl of the base when the slider moves from the first position to the second position.

Clause 6. The fastening system of clause 1, the buckle assembly comprising: a stopper formed on the base; and a pathway formed between the stopper and each of the first wall and the second wall configured to slidingly engage the slider, wherein movement of the slider is confined relative to the base by the stopper Clause 7. The fastening system of clause 1, and further comprising: a first rib formed on the front surface of the strap, and a first rib guideway formed in the slider, wherein the first rib guideway slidingly engages with the first rib of the strap to reduce friction therebetween.

Clause 8. The fastening system of clause 1, the strap further comprising: an engaging mechanism formed between the proximal end of the strap and the wearable, wherein the engaging mechanism is configured to disengage the strap from the wearable.

Clause 9. The fastening system of clause 1, the strap further comprising: a stop formed along the strap, wherein the stop is configured to block movement of the strap relative to the buckle assembly.

Clause 10. The fastening system of clause 1, the buckle assembly further comprising: a biasing member disposed between the slider and the base.

Clause 11. The fastening system of clause 10, the buckle assembly further comprising: a cap adjoining the biasing member, wherein the cap is one of: fastened to the base, or formed into the base.

Clause 12. The fastening system of clause 1, the fastening system further comprising: a first radius of curvature defined by the buckle assembly; and a second radius of curvature wherein the strap is formed with, wherein the second radius of curvature that is smaller than the first radius of curvature.

Clause 13. The fastening system of clause 1, wherein the strap further comprises: at least one protrusion disposed on the strap, wherein the at least one protrusion is configured to receive force from a digit of a user.

Clause 14. The fastening system of clause 1, wherein each of the array of teeth comprises: a slope; a flank; a peak defined at an intersection of the slope and the flank of each of the array of teeth; and a root defined at an intersection of the slope and the flank of two respective adjacent teeth of the array of teeth, wherein the slope is inclined to a tangential line through the root, at a first angle, and wherein the flank is inclined to the tangential line through the root, at a second angle.

Clause 15. A method of operating a fastening system, the method comprising: providing a buckle assembly on an object, the buckle assembly comprising: a base, comprising: a top, comprising: a pawl formed on the top; and a bottom adjoining the object, wherein the bottom is oppositely disposed from the top; and a slider slidingly engaged with the base, and movable between a first position and a second position; providing a strap, comprising: a proximal end attached to the object; and a distal end oppositely disposed from the proximal end; a front surface between the proximal end and the distal end; a back surface parallel to, and offset from, the front surface; and an array of teeth formed on the back surface, wherein a portion of the array of teeth is adjacent to the object, wherein an engaged section of the strap is located between the base and the slider; positioning a section of the strap between the base and the slider; transitioning, alternately, the buckle assembly between: an engaged condition, wherein the slider is positioned at the first position, the slider is offset from the top of the base by a first distance; and the pawl is adjoining the array of teeth; a released condition, wherein the slider is positioned at the second position, the slider is offset from the top of the base by a second distance that is greater than the first distance, and the strap is free-to-move relative to the buckle assembly; tensioning the strap by moving the strap relative to the buckle assembly; and sliding the slider, relative to the base, from the first position to the second position where the slider is offset from the top of the base by the second distance and the array of teeth of the strap are disengaged from the pawl.

Clause 16. The method of clause 15 and further comprising: disengaging the strap from the buckle assembly while the slider is at the second position.

Clause 17. The method of clause 15 and further comprising: engaging the pawl with a portion of the array of teeth by biasing the slider to obtain the engaged condition; and disengaging the pawl from the array of teeth by manually applying a force to the slider to obtain the released condition.

Clause 18. The method of clause 15, wherein providing the buckle assembly further comprises: a first wall protruding from the top of the base; a second wall protruding from the top of the base, wherein the second wall is parallel-to and offset-from the first wall by a width greater than the strap; a first ramp formed on the first wall; and a second ramp formed on the second wall, wherein the slider slidingly engages with first ramp and the second ramp.

Clause 19. The method of clause 18 and further comprising: providing the buckle assembly further comprises providing: a first guide formed on the slider; and a second guide formed on the slider; engaging, slidingly, the first guide with the first ramp of the base; and engaging, slidingly, the second guide with the second ramp of the base, wherein the first guide and the second guide align the slider is located: at first position, at the second position, or any position therebetween.

Clause 20. The method of clause 15 and further comprising: providing the strap further comprises providing: a first rib formed on the front surface, or an indicia formed on the front surface.

Clause 21. The method of clause 15 and further comprising: providing the strap further comprises providing: an engaging mechanism formed between the proximal end of the strap and the object, the engaging mechanism configured to attach the proximal end of the strap to the object; and removing the proximal end of the strap from the engaging mechanism.

Clause 22. The method of clause 15 and further comprising: providing the strap further comprises providing: a stop formed along the strap, the stop configured to block movement of the strap relative to the buckle assembly; and limiting movement of the strap relative to the buckle assembly by contacting the stop with the buckle assembly.

Clause 23. The method of clause 18 and further comprising: providing the buckle assembly further comprises providing: a biasing member disposed between the slider and the base; and compressing the biasing member with movement of the slider relative to the base.

Clause 24. The method of clause 15 and further comprising: providing the buckle assembly further comprises: a lifter adjacent to the slider, and wherein the lifter is one of: fastened to the slider, or formed into the slider; and lifting the strap relative to the base with the lifter to separate the pawl from the array of teeth when the slider moves from the first position to the second position.

Clause 25. The method of clause 16 and further comprising: providing the buckle assembly further comprises: a first radius of curvature defined by the buckle assembly; and a second radius of curvature defined by the strap that is smaller than the first radius of curvature; and biasing the distal end of the strap to the object according to a difference between the first radius of curvature and the second radius of curvature.

Clause 26. The method of clause 16 and further comprising: providing the strap further comprises: at least one protrusion disposed on the strap, wherein the at least one protrusion is configured to restrict movement of the strap relative to the buckle assembly, beyond the at least one protrusion; and blocking movement of the strap relative to the buckle assembly with the at least one protrusion.

Clause 27. A method of operating a fastening system for an object, the method comprising: providing a buckle assembly comprising: a base, comprising: a bottom adjoining the object; a top oppositely disposed from the bottom; and a pawl formed on the top; a slider movable between a first position and a second position; providing a strap comprising: a proximal end attached to the object; a distal end oppositely disposed from the proximal end; a front surface between the proximal end and the distal end; a back surface parallel to, and offset from, the front surface; and an array of teeth formed on the back surface, wherein the array of teeth is adjacent to the object, the array of teeth comprising: an engaged section of the strap located between the base and the slider; transitioning, alternatively, the buckle assembly between: an engaged condition wherein: the slider is positioned at the first position; the slider is offset from the top of the base by a first distance; and the pawl is adjoining the array of teeth; a released condition wherein: the slider is positioned at the second position; the slider is offset from the top of the base by a second distance that is greater than the first distance; and the strap is free-to-move relative to the buckle assembly.

Clause 28. A fastening system, comprising: a buckle assembly; and a strap passing through the buckle assembly, the strap comprising: a proximal end configured to attach to an object; a distal end disposed oppositely disposed from the proximal end; a front surface disposed between the proximal end and the distal end; a back surface parallel to, and offset from, the front surface; and an array of teeth formed on the back surface, wherein the array of teeth is adjacent to the object; each of the array of teeth comprises: a slope; a flank; a peak defined by an intersection of the slope and the flank of each of the array of teeth; a root defined by an intersection of the slope and the flank of two respective adjacent teeth, respectively of the array of teeth; a tangential line passing through the root; wherein the slope is inclined to the tangential line through the root, at a first angle; and wherein the flank is inclined to the tangential line through the root, at a second angle.

Clause 29. The fastening system of clause 28, wherein each of the first angle and the second angle is acute.

Clause 30. A fastening system, comprising: a buckle assembly, comprising: a base; a slider slidingly attached to the base, the slider comprising: a first rib guideway; a strap passing through the buckle assembly, comprising: a proximal end configured to attach to an object; a distal end oppositely disposed from the proximal end; and a front surface disposed between the proximal end and the distal end; a first rib formed on the front surface, wherein the first rib passes through the first rib guideway of the buckle assembly.

Clause 31. The fastening system of clause 30, the buckle assembly further comprising: a second rib guideway.

Clause 32. The fastening system of clause 31, the strap further comprising: a second rib formed on the front surface and parallel to and offset from the first rib; wherein the second rib passes through the second rib guideway.

Clause 33. A fastening system, comprising: a buckle assembly formed with a first arc defining a first radius of curvature; and a strap passing through the buckle assembly comprising: a proximal end configured to attach to an object; a distal end disposed oppositely disposed from the proximal end; a front surface disposed between the proximal end and the distal end; a back surface parallel to, and offset from, the front surface; and an array of teeth formed on the back surface, wherein the array of teeth is adjacent to the object, wherein the back surface is formed with a second arc defining a second radius of curvature that is greater than the first radius of curvature.

Clause 34. A fastening system for adjusting an object, the fastening system comprising: a buckle assembly comprising: a base; a slider slidingly attached to the base, the slider comprising: an indentation; and a strap passing through the buckle assembly, comprising: a proximal end configured to attach to the object; a distal end oppositely disposed from the proximal end; a front surface disposed between the proximal end and the distal end; and a protrusion formed on the strap, wherein the protrusion is accommodated in the indentation of the buckle assembly.

Clause 35. A method of operating a fastening system, the method comprising: providing a buckle assembly for an object, the buckle assembly comprising: a base, comprising: a bottom adjoining the object; a top oppositely disposed from the bottom; and a pawl fixedly formed on the top; and a first digit surface configured to receive a first digit; a slider slidingly attached to the base, the slider comprising: a digit surface configured to receive a second digit, wherein the slider is movable between a first position and a second position; providing a strap, comprising: a proximal end attached to the object; a distal end oppositely disposed from the proximal end; a front surface between the proximal end and the distal end; a back surface parallel to, and offset from, the front surface; an array of teeth formed on the back surface, wherein the array of teeth is adjacent to the object; and a third digit surface formed on the strap; transitioning, alternatively, the fastening system between: an engaging condition wherein: the slider is positioned at the first position; the pawl is adjoining the array of teeth; and the first digit surface and the third digit surfaces are pinched; a releasing condition wherein: the slider is positioned at the second position; the strap is free-to-move relative to the buckle assembly; and the first digit surface and the digit surface are pinched.

Clause 36. The method of clause 35, wherein providing the strap further comprise: forming the third digit surface adjacent to the proximal end of the strap.

Clause 37. The method of clause 36, wherein providing the strap further comprises: forming the third digit surface on the top of the strap.

Clause 38. The method of clause 35, wherein providing transitioning the fastening system further comprises: reducing a strap distance between the first digit surface, on the base of the buckle assembly, and the third digit surface, on the strap; and reducing a sliding distance between the first digit surface the digit surface, on the slider of the buckle assembly, to release the array of teeth on the strap from the pawl on the base of the buckle assembly, wherein reducing the sliding distance increases the strap distance.

Clause 39. The method of clause 35, the method further comprising: engaging, in the engaged condition, the pawl with the array of teeth by manually applying equal and opposite forces to the digit surface and the first digit surface of the strap such that the strap covers the strap distance for tightening the fastening system; and disengaging, in the released condition, the pawl with the array of teeth by manually applying equal and opposite force to the first digit surface and the digit surface such that the slider covers the sliding distance; wherein the strap distance is greater than the sliding distance.

Clause 40. An anchor for attaching webbing to an object, the anchor comprising: a base; a cam rotationally attached to the base; and a terminal-edge formed on the base, wherein rotation of the cam compresses the webbing between the cam and the terminal-edge.

Clause 41. Webbing for binding an object, the webbing comprising: an elongated front-surface; an elongated back-surface oppositely disposed from the front-surface; indicia formed on the front-surface and the back-surface; and a friction-modifying pad located on either a front-side or a back-side of the surface.

The methods, systems, devices, graphs, and/or tables discussed herein are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims. Additionally, the techniques discussed herein may provide differing results with different types of context awareness classifiers.

Unless defined otherwise, all technical and scientific terms used herein have the same meaning as commonly or conventionally understood. As used herein, the articles "a" and "an" refer to one or to more than one (i.e., to at least one) of the grammatical object of the article. By way of example, "an element" means one element or more than one element. "About" and/or "approximately" as used herein when referring to a measurable value such as an amount, a temporal duration, and the like, encompasses variations of ±20% or ±10%, ±5%, or +0.1% from the specified value, as such variations are appropriate to in the context of the systems, devices, circuits, methods, and other implementations described herein. "Substantially" as used herein when referring to a measurable value such as an amount, a temporal duration, a physical attribute (such as frequency), and the like, also encompasses variations of ±20% or ±10%, ±5%, or +0.1% from the specified value, as such variations are appropriate to in the context of the systems, devices, circuits, methods, and other implementations described herein.

As used herein, including in the claims, "and" as used in a list of items prefaced by "at least one of" or "one or more of" indicates that any combination of the listed items may be used. For example, a list of "at least one of A, B, and C" includes any of the combinations A or B or C or AB or AC or BC and/or ABC (i.e., A and B and C). Furthermore, to the extent more than one occurrence or use of the items A, B, or C is possible, multiple uses of A, B, and/or C may form part of the contemplated combinations. For example, a list of "at least one of A, B, and C" may also include AA, AAB, AAA, BB, etc.

While illustrative and presently preferred embodiments of the disclosed systems, methods, and/or machine-readable media have been described in detail herein, it is to be understood that the inventive concepts may be otherwise variously embodied and employed, and that the appended claims are intended to be construed to include such variations, except as limited by the prior art. While the principles of the disclosure have been described above in connection with specific apparatuses and methods, it is to be clearly understood that this description is made only by way of example and not as limitation on the scope of the disclosure.

What is claimed is:

1. A fastening system for an object, the fastening system comprising:
- a strap comprising:
  - a proximal end;
  - a distal end oppositely disposed to the proximal end;
  - a front surface disposed between the proximal end and the distal end;
  - a back surface parallel to and offset from the front surface; and
  - an array of teeth formed between the proximal end and the distal end;
- a buckle assembly comprising:
  - a base comprising:
    - a bottom configured to be adjoined to the object;
    - a top oppositely disposed from the bottom;
    - a first wall protruding from the top;
    - a second wall protruding from the top and is parallel-to and offset-from the first wall; and
    - a first digit surface configured to receive a first force from a first digit of a hand;
  - wherein the second wall is separated from the first wall by a distance that is greater than a width of the strap;
- a slider slidingly engaged with the first wall and the second wall between a first position and a second position, the slider comprising:
  - a first guide slidingly engaged to the first wall;
  - a second guide slidingly engaged to the second wall; and
  - a second digit surface configured to receive a second force from a second digit of the hand; and
  - a lifter comprising a channel, wherein the channel allows passage of the strap therethrough;
- a pawl configured to engage with the array of teeth;
- a biasing member biasing the slider relative to the base;
- an engaged condition wherein:
  - the slider is at the first position;
  - the biasing member is at a first length;
  - the slider is offset from the top of the base by a first distance; and
  - the pawl is adjoining the array of teeth; and
- a released condition wherein:
  - the slider is transitioned to the second position;
  - the biasing member is at a second length that is smaller than the first length;
  - the slider is offset from the top of the base by a second distance that is greater than the first distance;
  - the pawl is not adjoining the array of teeth; and
  - the strap is free to move relative to the buckle assembly.

2. The fastening system of claim 1, wherein the strap further comprises:
- a third digit surface configured to receive a third force from either the first digit or the second digit of the hand during the engaged condition.

3. The fastening system of claim 1 and further comprising:
- a first attachment formed on the buckle assembly and configured to interface with the object; and
- a second attachment formed on the strap and configured to interface with the object.

4. The fastening system of claim 3 and further comprising:
- a first webbing attached to the first attachment, the first webbing being configured to attach to the object; and
- a second webbing attached to the second attachment, the second webbing being configured to attach to the object.

5. The fastening system of claim 1, wherein the lifter comprises either:
- a clamp, or
- a pair of L-shaped members.

6. The fastening system of claim 1 and further comprising:
- in the engaged condition:
  - the first force and the second force are zero; and
  - the slider is in the first position; and
- in the released condition:
  - the first force and the second force are equal and opposite;
  - the slider is transitioned to the second position; and
  - the lifter is configured to lift the strap to disengage the array of teeth from the pawl.

7. The fastening system of claim 1 and further comprising:
- a first hold pin formed on the base and extending towards the slider; and
- a second hold pin formed on the slider and extending towards the base,
- wherein the biasing member is adjoined to the first hold pin and the second hold pin.

8. The fastening system of claim 1 and further comprising:
- a first protrusion formed on the strap,
- wherein the first protrusion limits motion of the strap relative to the buckle assembly.

9. A method of fastening a fastening system on an object, the method comprising:
- providing a strap comprising:
  - a proximal end;
  - a distal end oppositely disposed to the proximal end;
  - a front surface disposed between the proximal end and the distal end;
  - a back surface parallel to and offset from the front surface; and
  - an array of teeth formed between the proximal end and the distal end;
- providing a buckle assembly comprising:
  - a base comprising:
    - a bottom configured to be adjacently adjoined to the object;
    - a top oppositely disposed from the bottom;
    - a first wall protruding from the top;
    - a second wall protruding from the top, parallel-to and offset-from the first wall,
    - wherein the second wall is separated from the first wall by a distance that is greater than a width of the strap; and a first digit surface configured to receive a first force from a first digit of a hand;

a slider slidingly engaged with the first wall and the second wall between a first position and a second position, the slider comprising:

a first guide slidingly engaged with the first wall;

a second guide slidingly engaged with the second wall;

a second digit surface configured to receive a second force from a second digit of the hand; and a lifter comprising a channel, wherein the channel allows a passage of the strap through therethrough;

a biasing member disposed between the base and the slider; and a pawl configured to engage with the array of teeth;

releasing the fastening system, the releasing comprising:

transitioning the slider from the first position to the second position wherein:

the biasing member is compressed from a first length to a second length, the second length being smaller than the first;

the slider is offset from the top of the base by a distance that is greater in the second position than in the first position;

the pawl is disengaged from the array of teeth; and the strap is free to move relative to the buckle assembly.

* * * * *